US007185504B2

(12) United States Patent
Kasai et al.

(10) Patent No.: US 7,185,504 B2
(45) Date of Patent: Mar. 6, 2007

(54) AIR CONDITIONER

(75) Inventors: Masaya Kasai, Sakai (JP); Sumio Shiochi, Sakai (JP); Ryuuji Akiyama, Kusatsu (JP); Kazuhisa Shigemori, Kusatsu (JP)

(73) Assignee: Daikin Industries Ltd., Osaka (JP)

( * ) Notice: Subject to any disclaimer, the term of this patent is extended or adjusted under 35 U.S.C. 154(b) by 741 days.

(21) Appl. No.: 10/468,285

(22) PCT Filed: Dec. 20, 2002

(86) PCT No.: PCT/JP02/13408

§ 371 (c)(1),
(2), (4) Date: Aug. 20, 2003

(87) PCT Pub. No.: WO03/058134

PCT Pub. Date: Jul. 17, 2003

(65) Prior Publication Data

US 2004/0079094 A1 Apr. 29, 2004

(30) Foreign Application Priority Data

Dec. 28, 2001 (JP) ..... 2001-398917

(51) Int. Cl.
*F25D 17/04* (2006.01)

(52) U.S. Cl. ..... 62/186; 62/404; 454/292; 454/306

(58) Field of Classification Search ..... 62/186, 62/404, 408, DIG. 16; 454/292, 306
See application file for complete search history.

(56) References Cited

U.S. PATENT DOCUMENTS 5,145,112 A * 9/1992 Ueda ..... 236/49.3
6,196,468 B1 * 3/2001 Young ..... 236/46 R
6,397,615 B1 * 6/2002 Kawai et al. ..... 62/244

FOREIGN PATENT DOCUMENTS

| | | |
|---|---|---|
| JP | 2-143046 A | 6/1990 |
| JP | 2-169945 A | 6/1990 |
| JP | 4-297740 A | 10/1992 |
| JP | 05-187707 A | 7/1993 |
| JP | 5-223319 A | 8/1993 |
| JP | 10-115447 A | 5/1998 |
| KR | 96007980 B1 | 6/1996 |

* cited by examiner

*Primary Examiner*—Melvin Jones
(74) *Attorney, Agent, or Firm*—Birch, Stewart, Kolasch & Birch, LLP

(57) ABSTRACT

An operational air conditioning mode is allowed to set to a temperature uniformization mode and a spot air conditioning mode, and is selectively switched between these modes automatically by a control means (53) or manually. In such an embodiment, a comfortably air-conditioned state is obtained in all the areas of a space to be air-conditioned W during air conditioning performed in the temperature uniformization mode, and the comfort is ensured by intensively air-conditioning the surroundings of a person during air conditioning performed in the spot air conditioning mode. At the same time, since an unnecessary air conditioning is not provided to a region without the presence of a person, energy conservation is improved, for example, and thus the comfort of air conditioning and energy conservation are both achieved.

14 Claims, 25 Drawing Sheets

FIG. 27

| Exemplary automatic change of recommendable set temperature (when operational mode is switched based on distribution of people) | | | | | | |
|---|---|---|---|---|---|---|
| | | Early morning・ midnight | | Daytime | | Energy conservation |
| | | (1) | (2) | (3) | (4) | |
| | Operational mode | Temperature uniformization | Spot | Temperature uniformization | Spot | |
| | Number of people | Large | Small | Large | Small | |
| Cooling operation | Load | Low | | High | | (2)>(1)>(4)>(3) |
| | Set temperature | 24→26 (automatically changed) | | 24(unchanged) | | |
| Heating operation | Load | High | | Low | | (4)>(3)>(2)>(1) |
| | Set temperature | 22(unchanged) | | 22→20 (automatically changed) | | |

FIG. 28

| | Prior art | | Present invention | | | |
|---|---|---|---|---|---|---|
| Time period | Set temperature ℃ | Power consumption KW | Set temperature ℃ | Power consumption KW | Reduction | operational air conditioning mode |
| 0 o'clock to 4 o'clock | 24 | 15 | 27 | 12 | -0.02 | spot air conditioning |
| 4 o'clock to 8 o'clock | 24 | 14 | 27 | 11 | -0.02 | spot air conditioning |
| 8 o'clock to 12 o'clock | 24 | 31 | 25 | 29 | -0.01 | spot air conditioning/ temperature uniformization |
| 12 o'clock to 16 o'clock | 24 | 42 | 24 | 42 | -0.00 | temperature uniformization |
| 16 o'clock to 20 o'clock | 24 | 32 | 26 | 27 | -0.03 | spot air conditioning/ temperature uniformization |
| 20 o'clock to 24 o'clock | 24 | 28 | 26 | 24 | -0.02 | spot air conditioning |
| Total | | 161 | | 145 | -0.01 | |

AIR CONDITIONER

This application is the national phase under 35 U.S.C. § 371 of PCT International Application No. PCT/JP02/13408 which has an International filing date of Dec. 20, 2002, which designated the United States of America.

TECHNICAL FIELD

The present invention relates to an air conditioning apparatus that is provided with: an inlet located at the center of the bottom face of an indoor unit; and a plurality of elongated rectangular outlets located to surround the periphery of the inlet, and that is installed such that the indoor unit is embedded in or hung from a ceiling.

BACKGROUND ART

For example, in order to provide air conditioning to a relatively large space to be air-conditioned such as a shop, a restaurant or an office in a building, an indoor unit of the type embedded in a ceiling or of the type hung from a ceiling has heretofore generally been disposed at a ceiling located above the space to be air-conditioned.

In providing air conditioning to such a large space to be air-conditioned using an indoor unit of the type embedded in a ceiling or of the type hung from a ceiling, air flows have conventionally been discharged uniformly from respective outlets of the indoor unit without giving any thoughts to air conditioning requirement such as distribution of heat load or distribution of people within the space to be air-conditioned. This has been causing, for example, a problem that temperature variations occur in the space to be air-conditioned to create an area inferior in comfort accompanied with draftiness, another problem that an area without the presence of a person is air-conditioned as with an area with the presence of a person, and still another problem that energy conservation is impaired because of the execution of unnecessary and needless air conditioning as a result of, for example, always running an air conditioning apparatus under a predetermined condition even though the heat load distribution in the space to be air-conditioned varies with time depending on criteria such as season, time of day and the number of people present in a room.

Proposed solutions to these prior-art problems include: a technique in which distribution of heat load or distribution of people in a space to be air-conditioned, for example, is detected, and based on the detected information, the characteristic of an air flow discharged through an outlet of an indoor unit, e.g., quantity of air discharge, temperature of air discharge, velocity of air discharge or direction of air discharge, is appropriately controlled, thus performing air conditioning that achieves comfort at all times and accomplishes outstanding energy conservation (see Japanese Unexamined Patent Publication No. 5-203244 and Japanese Unexamined Patent Publication No. 5-306829, for example); and another technique in which an infrared sensor is used as a means for detecting, for example, distribution of heat load (see Japanese Unexamined Patent Publication No. 5-20659, for example).

Solution

However, although the proposed prior-art techniques described above as well-known examples are theoretically thought to provide necessary functionality and make the expected effects obtainable, the technical disclosures thereof are not implementable or not realistic, and therefore, the fact is that the above-described techniques are not yet brought into practical use. Accordingly, there is a strong demand that practice of the above-described techniques be established and implemented as soon as possible. In addition, a control mode suitable for achievement of the comfort of air conditioning and energy conservation is likewise demanded.

Hence, the object of the present invention is to achieve both of comfort and energy conservation with the use of an air conditioning apparatus including: a detection means for detecting, for example, a heat load; an air flow changing means for changing the characteristic of a discharged air flow; and a control means for the air flow changing means, by providing each of these means in more implementable and realistic form to promote the practical use thereof and by providing a control mode of air conditioning suitable for improvement of comfort and energy conservation.

DISCLOSURE OF INVENTION

The present invention employs the following arrangements as implementable solutions to the above-described problems.

A first invention is directed to an air conditioning apparatus including: an indoor panel 2 that is disposed at the bottom side of a ceiling 50, and is provided with an inlet 3 and a plurality of outlets 4, 4, . . . rectangularly surrounding the periphery of the inlet 3; detection means 51 including an infrared sensor 15 for detecting as a radiation temperature the temperature of an object in a space to be air-conditioned W; air flow changing means 52 for changing the characteristic of an air flow discharged from each of the outlets 4, 4, . . . ; and control means 53 for controlling the operation of the air flow changing means 52 based on detection information detected by the detection means 51 and operation information concerning the operation of the air conditioning apparatus. Furthermore, an operational air conditioning mode of the air conditioning apparatus is selectively switched between a temperature uniformization mode in which temperature distribution in the space to be air-conditioned W is uniformized, and a spot air conditioning mode in which the surroundings of a human body M present in the space to be air-conditioned W are intensively air-conditioned, and the operational air conditioning mode is switched automatically by the control means 53 or manually.

In a second invention based on the first invention, the operational air conditioning mode is switched automatically by the control means 53. Furthermore, the space to be air-conditioned W is divided into a plurality of areas, and the operational air conditioning mode is set to the temperature uniformization mode when it is detected by the detection means 51 that the percentage of the area with the presence of a human body M to the plurality of areas is above a predetermined level, while the operational air conditioning mode is set to the spot air conditioning mode when it is detected by the detection means 51 that the percentage is below the predetermined level.

In a third invention based on the first invention, the operational air conditioning mode is switched automatically by the control means 53. Furthermore, the operational air conditioning mode is switched to the temperature uniformization mode when it is detected by the detection means 51 that the level of a load applied to the overall space to be air-conditioned W is above a predetermined level, while the operational air conditioning mode is switched to the spot air conditioning mode when it is detected by the detection means 51 that the load level is below the predetermined level.

In a fourth invention based on the first, second or third invention, the operational air conditioning mode is continuously set to the temperature uniformization mode during a predetermined time period subsequent to the start of air conditioning operation or the switching of the operational air conditioning mode, and after the predetermined time has been elapsed, the control over the switching of the operational air conditioning mode is carried out based on the detection information detected by the infrared sensor 15.

In a fifth invention based on the first, second or third invention, the switching of the operational air conditioning mode is executed based on each time period of a day.

In a sixth invention based on the first, second, third, fourth or fifth invention, the control of air conditioning capacity is carried out based on the temperature of radiation emitted from an object in a predetermined area which is detected by the detection means 51, and a set temperature that has been set in advance.

In a seventh invention based on the sixth invention, a recommendable set temperature is used instead of the set temperature depending on the load level detected by the detection means 51.

In an eighth invention based on the first, second, third, fourth, fifth, sixth or seventh invention, the detection means 51 further includes, in addition to the infrared sensor 15, a temperature and humidity sensor 16 for detecting the temperature of an intake air taken into the inlet 3.

In a ninth invention based on the eighth invention, the infrared sensor 15 is formed to detect the position of a human body in the space to be air-conditioned W, and the temperature and humidity sensor 16 is formed to detect the temperature of an intake air.

In a tenth invention based on the ninth invention, a plurality of the temperature and humidity sensors 16 are provided so that each temperature and humidity sensor 16 detects the temperature of an intake air from an associated one of the areas of the space to be air-conditioned W. Furthermore, the radiation temperature from each of the areas detected by the infrared sensor 15 and the intake air temperature from each of the areas detected by the associated one of the temperature and humidity sensors 16, 16, . . . are each assigned a predetermined weight and are summed to determine the measurement temperature of each of the areas. In addition, the weight assignment to the radiation temperature and the intake air temperature are made such that the weight assigned to the intake air temperature is increased in the temperature uniformization mode, and the weight assigned to the radiation temperature is increased in the spot air conditioning mode.

In an eleventh invention based on the first, second, third, fourth, fifth, sixth, seventh, eighth, ninth or tenth invention, the air flow changing means 52 includes: an air quantity distribution mechanism 10 for changing the ratio of distribution of air quantities discharged from the outlets 4, 4, . . . ; a first flap 12 for changing the lateral discharge direction of an air flow discharged from the associated outlet 4; and a second flap 13 for changing the longitudinal discharge direction of the air flow discharged from the associated outlet 4. Furthermore, the air quantity distribution mechanism 10, the first flap 12 and the second flap 13 associated with each of the outlets 4, 4, . . . are formed so that they are operable independently and separately from their counterparts.

In a twelfth invention based on the first, second, third, fourth, fifth, sixth, seventh, eighth, ninth or tenth invention, the air flow changing means 52 includes: an air quantity distribution mechanism 10 for changing the ratio of distribution of air quantities discharged from the outlets 4, 4, . . . ; a first flap 12 for changing the lateral discharge direction of an air flow discharged from the associated outlet 4; and a second flap 13 for changing the longitudinal discharge direction of the air flow discharged from the associated outlet 4. Furthermore, the air quantity distribution mechanism 10 and the first flap 12 associated with each of the outlets 4, 4, . . . are formed so that they are operable independently and separately from their counterparts. On the other hand, the second flap 13 associated with each of the outlets 4, 4, . . . is formed to operate together with its counterpart.

In a thirteenth invention based on the first, second, third, fourth, fifth, sixth, seventh, eighth, ninth, tenth, eleventh or twelfth invention, the air quantity distribution mechanism 10 and the first flap 12 are each provided in an upstream region of a discharge duct 14 continuous with the outlet 4. Furthermore, a driving mechanism 29 for the air quantity distribution mechanism 10 and a driving mechanism 30 for the first flap 12 are provided at respective longitudinal ends of the discharge duct 14.

In a fourteenth invention based on the thirteenth invention, the air quantity distribution mechanism 10 includes a distribution shutter 11 attached so that the shutter 11 is allowed to assume a position adjacent to a side wall of the discharge duct 14 extending in a longitudinal direction thereof, and to tilt toward an inward region of the discharge duct 14. Furthermore, the distribution shutter 11 is formed to assume a position adjacent to the longitudinally extending side wall of the discharge duct 14 when the area of an opening of the discharge duct 14 is increased, and to assume a position at an upstream side region of the discharge duct 14 when the area of the opening is reduced.

-Effects of Invention-

The present invention achieves the following effects by employing the above-described arrangements.

(A) According to the first invention, the operational air conditioning mode of the air conditioning apparatus is selectively switched between the temperature uniformization mode in which temperature distribution in the space to be air-conditioned W is uniformized, and the spot air conditioning mode in which the surroundings of a human body M present in the space to be air-conditioned W are intensively air-conditioned, and the operational air conditioning mode is switched automatically by the control means 53 or manually. Therefore, for example, in a situation where people are present evenly in the space to be air-conditioned W, air conditioning is performed in the temperature uniformization mode, thus obtaining a comfortably air-conditioned state in all the areas of the space to be air-conditioned W.

Besides, in a situation where people are scattered in the space to be air-conditioned W, air conditioning is performed in the spot air conditioning mode to intensively air-condition the surroundings of the people, thus making it possible to ensure the comfort of air conditioning. At the same time, air conditioning is not provided to a region without the presence of a person, i.e., needless and wasteful air conditioning is not provided, which improves energy conservation, for example, thus achieving both of the comfort of air conditioning and energy conservation.

Further, the first invention has an advantage that when the switching of the operational air conditioning mode is automatically performed by the control means 53, no complicated manipulation is required, thus carrying out operational control of the air conditioning apparatus with ease.

Furthermore, the first invention has another advantage that when the switching of the operational air conditioning mode is performed manually, a person who directly enjoys the comfort of air conditioning in the space to be air-conditioned W not only achieves energy conservation and comfort but also can further improve the comfort by reflecting his or her own preference in the switching of the operational air conditioning mode.

(B) According to the second invention, in addition to the effects set forth in the section (A), the following unique effects are obtained.

In this invention directed to the air conditioning apparatus in which the operational air conditioning mode is switched automatically by the control means 53, the space to be air-conditioned W is divided into a plurality of areas, and the operational air conditioning mode is set to the temperature uniformization mode when it is detected by the detection means 51 that the percentage of the area with the presence of a human body M to the plurality of areas is above a predetermined level, while the operational air conditioning mode is set to the spot air conditioning mode when it is detected by the detection means 51 that the percentage is below the predetermined level.

Therefore, during air conditioning performed in the temperature uniformization mode, the temperatures of the plurality of areas are uniformized to allow all the people present in the plurality of areas to enjoy highly comfortable air conditioning.

On the other hand, during air conditioning performed in the spot air conditioning mode, only the area with the presence of a human body M which is to be air-conditioned is intensively air-conditioned, thus obtaining the comfort of air conditioning in the area. At the same time, since needless air conditioning is not provided to the area without the presence of a human body M, energy conservation is ensured, for example, thus achieving both of the comfort of air conditioning and energy conservation.

Furthermore, since the percentage of the area with the presence of a human body M is employed as the criterion for switching the operational air conditioning mode, the switching of the mode can be carried out based on whether or not there is the necessity for air conditioning, and thus it can be expected that the comfort of air conditioning and energy conservation will be further improved.

(C) According to the third invention, in addition to the effects set forth in the section (A), the following unique effects are obtained.

In this invention directed to the air conditioning apparatus in which the operational air conditioning mode is switched automatically by the control means 53, the operational air conditioning mode is switched to the temperature uniformization mode when it is detected by the detection means 51 that the level of a load applied to the overall space to be air-conditioned W is above a predetermined level, while the operational air conditioning mode is switched to the spot air conditioning mode when it is detected by the detection means 51 that the load level is below the predetermined level.

Therefore, if the load level in the overall space to be air-conditioned W is above the predetermined level, i.e., if there is a great demand that the temperature of the overall space to be air-conditioned W be increased or decreased, air conditioning is carried out in the temperature uniformization mode, thus satisfying the demand and obtaining an outstanding comfort. On the other hand, air conditioning is carried out in the spot air conditioning mode if the load level in the overall space to be air-conditioned W is below the predetermined level, i.e., if a demand for an intensive increase or decrease in only the temperature of a specified region such as a region with the presence of a lot of people is greater than a demand for an increase or decrease in the temperature of the overall space to be air-conditioned W. Accordingly, the immediate demand is satisfied to obtain an outstanding comfort, and at the same time, air conditioning is not provided to the region in which there is a little necessity for air conditioning, thus promoting energy conservation, for example, and achieving both of the comfort of air conditioning and energy conservation.

(D) According to the fourth invention, in addition to the effects set forth in the sections (A), (B) or (C), the following unique effects are obtained.

In this invention, the operational air conditioning mode is continuously set to the temperature uniformization mode during a predetermined time period subsequent to the start of air conditioning operation or the switching of the operational air conditioning mode, and after the predetermined time period has been elapsed, the control over the switching of the operational air conditioning mode is carried out based on the detection information detected by the detection means 51.

Therefore, until the predetermined time period is elapsed, i.e., until the operational state of the air conditioning apparatus is stabilized to a certain extent, air conditioning is performed in the temperature uniformization mode in which the operation of each air flow changing means 52, for example, provided to be associated with the corresponding one of the outlets 4, 4, . . . is rarely changed. After the operational state of the air conditioning apparatus has been stabilized to a certain extent, air conditioning is performed in the spot air conditioning mode in which the operation of each air flow changing means 52, for example, is often changed. Consequently, the air conditioning apparatus is stably operated, which eventually promotes the stabilization of the air conditioning characteristic, and thus it can be expected that the comfort of air conditioning will be further improved.

(E) According to the fifth invention, in addition to the effects set forth in the sections (A), (B) or (C), the following unique effects are obtained.

In this invention, the switching of the operational air conditioning mode is executed based on each time period of a day. For example, when a restaurant is air-conditioned, air conditioning is carried out in the temperature uniformization mode at mealtime during which the number of guests is large and a heat load applied from a kitchen is high, because at this time period there is a great demand that comfort be ensured by uniformly air-conditioning the entire area of the restaurant. Air conditioning is carried out in the spot air conditioning mode at time periods other than mealtime, i.e., at the time periods during which the number of guests is a few and a heat load applied from the kitchen is low, because at these time periods there is a demand that only the area of the restaurant where a guest is present be intensively air-conditioned in consideration of both of comfort and energy conservation. In this manner, air conditioning is carried out in accordance with the load level that varies depending on each time period of a day, thus making it possible to further improve the comfort of air conditioning and energy conservation.

(F) According to the sixth invention, in addition to the effects set forth in the sections (A), (B), (C), (D) or (E), the following unique effects are obtained.

In this invention, the control of air conditioning capacity is carried out based on the temperature of radiation emitted from an object in a predetermined area which is detected by the detection means 51, and a set temperature that has been set in advance.

Therefore, it can be expected that energy conservation will be improved by avoiding the operation of the air conditioning apparatus which provides an excessive capacity in reducing the actual load level in the space to be air-conditioned W, and it can also be expected that the comfort of air conditioning will be improved by avoiding the operation of the air conditioning apparatus which provides an insufficient capacity in reducing the load level.

(G) According to the seventh invention, in addition to the effects set forth in the section (F), the following unique effects are obtained.

In this invention, a recommendable set temperature is used instead of the set temperature depending on the load level detected by the detection means 51.

Therefore, when cooling operation is performed, the set temperature is normally set in accordance with the maximum load applied during the day time, and when heating operation is performed, the set temperature is set in accordance with the maximum load applied in the early morning. Accordingly, in performing cooling operation and heating operation, the control of air conditioning capacity is carried out based on the set temperature when the load level is high, and is carried out based on the recommendable set temperature when the load level is low. As a result, needless air conditioning capacity is not provided, thus further improving energy conservation.

(H) According to the eighth invention, in addition to the effects set forth in the sections (A), (B), (C), (D), (E), (F) or (G), the following unique effects are obtained.

In this invention, the detection means 51 further includes, in addition to the infrared sensor 15, a temperature and humidity sensor 16 for detecting the temperature of an intake air taken into the inlet 3. Therefore, the radiation temperature detected by the infrared sensor 15, for example, is corrected using the temperature of an intake air detected by the temperature and humidity sensor 16, and the corrected value is employed as the average temperature of the space to be air-conditioned W.

Thus, the reliability of the average temperature of the space to be air-conditioned W is improved compared with the case where the average temperature of the space to be air-conditioned W is calculated based on the value detected by the infrared sensor 15, the control of air conditioning capacity carried out based on the average temperature is eventually improved in reliability, and it can be expected that energy conservation in air conditioning will be further improved accordingly.

(I) According to the ninth invention, in addition to the effects set forth in the section (H), the following unique effects are obtained.

In this invention, the infrared sensor 15 is formed to detect the position of a human body in the space to be air-conditioned W, and the temperature and humidity sensor 16 is formed to detect the temperature of an intake air.

Therefore, since the infrared sensor 15 is required to detect only the human body position, the processing of information detected by the infrared sensor 15 can be performed with ease and the control system can be accordingly simplified compared with the case where the infrared sensor 15 detects, for example, both of the human body position and temperature distribution inside a room. At the same time, the required precision can be ensured in detecting the temperature distribution inside the room with the use of the temperature sensor or the temperature and humidity sensor 16 that is less expensive than the infrared sensor 15. Due to a synergistic effect obtained by the use of these sensors, the ensuring of accuracy in detection information and cost reduction are both achieved.

(J) According to the tenth invention, in addition to the effects set forth in the section (I), the following unique effects are obtained.

In this invention, a plurality of the temperature and humidity sensors 16 are provided so that each temperature and humidity sensor 16 detects the temperature of an intake air from an associated one of the areas of the space to be air-conditioned W, and the radiation temperature from each of the areas detected by the infrared sensor 15 and the intake air temperature from each of the areas detected by the associated one of the temperature and humidity sensors 16, 16, . . . are each assigned a predetermined weight and summed to determine the measurement temperature of each of the areas. The weight assignment to the radiation temperature and the intake air temperature are made such that the weight assigned to the intake air temperature is increased in the temperature uniformization mode, and the weight assigned to the radiation temperature is increased in the spot air conditioning mode.

Therefore, when air conditioning is performed in the temperature uniformization mode, it is allowed to eliminate, to the extent possible, an error caused by an unusual detection value that is detected by the infrared sensor 15 due to variations in the rate of heat radiation of an object, and thus the air conditioning apparatus is controlled using the measurement temperature obtained mainly based on the intake air temperature detected by the temperature and humidity sensor 16, i.e., the reliable temperature that is unlikely to be an unusual detection value. On the other hand, when air conditioning is performed in the spot air conditioning mode, the air conditioning apparatus is controlled using the measurement temperature obtained mainly based on the radiation temperature of a human body that needs an intensive air conditioning, thus realizing more comfortable air conditioning.

(K) In the air conditioning apparatus according to the eleventh invention, in addition to the effects set forth in the sections (A), (B), (C), (D), (E), (F), (G), (H), (I) or (J), the following unique effects are obtained.

In this invention based on the first, second, third, fourth, fifth, sixth, seventh, eighth, ninth or tenth invention, the air flow changing means 52 is formed to include: an air quantity distribution mechanism 10 for changing the ratio of distribution of air quantities discharged from the outlets 4, 4, . . . ; a first flap 12 for changing the lateral discharge direction of an air flow discharged from the associated outlet 4; and a second flap 13 for changing the longitudinal discharge direction of the air flow discharged from the associated outlet 4, and the air quantity distribution mechanism 10, the first flap 12 and the second flap 13 associated with each of the outlets 4, 4, . . . are formed so that they are operable independently and separately from their counterparts.

Therefore, the characteristic of an air flow discharged from each of the outlets 4, 4, . . . can be minutely controlled, and the comfort of air conditioning and energy conservation are further improved accordingly.

(L) In the air conditioning apparatus according to the twelfth invention, in addition to the effects set forth in the sections (A), (B), (C), (D), (E), (F), (G), (H), (I) or (J), the following unique effects are obtained.

In this invention based on the first, second, third, fourth, fifth, sixth, seventh, eighth, ninth or tenth invention, the air flow changing means 52 is formed to include: an air quantity distribution mechanism 10 for changing the ratio of distribution of air quantities discharged from the outlets 4, 4, . . . ; a first flap 12 for changing the lateral discharge direction of an air flow discharged from the associated outlet 4; and a second flap 13 for changing the longitudinal discharge direction of the air flow discharged from the associated outlet 4, and the air quantity distribution mechanism 10 and the first flap 12 associated with each of the outlets 4, 4, . . . are formed so that they are operable independently and separately from their counterparts; on the other hand, the second flap 13 associated with each of the outlets 4, 4, . . . is formed to operate together with its counterpart.

Therefore, in the air conditioning apparatus according to the present invention, the characteristic of an air flow discharged from each of the outlets 4, 4, . . . can be minutely controlled by the air quantity distribution mechanism 10 and the first flap 12. This improves the comfort of air conditioning and energy conservation compared with the arrangement in which the air quantity distribution mechanism 10 and the first flap 12 associated with each the outlets 4, 4, . . . are operated together with their counterparts, for example. Furthermore, the second flaps 13, 13, . . . each provided in the associated one of the outlets 4, 4, . . . can be driven by using a single driving source. Consequently, compared with the case where the second flaps 13, 13, . . . are driven by separate driving sources, for example, the cost and structural complexity of the air conditioning apparatus can be reduced by the decrease in the number of the driving sources to be provided, which enables not only the improvement in the comfort of air conditioning and energy conservation but also the promotion of cost reduction for the air conditioning apparatus.

(M) According to the thirteenth invention, in addition to the effects set forth in the sections (A), (B), (C), (D), (E), (F), (G), (H), (I), (J), (K) or (L), the following unique effects are obtained.

In this invention based on the first, second, third, fourth, fifth, sixth, seventh, eighth, ninth, tenth, eleventh, or twelfth invention, the air quantity distribution mechanism 10 and the first flap 12 are each provided in an upstream region of a discharge duct 14 continuous with the outlet 4, and a driving mechanism 29 for the air quantity distribution mechanism 10 and a driving mechanism 30 for the first flap 12 are provided at respective longitudinal ends of the discharge duct 14.

Therefore, the air quantity distribution mechanism 10, the first flap 12 and the driving mechanisms 29 and 30 thereof are compactly provided in the region of the discharge duct 14 having a restricted space. As a result, the indoor panel 2 can be reduced in thickness, i.e., size.

(N) According to the fourteenth invention, in addition to the effects set forth in the section (M), the following unique effects are obtained.

In this invention based on the thirteenth invention, the air quantity distribution mechanism 10 includes a distribution shutter 11 attached so that the shutter 11 is allowed to assume a position adjacent to a side wall of the discharge duct 14 extending in a longitudinal direction thereof, and to tilt toward an inward region of the discharge duct 14. The distribution shutter 11 is formed to assume a position adjacent to the longitudinally extending side wall of the discharge duct 14 when the area of an opening of the discharge duct 14 is increased, and to assume a position at an upstream side region of the discharge duct 14 when the area of the opening is reduced.

Therefore, when the opening area of the discharge duct 14 is increased, i.e., when the quantity of air discharge is increased, the distribution shutter 11 assumes a position at the region of the discharge duct 14 where the velocity of flow is low, so as to reduce draft resistance caused by the distribution shutter 11, thus ensuring air quantity with certainty and reducing noise due to a blown air. On the other hand, when the opening area of the discharge duct 14 is reduced, i.e., the quantity of air discharge is reduced, the distribution shutter 11 assumes a position at the upstream side region of the discharge duct 14, thus suppressing, to the extent possible, the disturbance of an air flow at a region of the outlet 4 located at the downstream side end of the discharge duct 14. As a result, it is allowed to prevent condensation from occurring at a portion of the indoor panel 2 adjacent to the outlet 4, and contamination from occurring at a ceiling surface due to the collision of the disturbed discharged air flow thereto.

BRIEF DESCRIPTION OF THE DRAWINGS

FIG. 27 is a diagram illustrating an exemplary operation for the automatic adjustment of recommendable set temperature.

FIG. 28 is a diagram illustrating an exemplary setting of an operational air conditioning mode for each time period of a day.

BEST MODE FOR CARRYING OUT THE INVENTION

Hereinafter, the present invention will be described in detail based on preferred embodiments thereof.

I: First Embodiment of Air Conditioning Apparatus

Figure 1:
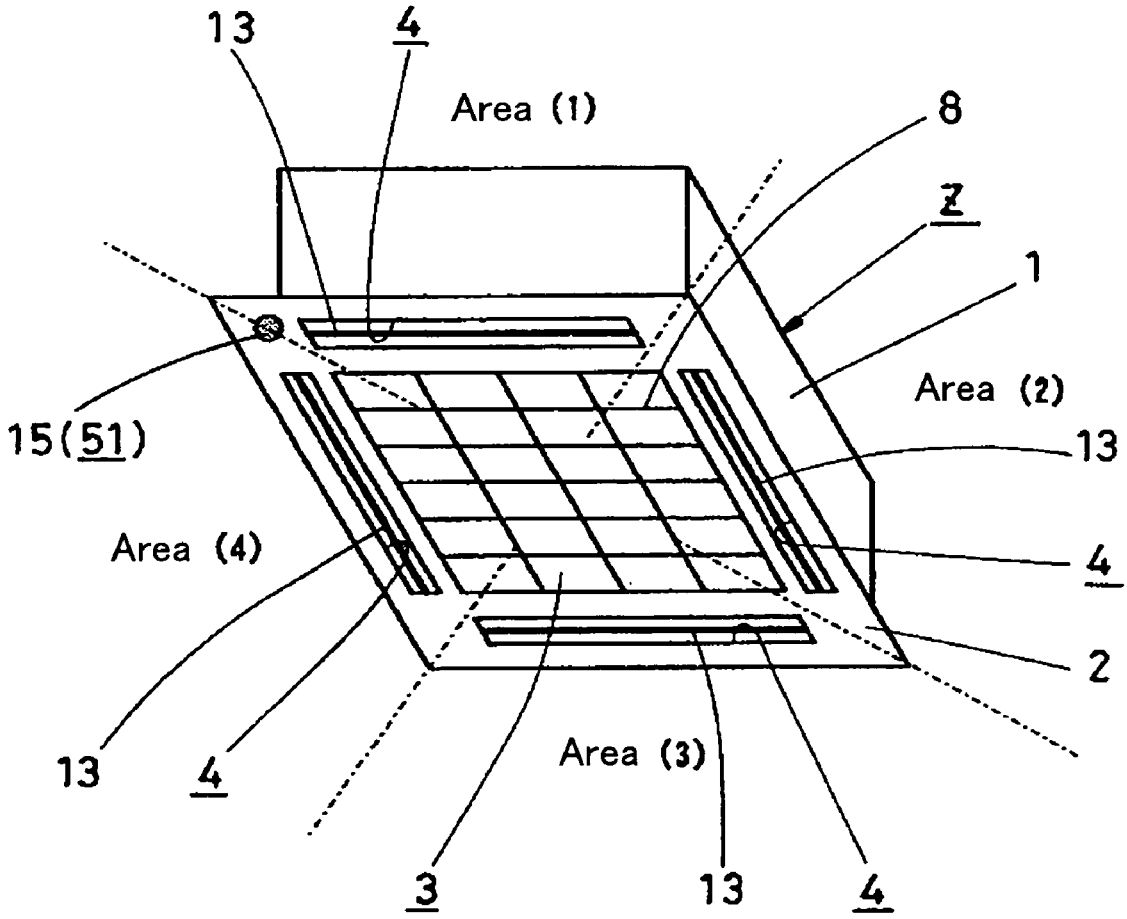
FIG. 1 is an oblique view of an indoor unit of an air conditioning apparatus according to a first embodiment of the present invention, as viewed from the inside of a room.
Figure 2:
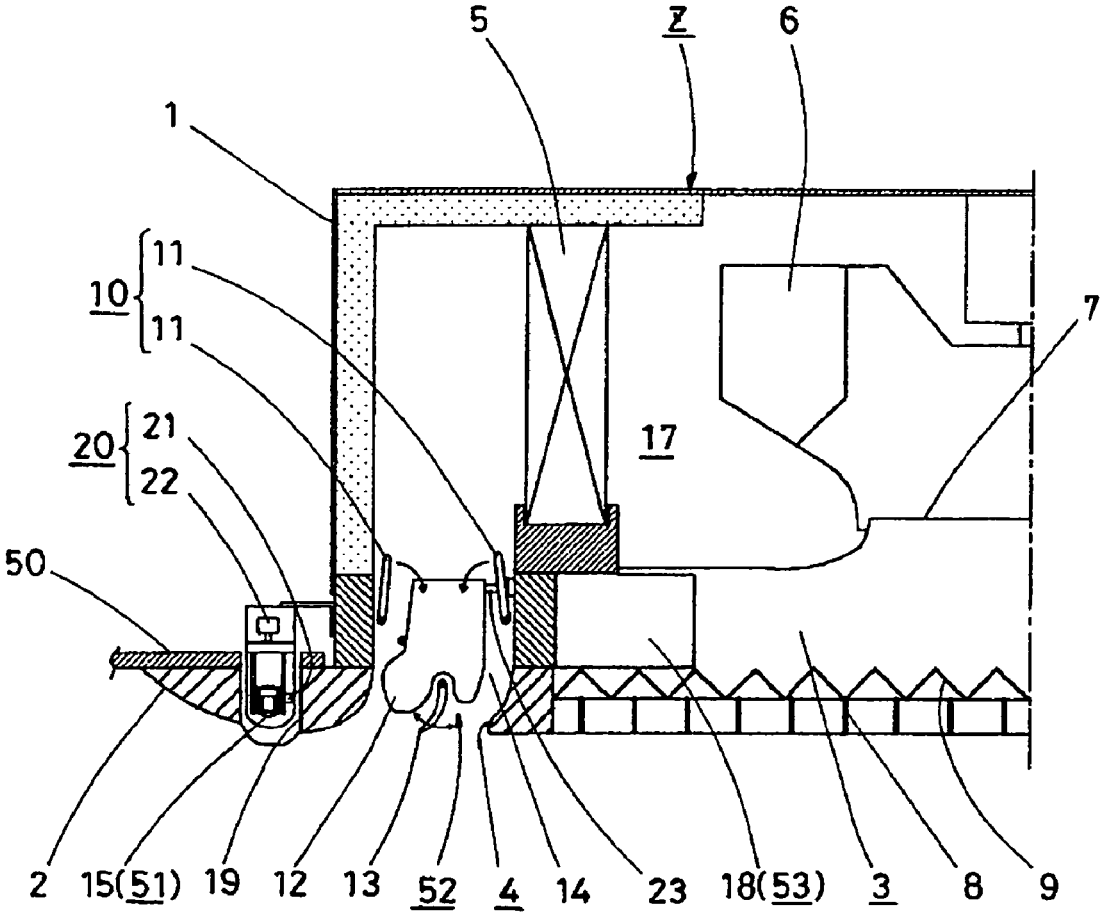
FIG. 2 is an enlarged cross-sectional view of a principal portion of the indoor unit shown in FIG. 1.

FIGS. 1 and 2 show an indoor unit Z of a separate type air conditioning apparatus as the first embodiment of an air conditioning apparatus according the present invention. The indoor unit Z is a ceiling-embedded type indoor unit embedded in a ceiling 50 above the inside of a room, and has a basic structure similar to a conventionally known one. Specifically, the indoor unit Z includes: a rectangular box-like casing 1 embedded in the ceiling 50 so that the casing 1 is located above the ceiling 50; and a rectangular flat-shaped indoor panel 2 that is placed at an opening of a lower end of the casing 1 from the inside of the room. The indoor panel 2 is provided at its center with an inlet 3 formed by a rectangular opening. Provided outwardly of the inlet 3 are four outlets 4, 4, . . . that are formed by elongated rectangular openings so as to rectangularly surround the inlet 3, and that are each extended substantially parallel to an associated outer edge of the indoor panel 2.

Further, the casing 1 is provided, at its inner space extending from the inlet 3 to each of the outlets 4, 4, . . . , with an air passage 17 in which a centrifugal fan 6 is located coaxially with the inlet 3, and a heat exchanger 5 is located outwardly of the fan 6 so as to surround this. Furthermore, a bell mouth 7 is provided at the suction side of the fan 6, and a filter 9 and a suction grill 8 are placed in the inlet 3.

On the other hand, provided upstream of the outlet 4 is a discharge duct 14 having an elongated cross section continuous with the outlet 4 and extending upward to form a downstream-side region of the air passage 17. Provided in the discharge duct 14 are an air quantity distribution mechanism 10, a first flap 12 and a second flap 13 that are described later. It should be noted that the air quantity distribution mechanism 10, first flap 12 and second flap 13 constitute an "air flow changing means 52" recited in the claims.

In addition, provided at a portion of the indoor panel 2 located between the openings of the outlets 4, 4, . . . is an infrared sensor 15 that constitutes a "detection means 51" recited in the claims. Located adjacent to the discharge duct 14 is a controller 18 (equivalent to "control means 53" recited in the claims) for controlling, upon receipt of detection information from the infrared sensor 15, the operations of the air quantity distribution mechanism 10, first flap 12 and second flap 13 of the air flow changing means 52, for example.

First, the specific configuration of each of the above-mentioned constituting elements will be described.

(I-a) Configuration of Air Quantity Distribution Mechanism 10

Figure 5:
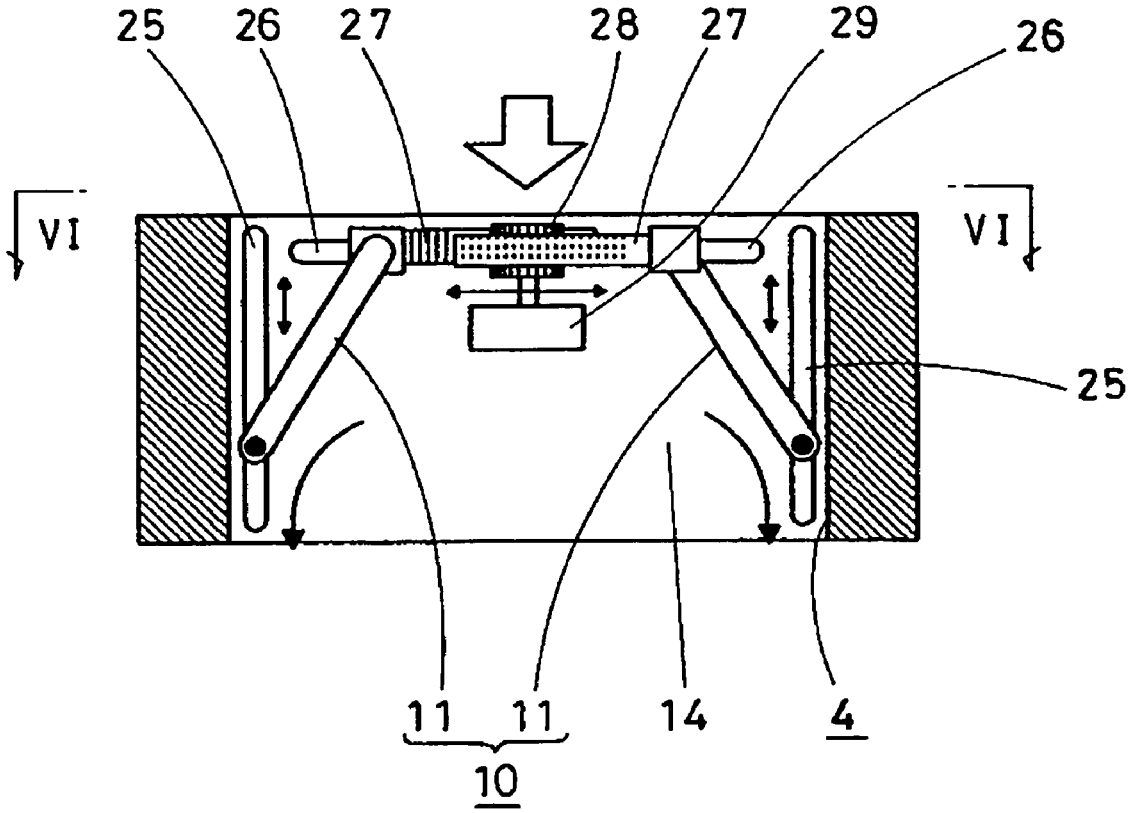
FIG. 5 is a cross-sectional view illustrating a first exemplary structure of an air quantity distribution mechanism provided in an outlet of an indoor unit.
Figure 6:
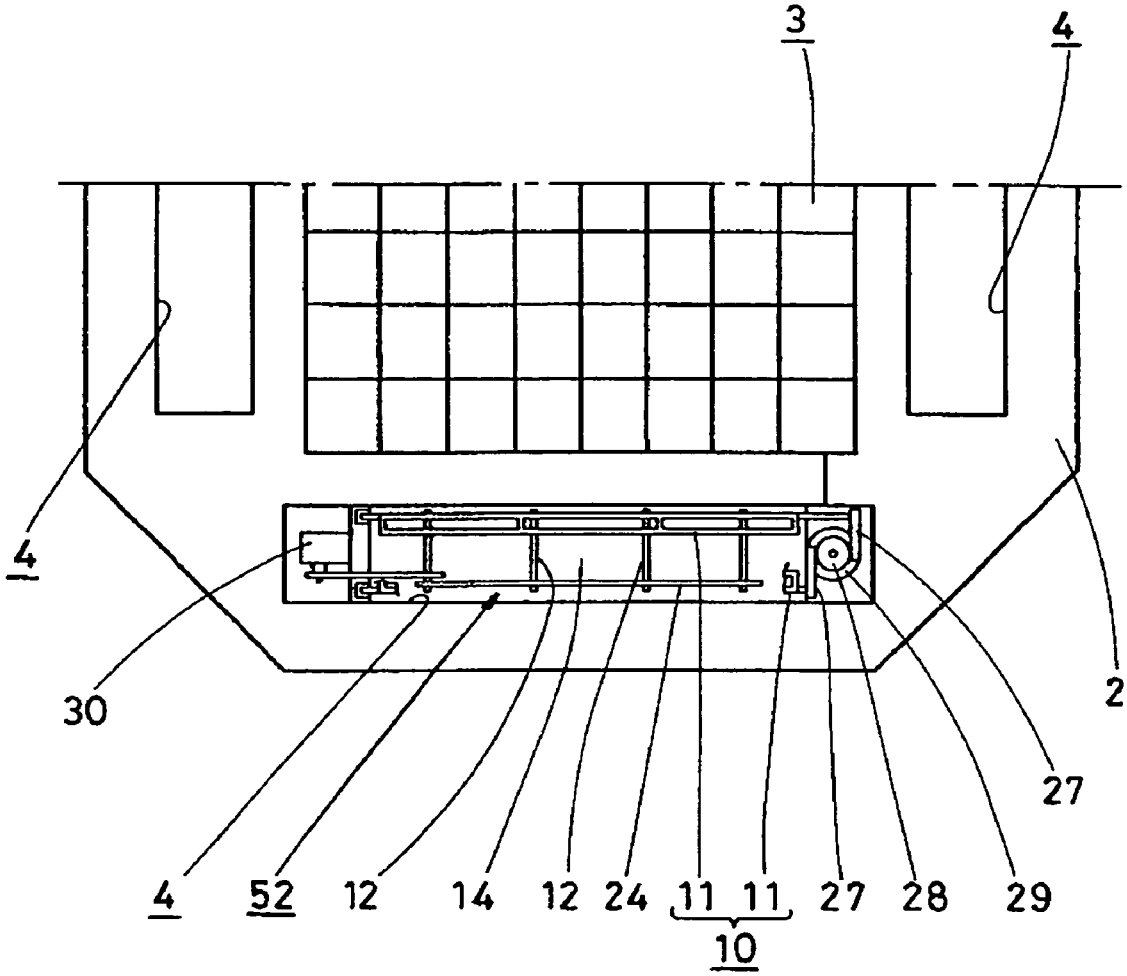
FIG. 6 is a section view taken along the arrow VI—VI shown in FIG. 5.
Figure 7:
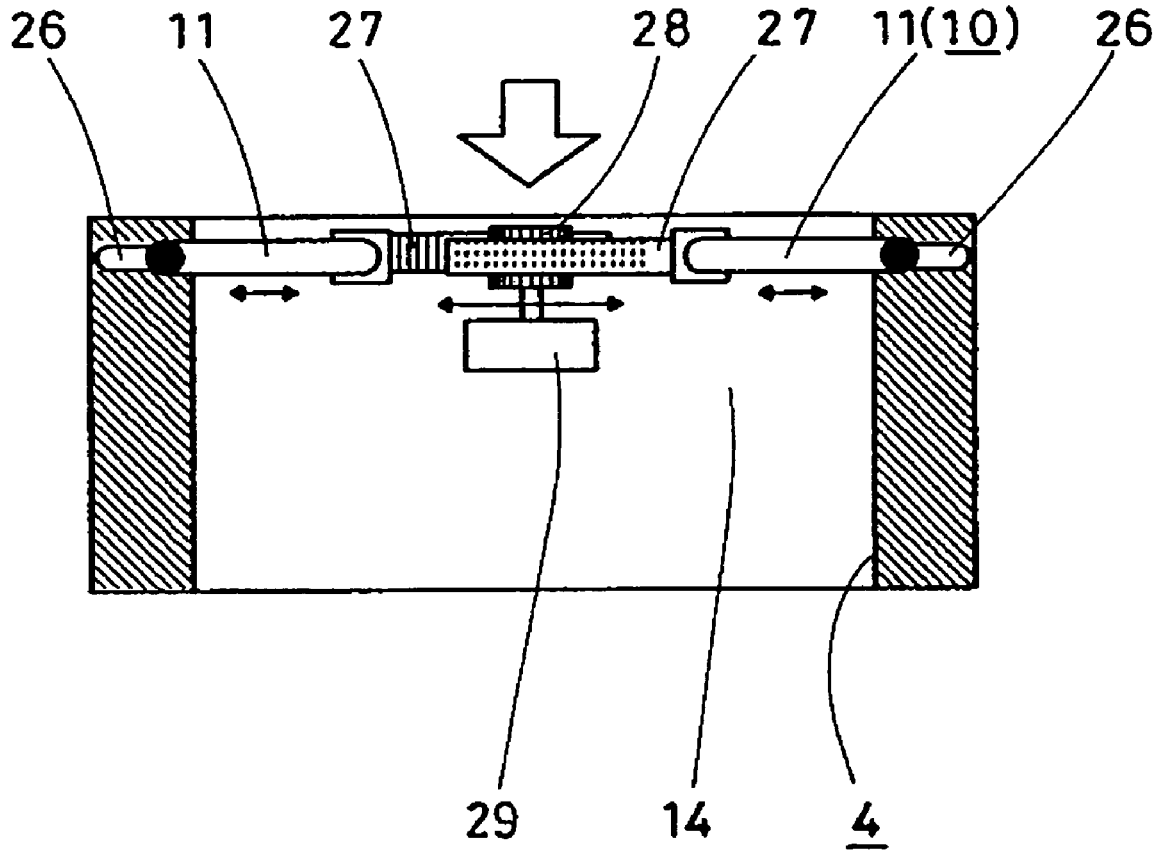
FIG. 7 is a cross-sectional view illustrating a second exemplary structure of an air quantity distribution mechanism provided in an outlet of an indoor unit.

The air quantity distribution mechanism 10 serves to increase or decrease the quantity of an air discharged through the associated outlet 4, thereby adjusting the ratio of distribution of air quantities from the outlets 4, 4, . . . . As shown in FIGS. 5 through 7, the air quantity distribution mechanism 10 includes right and left distribution shutters 11, 11 that are provided to make a pair at regions of the discharge duct 14 adjacent to side walls thereof each extending in a longitudinal direction of the discharge duct 14, with the shutters facing each other in a transverse direction of the discharge duct 14. The specific configuration of the pair of distribution shutters 11, 11 is as shown in FIGS. 5 and 6. Guide grooves 25 are formed to extend vertically along the side walls of the discharge duct 14, and one ends of the pair of distribution shutters 11, 11 can be moved vertically along the guide grooves 25 by engaging said one ends thereto. The other ends of the pair of the distribution shutters 11, 11 are connected to a pair of racks 27, 27 that mesh with a gear 28, which is driven and rotated by a motor 29 (equivalent to "driving mechanism 29" recited in the claim), on both sides of the gear 28 in a radial direction thereof with the shaft of the gear 28 sandwiched between the pair of racks 27, 27.

Therefore, in the air quantity distribution mechanism 10, upon selective rotation of the gear 28 in either a forward or reverse direction by the motor 29, the paired racks 27, 27 meshed with the gear 28 are moved in opposite directions. With the movement of the paired racks 27, 27 in opposite directions, the paired distribution shutters 11, 11 move vertically while changing their tilt angles so as to increase or decrease the degree of protrusion toward the center of the discharge duct 14, thereby decreasing or increasing the area of an opening of the discharge duct 14.

When the opening area of the discharge duct 14 is increased by the air quantity distribution mechanism 10 (i.e., when the air quantity is set at "large"), the paired distribution shutters 11, 11 each assume a substantially upright position and retract toward the associated side wall of the discharge duct 14, thus reducing the degree of protrusion toward the center of the discharge duct 14. On the other hand, when the opening area of the discharge duct 14 is reduced by the air quantity distribution mechanism 10 (i.e., when the air quantity is set at "small"), the paired distribution shutters 11, 11 each assume a substantially horizontal position to increase the degree of protrusion toward the center of the discharge duct 14, and the air quantity distribution mechanism 10 is overall placed at an upstream-side region of the discharge duct 14.

Accordingly, by adopting the above-described configuration, while the opening area of the discharge duct 14 is increased, i.e., while the quantity of an air discharge is increased, each distribution shutter 11 is placed at a region of the discharge duct 14 where the velocity of flow is low; thus, draft resistance caused by the distribution shutter 11 is reduced, the air quantity is ensured with certainty, and the noise produced when an air is sent is reduced. On the other hand, while the opening area of the discharge duct 14 is reduced, i.e., while the quantity of an air discharge is reduced, each distribution shutter 11 is placed at the upstream-side region of the discharge duct 14; thus, the disturbance of an air flow at a region of the outlet 4 located at the downstream end of the discharge duct 14 is suppressed as much as possible. This makes it possible to obtain tremendous effects such as the prevention of condensation in the vicinity of the outlet 4, and the prevention of contamination of the ceiling surface due to the collision of a disturbed discharged air flow thereto.

It should be noted that since each air quantity distribution mechanism 10 is provided to be associated with the corresponding one of the outlets 4, 4, . . . , the operations of the air quantity distribution mechanisms 10, 10, . . . are controlled independently and separately. Besides, the operation of each air quantity distribution mechanism 10 is controlled by the after-mentioned controller 18 (the configuration of which will be described later) based on detection information from the after-mentioned infrared sensor 15.

Meanwhile, as described above, each air quantity distribution mechanism 10 includes the distribution shutter 11 that tilts by using, as a supporting point, one end thereof located adjacent to the associated side wall of the discharge duct 14 and movable in a flow direction in the discharge duct 14. In addition, when the area of the opening is increased, each distribution shutter 11 assumes a position adjacent to the associated side wall of the discharge duct 14 so as to ensure a wide opening in the vicinity of the center of the duct where the velocity of flow is high. In other words, each distribution shutter 11 is retracted toward the associated side wall of the discharge duct 14. On the other hand, when the area of the opening is reduced, each air quantity distribution mechanism 10 has configurative and functional features that each distribution shutter 11 is placed at the upstream-side region of the discharge duct 14. As a consequence, the unique effects can be provided as described below.

The air quantity distribution mechanism 10 does not have to be limited to the structure as in the aforementioned embodiment so long as the above-described configurative and functional features are provided. Therefore, other than the aforementioned embodiment, the structure shown in FIG. 7 or the structure shown in FIG. 8, for example, can be employed when deemed appropriate. These structures will be briefly described below.

The air quantity distribution mechanism 10 shown in FIG. 7 is configured so that the paired distribution shutters 11, 11 are each movable to and fro in a transverse direction of the discharge duct 14 at its upstream region. The distribution shutters 11, 11 are driven by the motor 29 via the racks 27 and the gear 28 meshed therewith in the same way as those of the aforementioned air quantity distribution mechanism 10 shown in FIG. 3. Also in the air quantity distribution mechanism 10 shown in FIG. 7, when the area of the opening is increased, the distribution shutters 11, 11 each assume a position adjacent to the associated side wall of the discharge duct 14 so as to ensure a wide opening in the vicinity of the center of the duct where the velocity of flow is high. On the other hand, when the area of the opening is reduced, each distribution shutter 11 is placed at the upstream-side region of the discharge duct 14.

Figure 8:
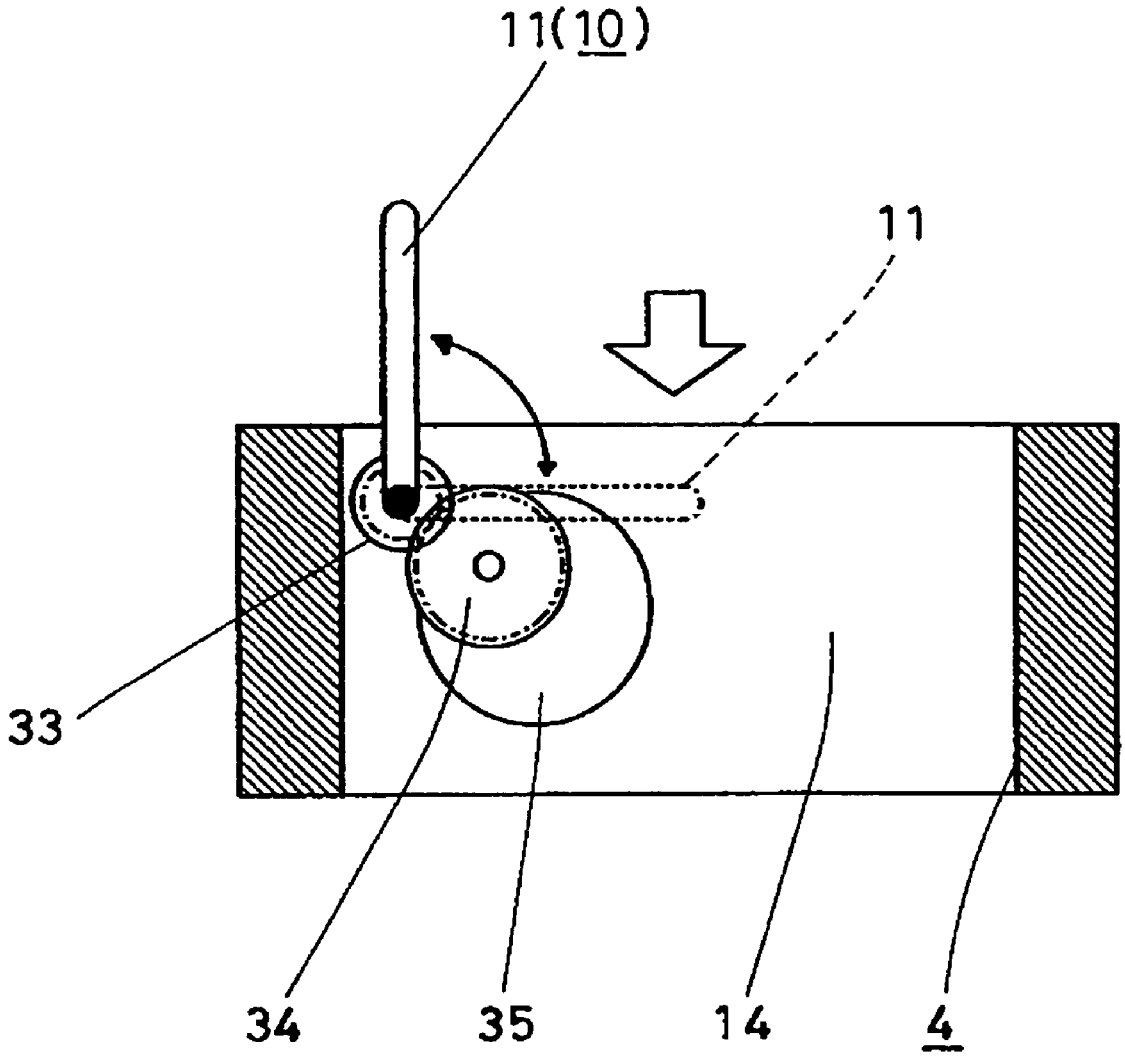
FIG. 8 is a cross-sectional view illustrating a third exemplary structure of an air quantity distribution mechanism provided in an outlet of an indoor unit.

The air quantity distribution mechanism 10 shown in FIG. 8 includes a single distribution shutter 11 with one end thereof tiltably pivoted at the upstream-side region of the discharge duct 14 located adjacent to one side wall of the discharge duct 14, and the distribution shutter 11 is driven and rotated by a motor 35 via gear 33 and gear 34 that mesh with each other. The air quantity distribution mechanism 10 is allowed to selectively assume a position, indicated by the solid line in FIG. 8, for increasing the area of opening, and another position, indicated by the broken line in FIG. 8, for reducing the area of opening. Also in the air quantity distribution mechanism 10 shown in FIG. 8, when the area of the opening is increased, the distribution shutter 11 assumes a position adjacent to the side wall of the discharge duct 14 to ensure a wide opening in the vicinity of the center of the duct where the velocity of flow is high; on the other hand, when the area of the opening is reduced, the distribution shutter 11 is placed at the upstream-side region of the discharge duct 14.

(I-b) Configuration of First Flap 12

The first flap 12 serves to adjust the lateral discharge direction of an air flow that is discharged from the outlet 4 to the inside of the room after having passing through the discharge duct 14. As shown in FIG. 2, the first flap 12 is formed to have a geometry of a plate extending along the cross-sectional shape of the duct from the discharge duct 14 to the discharge duct 14, and is supported by a supporting shaft 23 so as to be swingable with respect to the side walls of the discharge duct 14 extending in the longitudinal direction thereof. As shown in FIG. 6, a plurality of the first flaps 12 are provided in the discharge duct 14 so as to be spaced a certain distance apart in the longitudinal direction thereof, and are each driven in a swingable direction by a motor 30 (equivalent to "driving mechanism 30" recited in the claims) via a link bar 24 that connects the first flaps 12 to each other, thereby changing tilt angles thereof. The first flaps 12 adjust the lateral discharge direction of an air flow discharged from the outlet 4 by having their tilt angles changed, and are allowed to swing by having their tilt angles increased and decreased continuously if necessary. Furthermore, the first flaps 12, 12, . . . are provided in the associated outlets 4, 4, . . . . The operations of the first flaps 12, 12, . . . are controlled separately and independently, or together by the controller 18.

In this embodiment, as described above, the air quantity distribution mechanism 10 and the first flaps 12 are provided at the upstream-side region of the discharge duct 14 continuous with the outlet 4, and the driving mechanism 29 for the air quantity distribution mechanism 10 and the driving mechanism 30 for the first flaps 12 are provided at respective longitudinal ends of the discharge duct 14. By employing this arrangement, the air quantity distribution mechanism 10, first flaps 12, and driving mechanisms 29, 30 for driving them can be compactly provided in the region of the discharge duct 14 on which spatial restrictions are imposed, resulting in the thin and small-sized indoor panel 2.

(I-c) Second Flap 13

As shown in FIG. 2, each second flap 13 is formed by a band plate member having a curved cross-sectional shape. Each second flap 13 is provided at a downstream-side region of the discharge duct 14 located adjacent to the outlet 4, is allowed to adjust longitudinal discharge direction of an air flow by tilting around an upper edge thereof, and is allowed to swing by having its tilt angle increased and decreased continuously if necessary.

Figure 9:
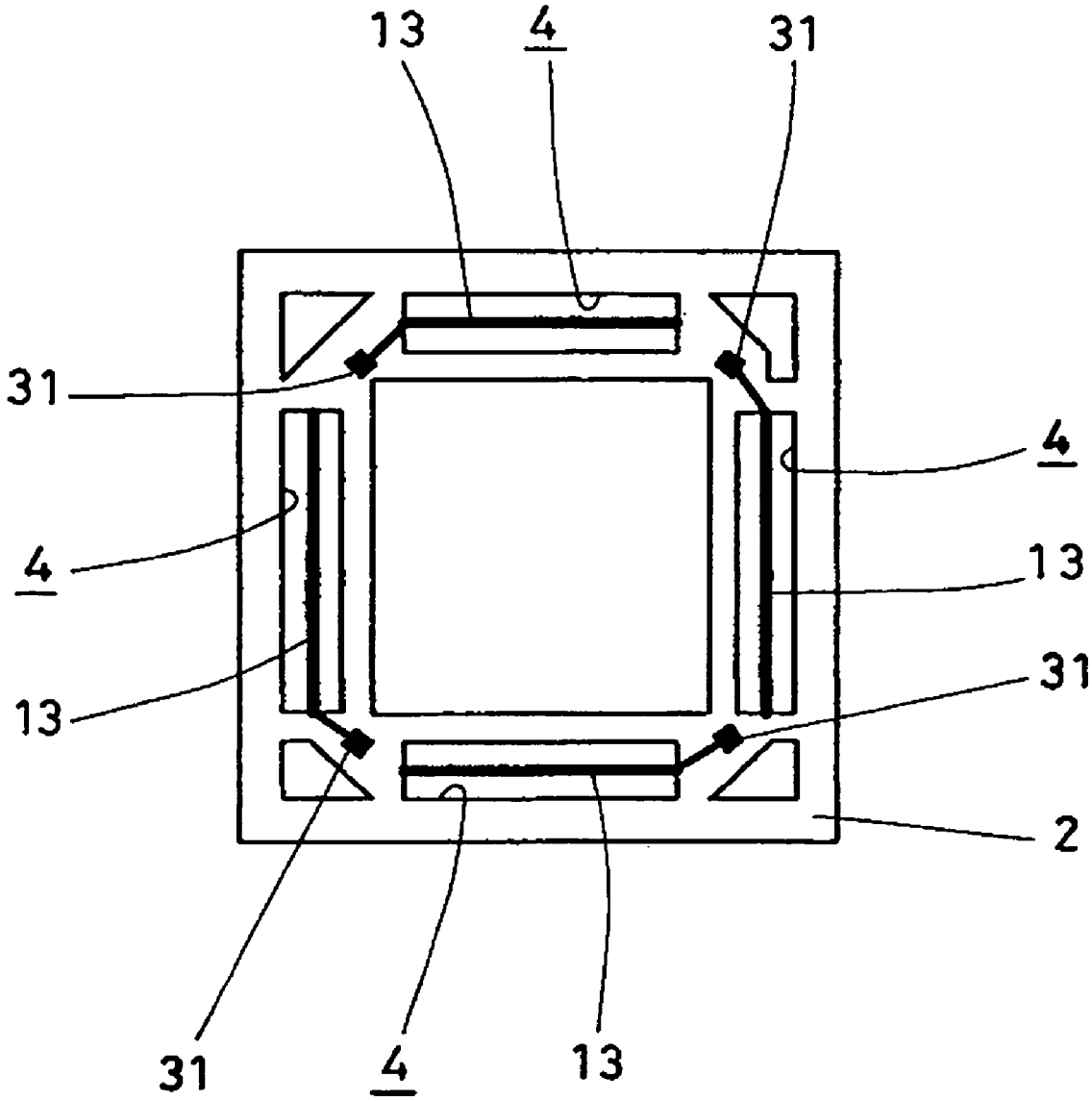
FIG. 9 is a schematic diagram illustrating a first method for driving second flaps provided in outlets of an indoor unit.
Figure 10:
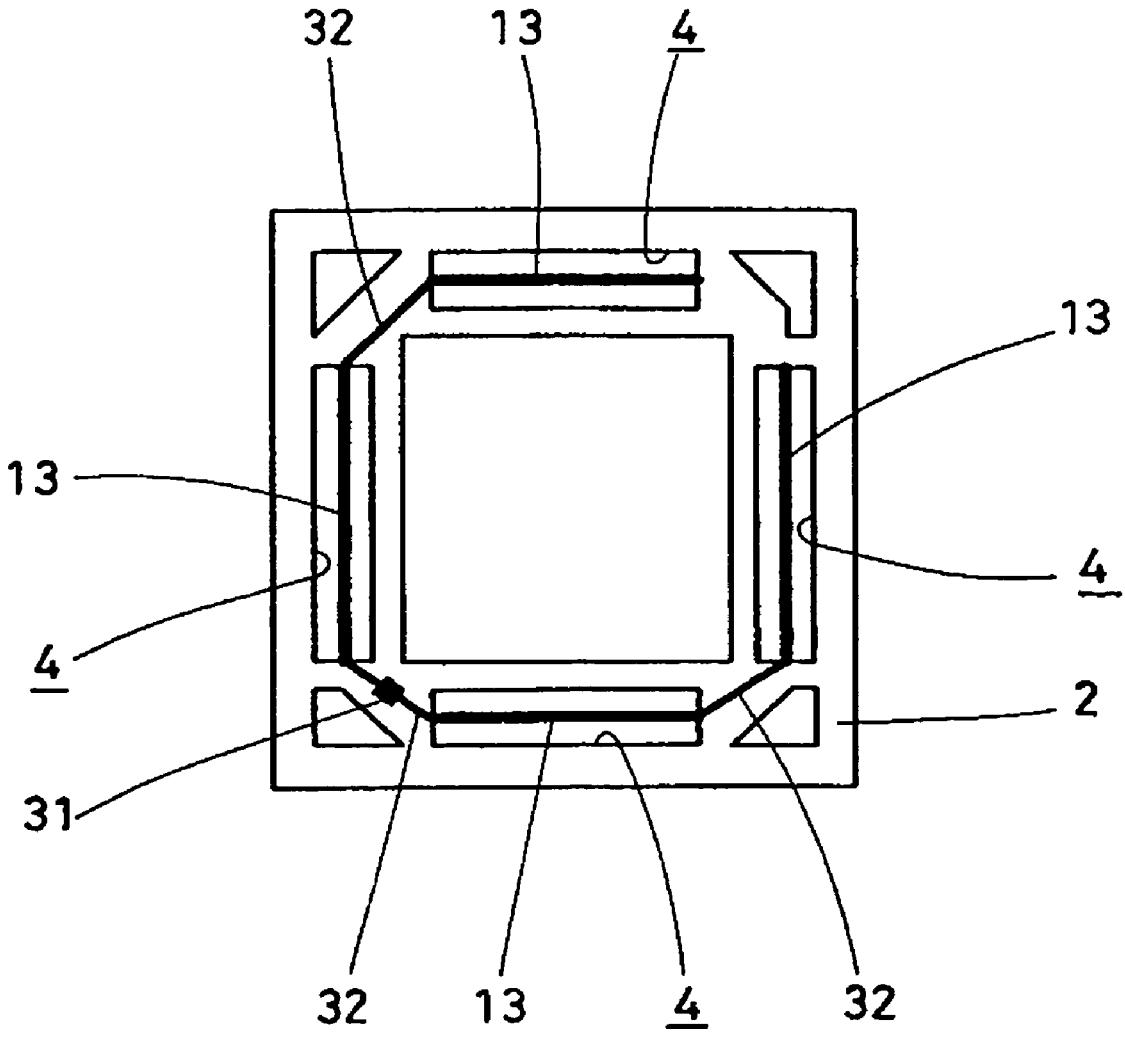
FIG. 10 is a schematic diagram illustrating a second method for driving second flaps provided in outlets of an indoor unit.

Each second flap 13 is provided in the associated one of the outlets 4, 4, . . . , and as a method for driving the second flaps 13, 13, . . . , a method for driving the flaps together and a method for driving the flaps separately are conceivable. As shown in FIG. 9, in the method for driving the flaps together, the second flaps 13, 13, . . . provided in the corresponding outlets 4, 4, . . . are connected to each other via interlocking members 32, 32 . . . , and the second flaps 13, 13, . . . are driven by a single motor 31. To the contrary, as shown in FIG. 10, in the method for driving the flaps separately, the second flaps 13, 13, . . . provided in the corresponding outlets 4, 4, . . . are driven separately by motors 31, 31, . . . each used exclusively for the associated one of the second flaps 13, 13, . . . . If these methods are compared to each other, the former method, i.e., the method for driving the flaps together, is advantageous in that the structure of the driving mechanism is simple and thus the cost thereof is reduced since the flaps can be driven by the single motor 31. To the contrary, the latter method, i.e., the method for driving the flaps separately, is advantageous in that the longitudinal discharge directions of air flows discharged from the outlets 4, 4, . . . can be separately and minutely adjusted.

(I-d) Operational Relationship between Constituting Elements of Air Flow Changing Means 52

The present embodiment proposes the following two configurations concerning the operational relationship between the air quantity distribution mechanism 10, first flaps 12, and second flap 13 that constitute each air flow changing means 52.

In a first configuration, the air quantity distribution mechanisms 10, first flaps 12 and second flaps 13 associated with the respective outlets 4, 4, . . . are formed so that they are operable independently and separately. According to this operational configuration, the characteristics of air flows discharged from the outlets 4, 4, . . . can be minutely controlled, for example, with the air quantity distribution mechanisms 10, which is effective in improving the comfort of air conditioning and energy conservation.

In a second configuration, among the air quantity distribution mechanisms 10, first flaps 12 and second flaps 13, the air quantity distribution mechanisms 10 and first flaps 12 associated with the respective outlets 4, 4, . . . are formed so that they are operable independently and separately, while the second flaps 13 associated with the respective outlets 4, 4, . . . are operated together. According to this operational configuration, the characteristics of air flows discharged from the outlets 4, 4, . . . can be minutely controlled by the air quantity distribution mechanisms 10 and the first flaps 12. Thus, as compared with the configuration in which the air quantity distribution mechanisms 10 and the first flaps 12 provided in the associated outlets 4, 4, . . . are operated together, for example, the comfort of air conditioning and energy conservation can be improved, and the second flaps 13, 13, . . . provided in the outlets 4, 4, . . . can be driven by a single driving source. Therefore, as compared with the case where the second flaps 13, 13, . . . are driven by separate driving sources, for example, the number of the driving sources to be provided is reduced, and the cost and structural complexity thereof can be accordingly reduced. That is, the improvement in the comfort of air conditioning and energy conservation, and the promotion of cost reduction of the air conditioning apparatus are both achieved.

(I-e) Configuration of Infrared Sensor 15

The infrared sensor 15 is equivalent to "detection means 51" recited in the claims. If the indoor unit Z has been provided at the ceiling 50, the infrared sensor 15 detects the radiation temperature of an object such as a wall surface, floor surface or human body inside the room (equivalent to "space to be air-conditioned W" recited in the claims), outputs the detected temperature to the controller 18 as a room temperature, and outputs information on a high radiation temperature region to the controller 18 as information concerning the position of a human body. The controller 18 utilizes these pieces of information as factors for controlling the air flow changing means 52.

As shown in FIGS. 1 and 2, the infrared sensor 15 is provided at one of four corners of an outer region of the indoor panel 2, i.e., at a region of the indoor panel 2 located between two of the four openings of the outlets 4, 4, . . . . In this case, according to the present embodiment, the infrared sensor 15 is mounted to the panel via a scanning mechanism 20, thus enabling the scanning and detection of body temperature in all the areas inside the room with the use of this single infrared sensor 15. It should be noted that the scanning mechanism 20 is formed to oscillate the infrared sensor 15 by a first motor 21 having a horizontal shaft and to rotate the infrared sensor 15 by a second motor 22 having a vertical shaft, and allows the infrared sensor 15 to be supported by the casing 1 with the infrared sensor 15 inserted into a sensor mounting hole 19 provided in the indoor panel 2.

In this embodiment, suitable for the infrared sensor 15 is, for example, a sensor of the type in which a single element is provided to carry out detection in a limited area of a detection target range, a sensor of the type in which elements are one-dimensionally arrayed to carry out detection in respective areas of a detection target range divided in one direction, or a sensor of the type in which elements are two-dimensionally arrayed to carry out detection in respective areas of a detection target range divided in two orthogonal directions.

Furthermore, in the present embodiment, when body temperature (i.e., radiation temperature) and temperature distribution inside the room are detected by the infrared sensor 15, the space inside the room, i.e., the detection target space (space to be air-conditioned W recited in the claims) for the infrared sensor 15, is imaginarily divided into four areas (1) through (4) along radial directions with respect to the indoor unit Z so that the areas (1) through (4) are each associated with the position of the corresponding one of the outlets 4, 4, . . . (see FIG. 21). The radiation temperature and human body position are detected in each of the areas (1) through (4), and then information detected in each of the areas (1) through (4) is outputted to the controller 18.

(I-f) Controller 18

As described above, the controller 18 controls, based on the information detected by the infrared sensor 15, the operations of the air quantity distribution mechanism 10, first flaps 12 and second flap 13 constituting the air flow changing means 52 while associating the constituting elements with each other, and simultaneously carries out control of air conditioning capacity or temperature control to optimize the air conditioning, thus making it possible to improve the comfort of air conditioning or energy conservation.

How the controller 18 carries out control will be described in summary by providing several exemplary controls, subsequent to the following description made about a second embodiment of an air conditioning apparatus.

II: Second Embodiment of Air Conditioning Apparatus

Figure 3:
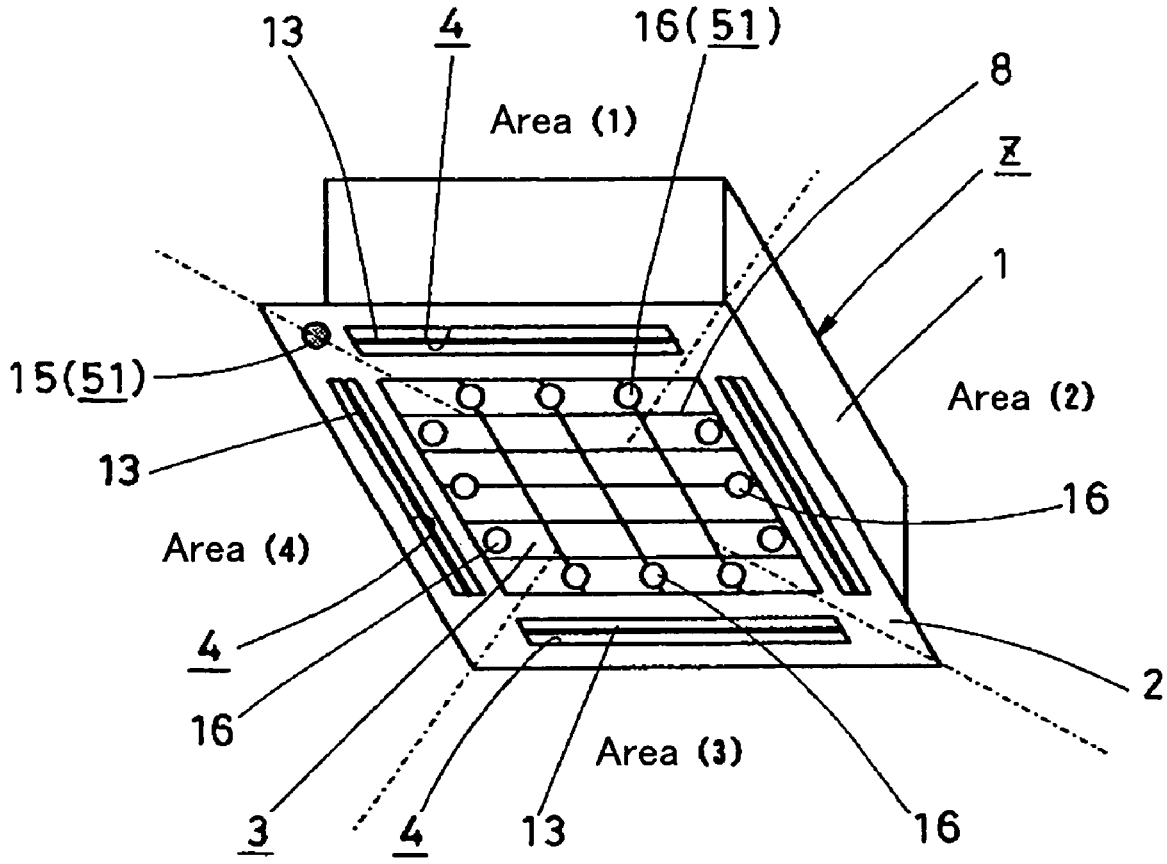
FIG. 3 is an oblique view of an indoor unit of an air conditioning apparatus according to a second embodiment of the present invention, as viewed from the inside of a room.
Figure 4:
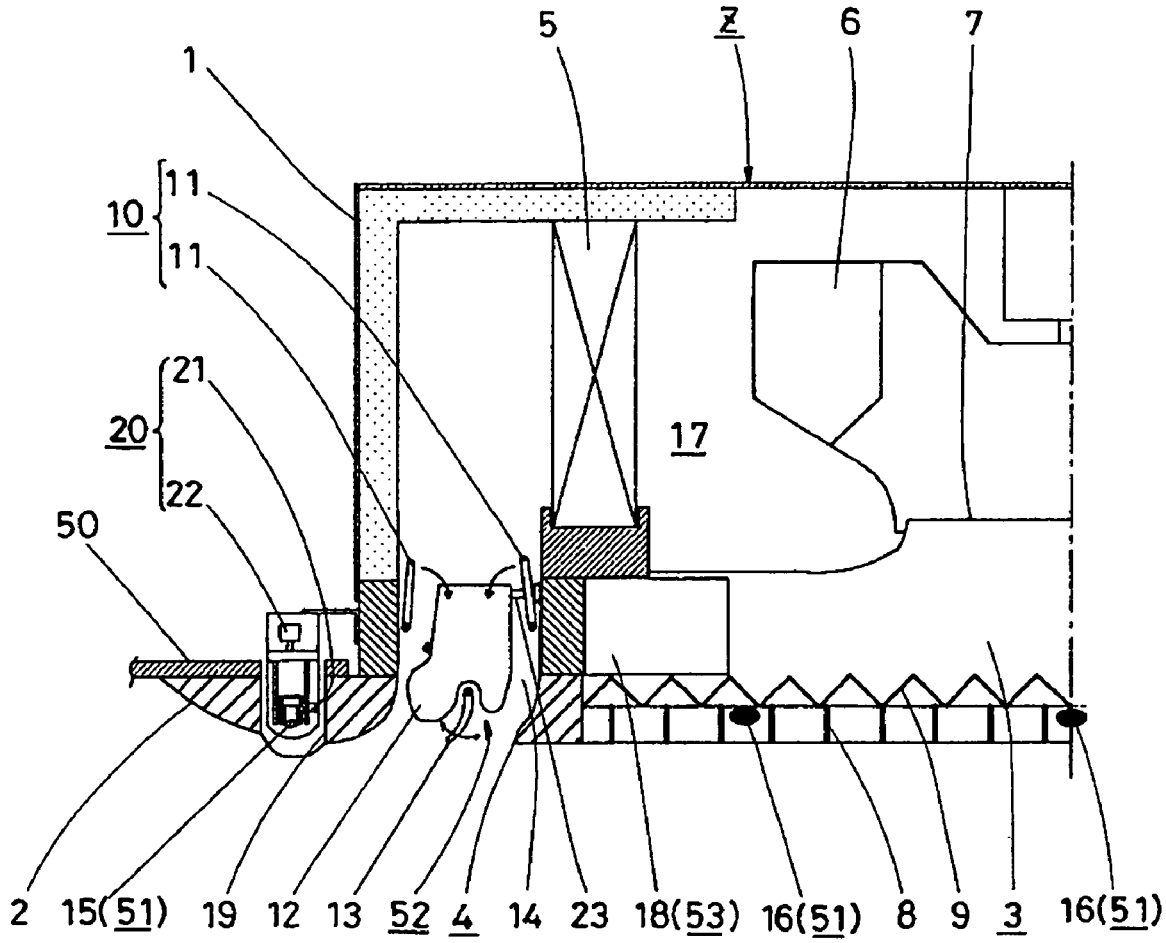
FIG. 4 is an enlarged cross-sectional view of a principal portion of the indoor unit shown in FIG. 3.

FIGS. 3 and 4 show an indoor unit Z of a separate type air conditioning apparatus as the second embodiment of an air conditioning apparatus according to the present invention. This indoor unit Z is similar in basic configuration to the indoor unit Z according to the first embodiment, and is different from the indoor unit Z according to the first embodiment in that the indoor unit Z of the present embodiment is provided with not only the infrared sensor 15 but also an after-mentioned temperature and humidity sensor 16 as the detection means 51, since the indoor unit Z of the first embodiment is provided with only the infrared sensor 15 as the detection means 51.

Therefore, only the configuration of the temperature and humidity sensor 16 and the arrangement related to this sensor will be described below, and the appropriate descriptions in the first embodiment will be referenced as for the other configurations and arrangements. It should be noted that the constituting members shown in FIGS. 3 and 4 and similar to the counterparts described in the first embodiment are identified by the same reference characters as those used in FIGS. 1 and 2.

In the indoor unit Z of the present embodiment, as shown in FIGS. 3 and 4, the infrared sensor 15 is provided at a region of the indoor panel 2 located between the openings of two of the outlets 4, 4, . . . , and is configured to allow scanning with the scanning mechanism 20. On the other hand, the three temperature and humidity sensors 16 are provided in the vicinity of each peripheral side of the inlet 3 so that they are spaced a certain distance apart along the peripheral side, and thus the twelve temperature and humidity sensors 16 are provided in total. Each of the temperature and humidity sensors 16, 16, . . . is associated with the corresponding one of the outlets 4, 4, . . . , and is associated with the corresponding one of the four areas (1) through (4) that are divided as the detection areas for the infrared sensor 15. Therefore, the temperature and humidity sensors 16, 16, . . . detect, for each of the areas (1) through (4), the temperature of each intake air (i.e., intake air temperature) that is taken into the inlet 3 from a region of the space belonging to one of the areas (1) through (4).

Consequently, the infrared sensor 15 detects the radiation temperature and the human body position in each of the areas (1) through (4) of the space to be air-conditioned W, and the temperature and humidity sensors 16 each detect the intake air temperature corresponding to the air temperature in the associated one of the areas (1) through (4) of the space to be air-conditioned W. Furthermore, the above-described detection method is significantly different from the detection method of the first embodiment in which the radiation temperature and human body position in each of the areas (1) through (4) are detected only by the infrared sensor 15.

In addition, if the detection means 51 is configured to include the infrared sensor 15 and temperature and humidity sensor 16 as in the present embodiment, the following two usages of the sensors are conceivable.

In a first usage, the infrared sensor 15 and the temperature and humidity sensor 16 are allowed to carry out respective functions, and the infrared sensor 15 detects only human body position while the temperature and humidity sensor 16 detects intake air temperature. According to this usage, the infrared sensor 15 needs only detect human body position; therefore, as compared with the case where human body position and radiation temperature are both detected, for example, the detected information is processed more easily and the control system can be simplified accordingly. At the same time, required accuracy can be ensured in detecting temperature distribution inside the room by detecting intake air temperature with the temperature and humidity sensor 16 that is less expensive than the infrared sensor 15. Due to a synergistic effect of these merits, this usage is advantageous in that accuracy of the detected information and cost reduction can be both secured. It should be noted that the description of the first usage is omitted in exemplary controls.

In a second usage, the infrared sensor 15 detects radiation temperature and human body position, while the temperature and humidity sensor 16 detects intake air temperature. Furthermore, in this case, temperature correction is carried out. To be more specific, the radiation temperature detected by the infrared sensor 15, and the intake air temperature detected by the temperature and humidity sensor 16 are each assigned a predetermined weight and are summed to determine a value indicative of a measurement temperature, thus reflecting both of the radiation temperature and intake air temperature in control. It should be noted that this second usage is employed in a fourth exemplary control described below.

It should also be noted that the three temperature and humidity sensors 16 are provided for each outlet 4 in the present embodiment because an increase in the number of the temperature and humidity sensors 16 to be provided enables further fragmentation of the detection target range and thus improves detection accuracy. Therefore, the number of the temperature and humidity sensors 16 to be provided may be appropriately increased or decreased in accordance with the required detection accuracy. For example, an arrangement in which one temperature and humidity sensor 16 is provided for each of the outlets 4, 4, . . . may also be allowed since the detected information for each of the areas (1) through (4) can be at least confirmed.

Besides, in the present embodiment, each temperature and humidity sensor 16 is provided in the suction grill 8 (i.e., upstream of the filter 9). This is because such an arrangement avoids leveling off of intake air temperatures caused by the passage of the intake airs through the filter 9, and thus prevents the determination of the relationship between the information detected by each temperature and humidity sensor 16 and the detection target area from becoming difficult. Therefore, if a draft resistance due to the filter 9 is small and the influence of leveling off of intake air temperatures is slight, each temperature and humidity sensor 16 may be provided downstream of the filter 9, e.g., at an inner surface of the bell mouth 7.

Furthermore, the detection means 51 is formed using the temperature and humidity sensor 16 in the present embodiment because if the temperature and humidity of an intake air are detected and a heat load is calculated based on this detection, the heat load can be detected with a higher degree of accuracy compared with the case where only the temperature of an intake air is detected and a heat load is calculated based on this detection. Therefore, depending on the required detection accuracy, a temperature sensor may be provided instead of the temperature and humidity sensor 16.

Although the description of the other constituting elements, for example, will be omitted, the indoor unit Z of the second embodiment also includes the controller 18 as shown in FIG. 4.

Accordingly, in the following, how the controller 18 carries out control will be described in detail together with an exemplary control targeted for the indoor unit Z according to the first embodiment, and furthermore, an exemplary control targeted for the indoor unit Z according to the second embodiment will be also described in detail.

III: Exemplary Control of Air Conditioning Apparatus by Controller 18

First, the description will be made about the basic concepts regarding the control of the indoor unit Z and outdoor unit (not shown) by the controller 18.

(a) Area Setting in Space to be Air-Conditioned W

Figure 21:
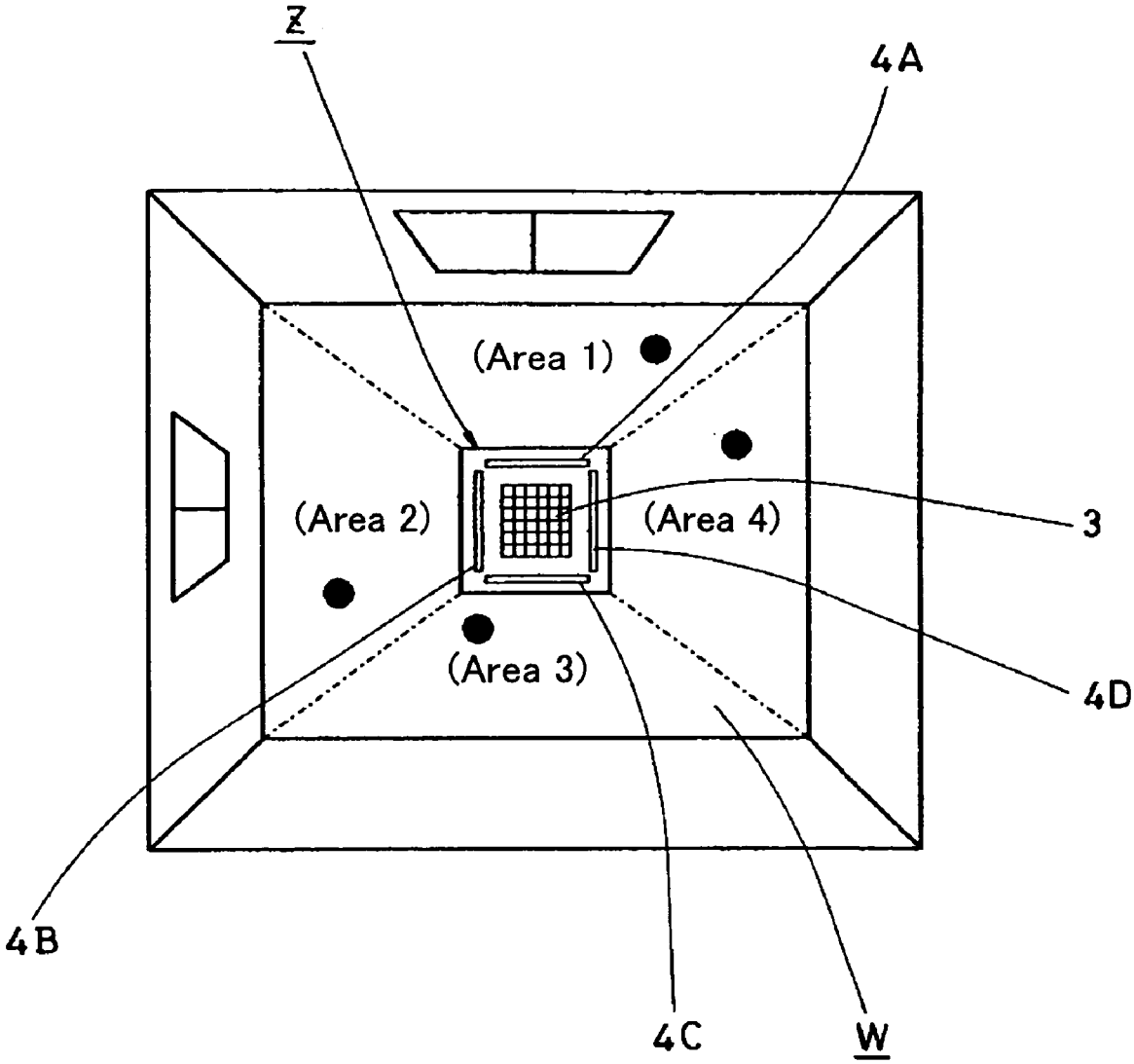
FIG. 21 is a diagram illustrating exemplary areas to be air-conditioned inside a room.

In each exemplary control described below, as shown in FIG. 21, the space inside the room, i.e., the space to be air-conditioned W, is imaginarily divided into the four areas (1) through (4) each associated with the position of the corresponding one of the outlets 4, 4, . . . of the indoor unit Z. In addition, based on the measurement temperature of each of the areas (1) through (4), the level of a load in each of the areas (1) through (4) of the space to be air-conditioned W or the level of a load in the overall space to be air-conditioned W, for example, is determined. It should be noted that the radiation temperature detected by the infrared sensor 15 may simply be employed as a measurement temperature, or the radiation temperature and the intake air temperature detected by the temperature and humidity sensor 16 may each be weighted to carry out temperature correction, thus determining a measurement temperature. Besides, as indicated by in FIG. 21, the position of a human body (i.e., the presence of a high temperature region) in each of the areas (1) through (4) of the space to be air-conditioned W is detected by the infrared sensor 15, and is reflected in each control.

Figure 22:
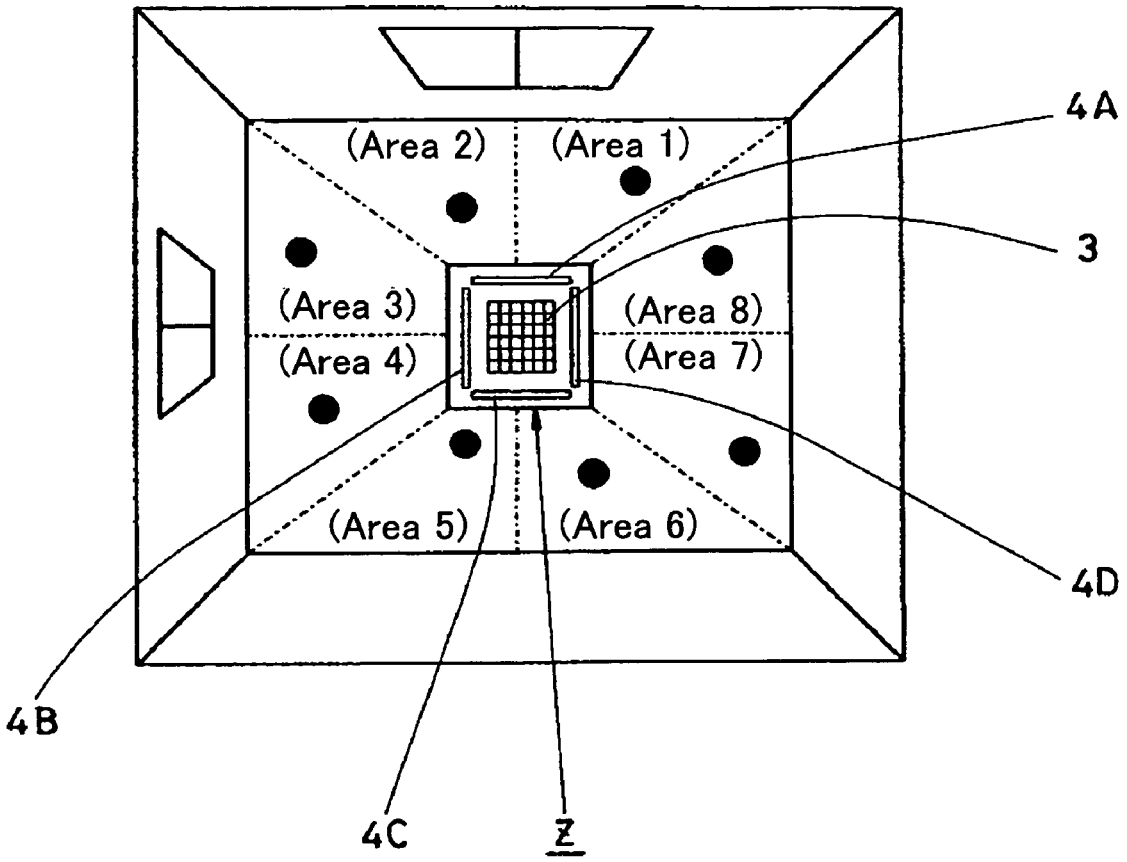
FIG. 22 is a diagram illustrating another exemplary areas to be air-conditioned inside a room.

It should be noted that the area setting is not limited to one in which the space to be air-conditioned W is divided into the four areas (1) through (4) as described above, but the space to be air-conditioned W may be divided into eight areas (1) through (8) by further dividing each of the areas (1) through (4) as shown in FIG. 22, for example. Although an increase in the number of the areas enables more minute control, cost increase might be caused due to the increase in the number of sensors or the increase in the complexity of the control system, for example; therefore, the number of the areas may be appropriately set depending on criteria such as required control accuracy.

(b) Operational Air Conditioning Mode

In each exemplary control described below, an operational air conditioning mode is automatically switched between temperature uniformization mode and spot air conditioning mode.

Figure 23:
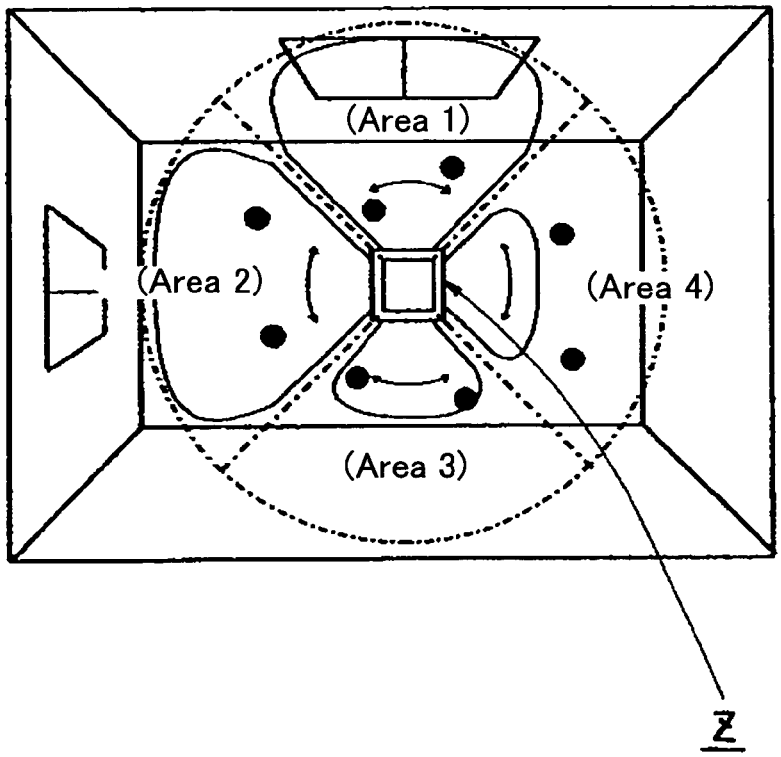
FIG. 23 is a schematic diagram illustrating how air conditioning is performed in a temperature uniformization mode.

Specifically, the temperature uniformization mode refers to an air conditioning mode in which the temperatures of all areas of the space to be air-conditioned W are uniformized as much as possible. Suppose that, as shown in FIG. 23, the areas (1) through (4) are equal in number of people present (i.e., the areas (1) through (4) are similar in heat load resulting from radiation heat from human body), and the area (1) and area (2) are each exposed to a considerable radiation heat penetrating from outside since these areas each have a window that constitutes a high radiation region. In that case, a large quantity of conditioned air is discharged to the area (1) and area (2) at a wide angle in a horizontal direction, while a small quantity of conditioned air is discharged to the area (3) and area (4) at a narrow angle in a horizontal direction, thus uniformizing the temperature of the overall space to be air-conditioned W as much as possible.

Figure 24:
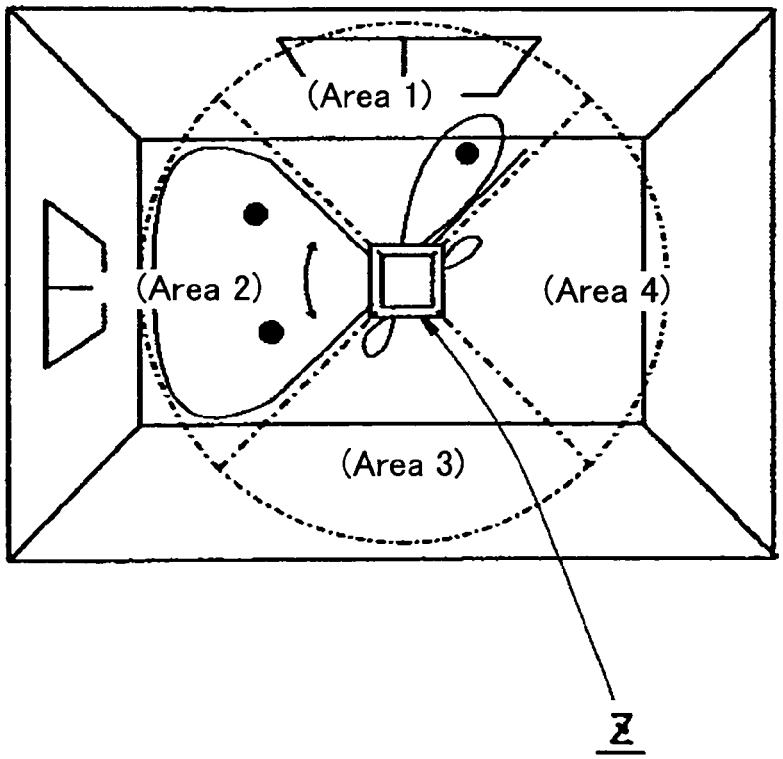
FIG. 24 is a schematic diagram illustrating how air conditioning is performed in a spot air conditioning mode.

To the contrary, the spot air conditioning mode refers to an air conditioning mode in which the surroundings of people present in the space to be air-conditioned W are intensively air-conditioned. Suppose that, as shown in FIG. 24, among the areas (1) through (4), one person is present in the area (1) and two people are present in the area (2); however, no one is present in the area (3) and area (4). In that case, a large quantity of conditioned air is discharged to the area (1) so that the conditioned air is discharged, at a narrow angle, toward the surroundings of the person, a large quantity of conditioned air is discharged at a wide angle to the area (2), and a small quantity of conditioned air is discharged to the area (3) and area (4).

(c) Relationship between Set Temperature and Recommendable Set Temperature

The set temperature refers to a reference temperature in controlling the capacity of the air conditioning apparatus; when cooling operation is performed, the set temperature is normally set at about 24° C. in accordance with the maximum load applied during the day time, and when heating operation is performed, the set temperature is set at about 22° C. in accordance with the maximum load applied in the early morning.

Therefore, in performing actual cooling and heating operations, if the air conditioning apparatus is always operated at the set temperature when the level of a load is lower than that of the maximum load employed as the criterion for the set temperature, then the air conditioning apparatus is operated to provide a capacity higher than necessary, which is undesirable from the viewpoint of energy conservation.

Figure 25:
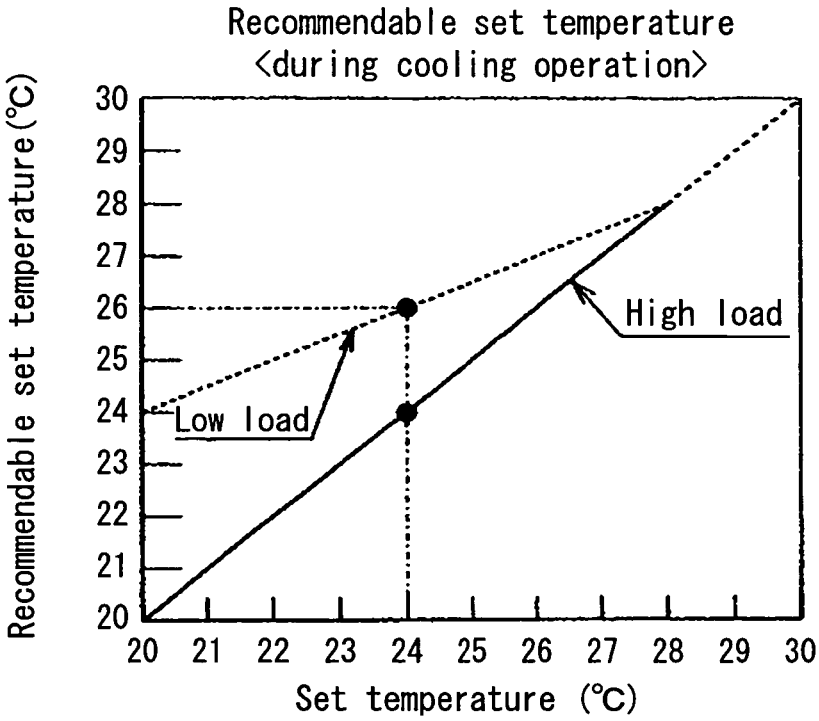
FIG. 25 is a graph illustrating the relationship between set temperature and recommendable set temperature during cooling operation.

Accordingly, in each exemplary control described below, a recommendable set temperature is provided in addition to the set temperature, and in a low-load state in which the load level is lower than the reference level, the recommendable set temperature is adopted as the reference temperature for the capacity control instead of the set temperature. To be more specific, during cooling operation, the set temperature of 24° C. is automatically switched to the recommendable set temperature of 26° C. when the load level is low, and the set temperature of 24° C. is maintained when the load level is high, as shown in FIGS. 25 and 27.

Figure 26:
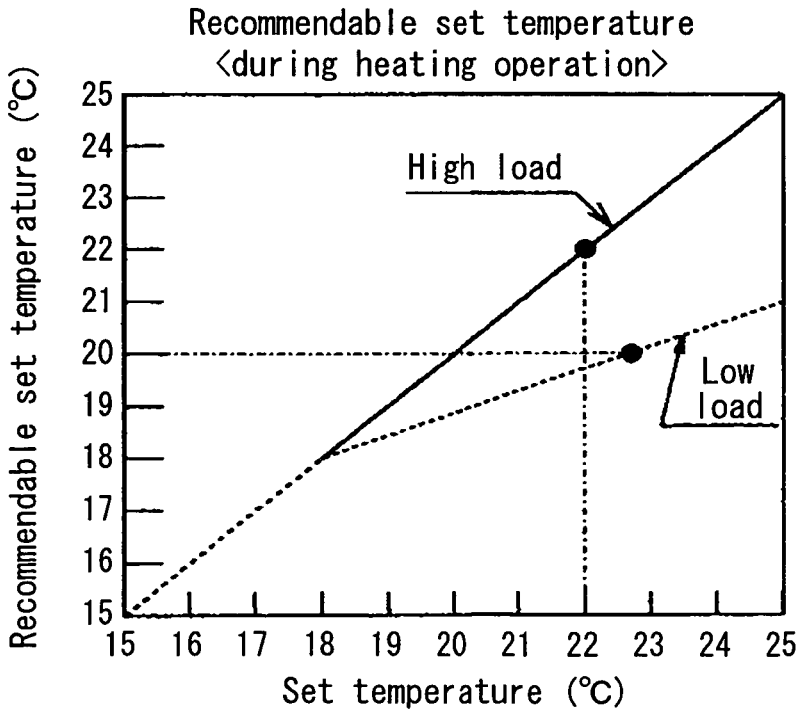
FIG. 26 is a graph illustrating the relationship between set temperature and recommendable set temperature during heating operation.

On the other hand, during heating operation, the set temperature of 22° C. is maintained when the load level is low, and the set temperature of 22° C. is automatically switched to the recommendable set temperature of 20° C. when the load level is high, as shown in FIGS. 26 and 27. By performing an air conditioning operation while appropriately allowing switching between the set temperature and the recommendable set temperature in this manner, energy conservation can be improved.

Figure 11:
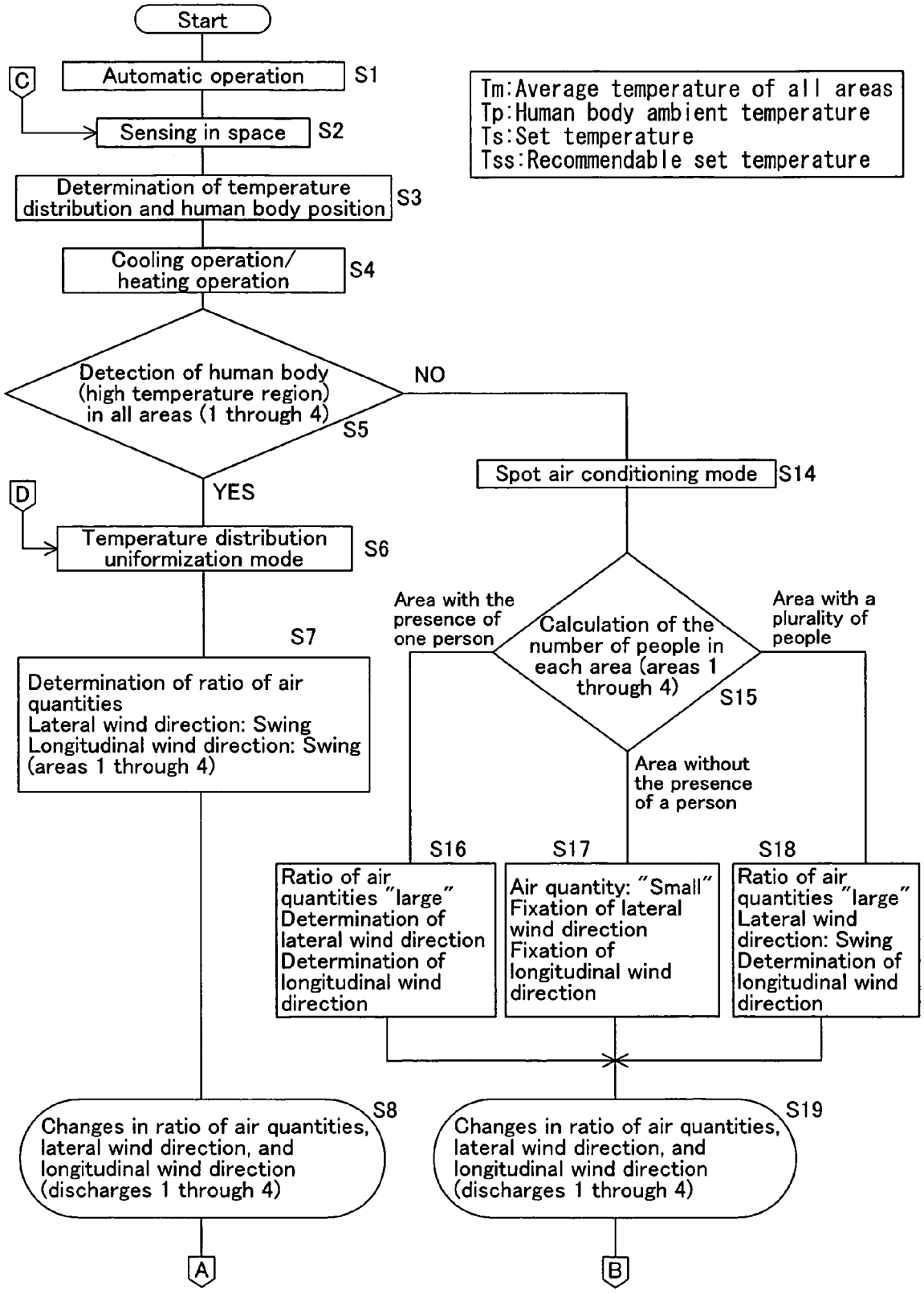
FIG. 11 is a flow chart illustrating the first half of the process of control in a first exemplary operational control for an overall air conditioning apparatus including an indoor unit.
Figure 12:
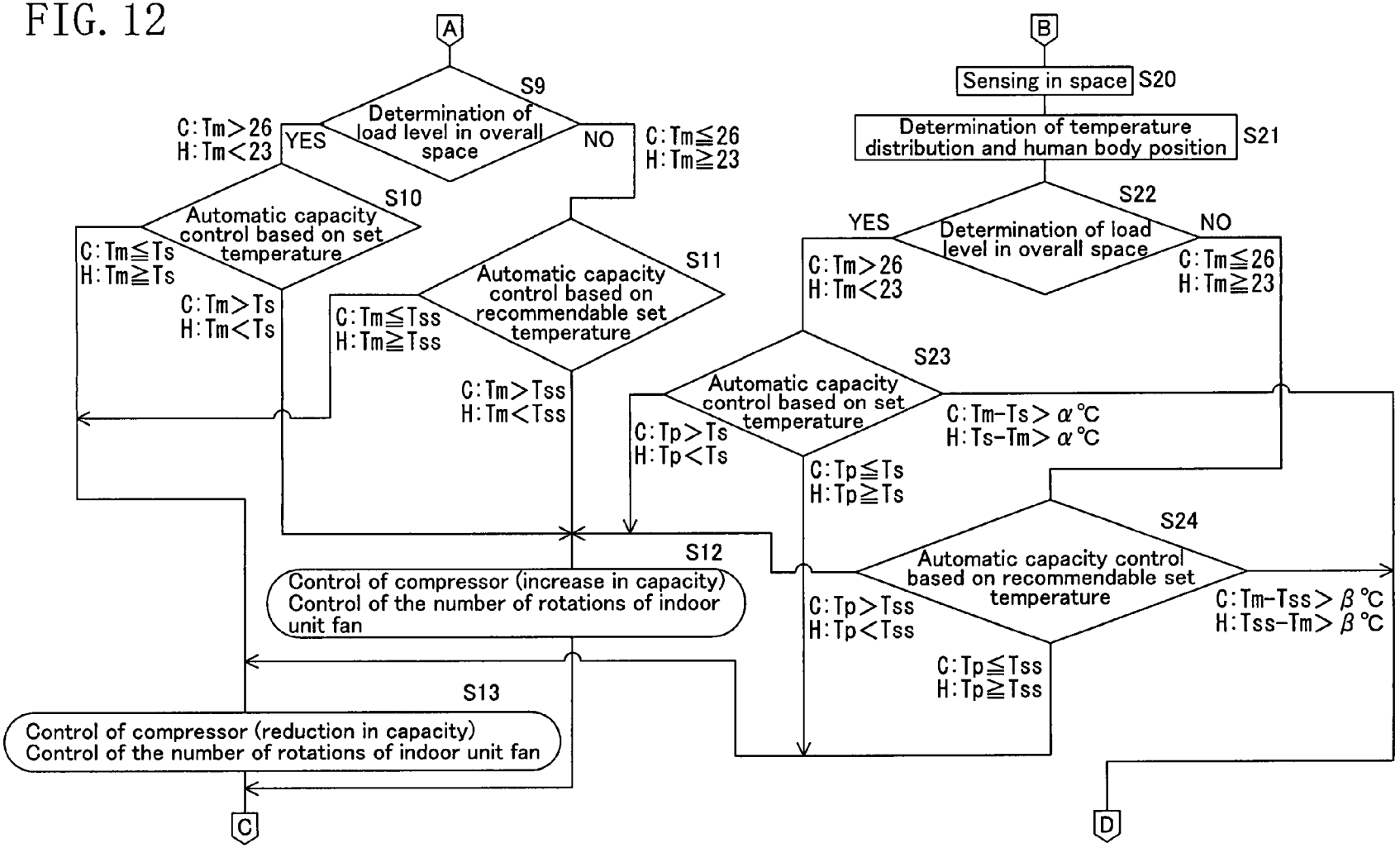
FIG. 12 is a flow chart illustrating the latter half of the process of control in the first exemplary operational control for an overall air conditioning apparatus including an indoor unit.

(d) Exemplary Control (d-1) First Exemplary Control (see FIGS. 11 and 12)

The first exemplary control is targeted for the indoor unit Z according to the first embodiment (i.e., the indoor unit formed to include, as the detection means 51, only the infrared sensor 15), and the control over switching of the operational air conditioning mode between the temperature uniformization mode and the spot air conditioning mode is automatically carried out based on the presence or absence of a human body (presence or absence of a high temperature region) in each of the areas 1 through 4 of the space to be air-conditioned W.

As illustrated in the flow charts in FIGS. 11 and 12, first, "automatic operation" is selected as an operation mode after the start of the control (step S1), and then the radiation temperatures of the areas (1) through (4) are sequentially detected using the infrared sensors 15, 15, . . . (step S2). Based on the detected values for the areas (1) through (4), the temperature distribution in the overall space to be air-conditioned W is calculated, and the position of a human body in each of the areas (1) through (4) (i.e., a high temperature region in each area) is determined (step S3). Furthermore, at this time, a manipulation signal for cooling operation or heating operation is inputted, thus allowing the air conditioning apparatus to perform cooling operation or heating operation (step S4).

Subsequently, it is determined in step S5 whether or not the presence of a human body is detected in each of the areas (1) through (4), and the determination result is employed as the criterion for switching the operational air conditioning mode.

It should be noted that although whether or not a person is present in each of the areas (1) through (4) is employed as the criterion for switching the operational air conditioning mode in this exemplary control, the percentage of the area with the presence of a person to all the areas (1) through (4) may naturally be employed as the criterion for switching the operational air conditioning mode in the other exemplary control. The criterion for the switching in this exemplary control is merely an example (in this example, the percentage of the area with the presence of a person to all the areas is 100%).

If it is now determined in step S5 that a person is present in each of the areas (1) through (4), the operational air conditioning mode is set to the temperature uniformization mode (step S6). On the other hand, if any one of the areas (1) through (4) is without the presence of a person, the operational air conditioning mode is set to the spot air conditioning mode (step S14).

In the former case, even if the number of people may vary, at least a person is present in each of the areas (1) through (4); therefore, in order to ensure the comfort of air conditioning in each of the areas (1) through (4), it is preferable that the temperatures of the areas (1) through (4) are each set at a uniformized temperature as much as possible.

To the contrary, in the latter case, at least one of the areas (1) through (4) is without the presence of a person. Therefore, if the area without the presence of a person is air-conditioned as with the other areas (i.e., the areas with the presence of people), the air conditioning operation becomes uneconomical by the air conditioning of the area without the presence of a person; thus, it is conceivable that spot air conditioning of only the areas with the presence of people is more advantageous from the viewpoint of energy conservation. In other words, it is conceivable that this is an optimum method for achieving both of the comfort of air conditioning and energy conservation.

If the answer is YES in step S5, the process of the control goes to the execution of the temperature uniformization mode (step S6), and the operational mode of the air flow changing means 52 is first determined in order to uniformize the room temperature.

Specifically, in step S7, the ratio of air quantities from the outlets 4, 4, . . . of the indoor unit Z (i.e., the ratio of opening areas in the outlets 4, 4, . . . adjusted by the air quantity distribution mechanisms 10, 10, . . . ) is calculated, and the operational modes of the first flaps 12, 12, . . . and the second flaps 13, 13, . . . are each set at "swing". In this step, the operational modes of all the first flaps 12 and second flaps 13 are each set at "swing" because it is necessary to discharge conditioned air evenly to a wider range of the room from the outlets 4, 4, . . . .

Based on each setting made in step S7, the ratio of air quantities, lateral wind direction, and longitudinal wind direction are adjusted (step S8).

Next, the process goes to the control of the capacity of the indoor unit Z in the temperature uniformization mode. To require the indoor unit Z to provide a capacity more than necessary is undesirable from the standpoint of ensuring energy conservation. Therefore, if the indoor unit Z provides an excessive capacity, the indoor unit Z is controlled so that its capacity is reduced, and if the indoor unit Z provides an insufficient capacity, the indoor unit Z is controlled so that its capacity is increased. Specifically, the indoor unit Z is controlled as follows.

First, the level of a load applied to the overall space to be air-conditioned W is determined in step S9. To be more specific, when cooling operation is currently performed, it is determined whether the average temperature Tm of all the areas (1) through (4) inside the room is lower than, equal to or higher than 26° C., and when heating operation is currently performed, it is determined whether the average temperature Tm of all the areas (1) through (4) inside the room is lower than, equal to or higher than 23° C. It should be noted that the average temperature is determined by the average of the radiation temperatures of the areas (1) through (4) detected by the infrared sensor 15.

In this step, if it is determined that the load level is high (i.e., if the average temperature Tm is higher than 26° C. during cooling operation, or if the average temperature Tm is lower than 23° C. during heating operation), the process goes to automatic capacity control that is carried out based on a set temperature Ts (step S10). To the contrary, if it is determined that the load level is low (i.e., if the average temperature Tm is equal to or lower than 26° C. during cooling operation, or if the average temperature Tm is equal to or higher than 23° C. during heating operation), the process goes to automatic capacity control that is carried out based on a recommendable set temperature Tss (step S11).

First, in carrying out the automatic capacity control based on the set temperature Ts, a comparison is made between the current average temperature Tm and the set temperature Ts in step S10. In this step, when the average temperature Tm is equal to or lower than the set temperature Ts during cooling operation, or when the average temperature Tm is equal to or higher than the set temperature Ts during heating operation, it is determined that air conditioning capacity is excessive. In this case, the indoor unit Z is controlled so that its capacity is reduced, for example, by reducing the number of rotations of a compressor and reducing the number of rotations of the fan 6 of the indoor unit Z (step S13).

To the contrary, when the average temperature Tm is higher than the set temperature Ts during cooling operation, or when the average temperature Tm is lower than the set temperature Ts during heating operation, it is determined that air conditioning capacity is insufficient. In this case, the indoor unit Z is controlled so that its capacity is increased, for example, by increasing the number of rotations of a compressor and increasing the number of rotations of the fan 6 (step S12).

On the other hand, in carrying out the automatic capacity control based on the recommendable set temperature Tss, first, a comparison is made between the current average temperature Tm and the recommendable set temperature Tss in step S11. In this step, when the average temperature Tm is equal to or lower than the recommendable set temperature Tss during cooling operation, or when the average temperature Tm is equal to or higher than the recommendable set temperature Tss during heating operation, it is determined that air conditioning capacity is excessive. In this case, the indoor unit Z is controlled so that its capacity is reduced (step S13). To the contrary, when the average temperature Tm is higher than the recommendable set temperature Tss during cooling operation, or when the average temperature Tm is lower than the recommendable set temperature Tss during heating operation, it is determined that air conditioning capacity is insufficient. In this case, the indoor unit Z is controlled so that its capacity is increased (step S12).

The above-described operation and automatic capacity control in the temperature uniformization mode are repeatedly carried out as long as the requirements for the execution of the temperature uniformization mode are met.

On the other hand, if the answer is NO in step S5 (i.e., if it is determined that there exist, among all the areas (1) through (4), at least one or more of the areas without the presence of people), the process goes to the execution of the spot air conditioning mode (step S14).

After the operational air conditioning mode has been switched to the spot air conditioning mode, first, the number of people present in each of the areas (1) through (4) is calculated in step S15. Then, in order to realize the optimum spot air conditioning for each of the areas (1) through (4) in accordance with the number of people present in each of the areas (1) through (4), the required operational modes of the air flow changing means 52 provided in the outlets 4, 4, . . . , each associated with the corresponding one of the areas (1) through (4), are determined.

For the area with the presence of only one person, the ratio of air quantities is set at "large", and the lateral wind direction and longitudinal wind direction (i.e., the operational modes of the first flaps 12 and the second flaps 13) are determined so as to direct the discharge of conditioned air toward the position of a human body (step 16).

In addition, for the area without the presence of a person, since this area does not need air conditioning itself, the ratio of air quantities is fixed at "small" and the lateral wind direction and longitudinal wind direction are both fixed (step S17).

Furthermore, the area with the presence of a plurality of people most needs air conditioning and requires uniform air conditioning of the entire area. Therefore, for this area, the ratio of air quantities is set at "large"; in addition, to determine each discharge direction of conditioned air, the operational modes of the flaps for changing the lateral wind direction are each set at "swing", and the operational modes of the flaps for changing the longitudinal wind direction are each determined in accordance with the position of a human body (step S18).

Based on the settings made in steps S16 through S15, the ratio of air quantities, lateral wind direction, and longitudinal wind direction are adjusted (step S19).

Next, the process goes to the control of the capacity of the indoor unit Z in the spot air conditioning mode. Also in the spot air conditioning mode, to require the indoor unit Z to provide a capacity more than necessary is undesirable from the standpoint of ensuring energy conservation, as in the above-described temperature uniformization mode. Therefore, if the indoor unit Z provides an excessive capacity, the indoor unit Z is controlled so that its capacity is reduced, and if the indoor unit Z provides an insufficient capacity, the indoor unit Z is controlled so that its capacity is increased. Specifically, the indoor unit Z is controlled as follows.

First, in step S20, the infrared sensor 15 carries out detection for each of the areas (1) through (4) of the space to be air-conditioned W again, and the temperature distribution and position of a human body in the overall space to be air-conditioned W are determined based on pieces of the detected information (step 21).

Next, in step S22, the load level in the overall space to be air-conditioned W is determined. If cooling operation is currently performed, it is determined whether the average temperature Tm of all the areas (1) through (4) inside the room is lower than, equal to or higher than 26° C., and if heating operation is currently performed, it is determined whether the average temperature Tm of all the areas (1) through (4) is lower than, equal to or higher than 23° C.

If it is determined that the load level is high (i.e., if the average temperature Tm is higher than 26° C. during cooling operation, or if the average temperature Tm is lower than 23° C. during heating operation), the process goes to automatic capacity control that is carried out based on a set temperature Ts (step S23). To the contrary, if it is determined that the load level is low (i.e., if the average temperature Tm is equal to or lower than 26° C. during cooling operation, or if the average temperature Tm is equal to or higher than 23° C. during heating operation), the process goes to automatic capacity control that is carried out based on a recommendable set temperature Tss (step S24).

First, in carrying out the automatic capacity control based on the set temperature Ts, a comparison is made between the current human body ambient temperature Tp and the set temperature Ts in step S23. In this step, when the human body ambient temperature Tp is equal to or lower than the set temperature Ts during cooling operation, or when the human body ambient temperature Tp is equal to or higher than the set temperature Ts during heating operation, it is determined that air conditioning capacity is excessive. In this case, the indoor unit Z is controlled so that its capacity is reduced (step S13).

To the contrary, when the human body ambient temperature Tp is higher than the set temperature Ts during cooling operation, or when the human body ambient temperature Tp is lower than the set temperature Ts during heating operation, it is determined that air conditioning capacity is insufficient. In this case, the indoor unit Z is controlled so that its capacity is increased (step S12).

Furthermore, when a difference between the average temperature Tm and the set temperature Ts is greater than a predetermined temperature $\alpha$° C. during cooling operation, or when a difference between the set temperature Ts and the average temperature Tm is greater than a predetermined temperature $\alpha$° C. during heating operation, it is deemed that the capacity control is unnecessary, and the process of the control is returned (step S23→step S6).

On the other hand, in carrying out the automatic capacity control based on the recommendable set temperature Tss, a comparison is made between the current human body ambient temperature Tp and the recommendable set temperature Tss in step S24. In this step, when the human body ambient temperature Tp is equal to or lower than the recommendable set temperature Tss during cooling operation, or when the human body ambient temperature Tp is equal to or higher than the recommendable set temperature Tss during heating operation, it is determined that air conditioning capacity is excessive. In this case, the indoor unit Z is controlled so that its capacity is reduced (step S13).

To the contrary, when the human body ambient temperature Tp is higher than the recommendable set temperature Tss during cooling operation, or when the human body ambient temperature Tp is lower than the recommendable set temperature Tss during heating operation, it is determined that air conditioning capacity is insufficient. In this case, the indoor unit Z is controlled so that its capacity is increased (step S12).

Furthermore, when a difference between the average temperature Tm and the set temperature Ts is greater than a predetermined temperature β° C. during cooling operation, or when a difference between the set temperature Ts and the average temperature Tm is greater than a predetermined temperature β° C. during heating operation, it is deemed that the capacity control is unnecessary, and the process of the control is returned (step S24→step S6).

The above-described operation and automatic capacity control in the spot air conditioning mode are repeatedly carried out as long as the requirements for the execution of the spot air conditioning mode are met.

Figure 13:
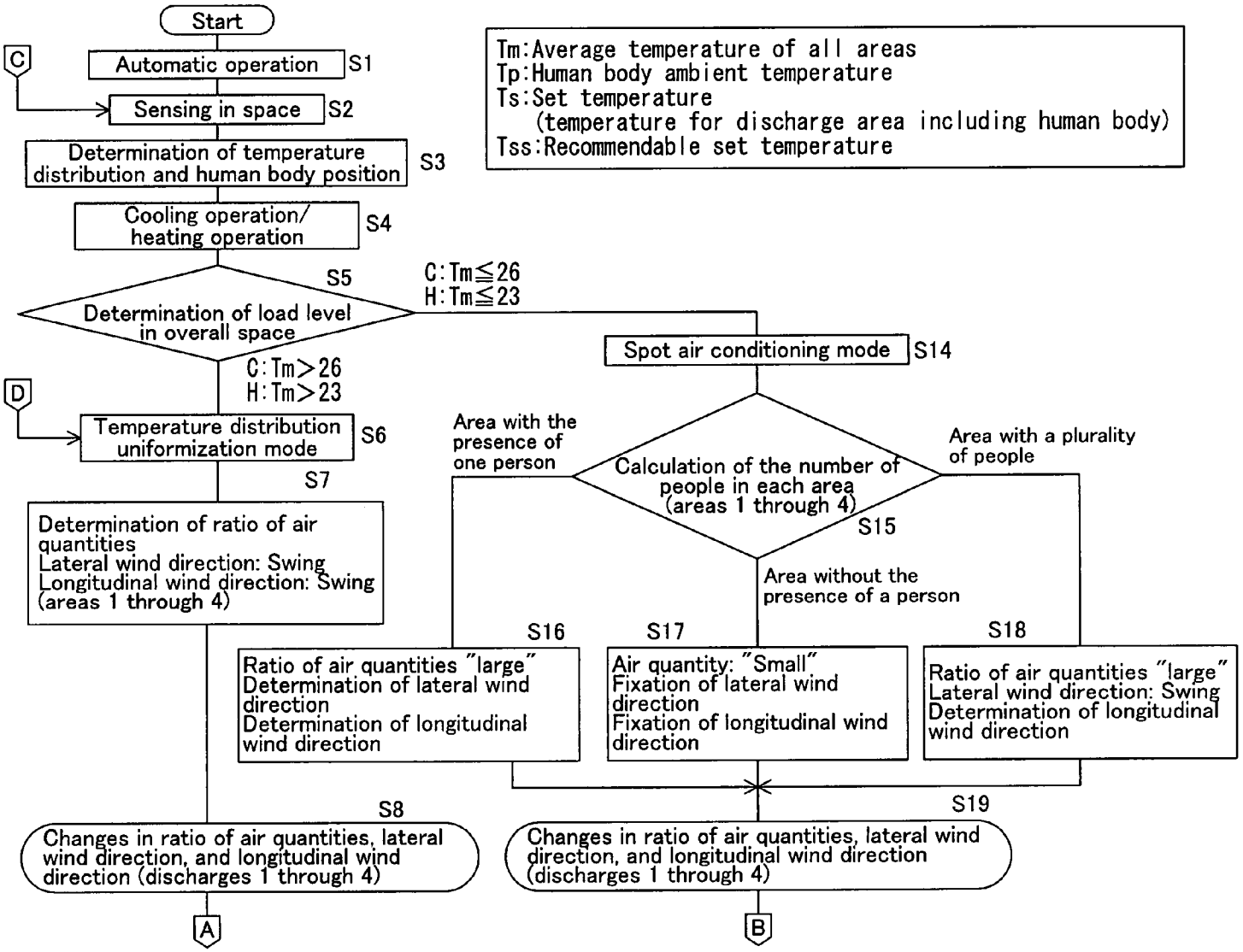
FIG. 13 is a flow chart illustrating the first half of the process of control in a second exemplary operational control for an overall air conditioning apparatus including an indoor unit.
Figure 14:
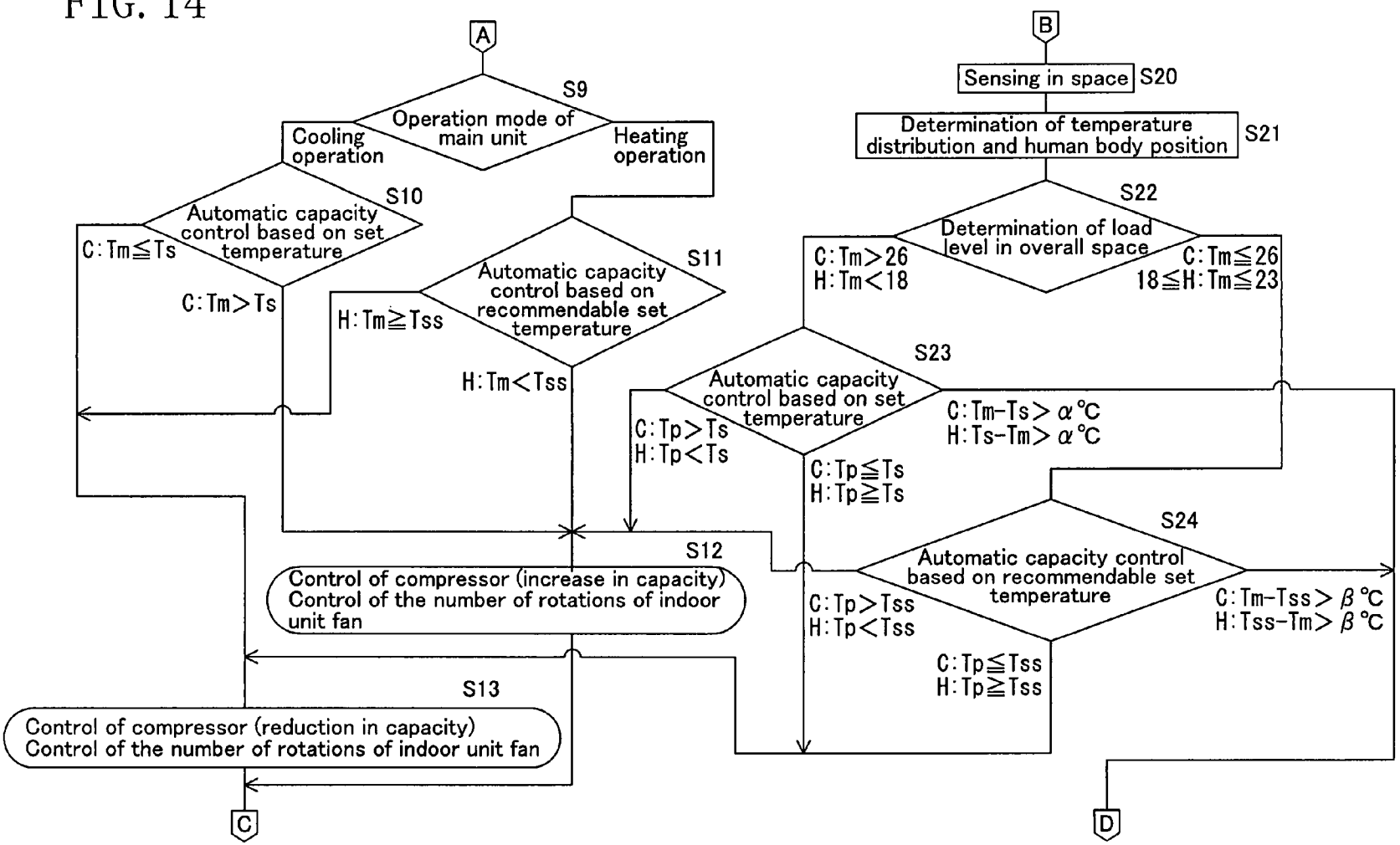
FIG. 14 is a flow chart illustrating the latter half of the process of control in the second exemplary operational control for an overall air conditioning apparatus including an indoor unit.

(d-2) Second Exemplary Control (see FIGS. 13 and 14)

The second exemplary control is targeted for the indoor unit Z according to the first embodiment (i.e., the indoor unit formed to include, as the detection means 51, only the infrared sensor 15). In the second exemplary control, the control over switching of the operational air conditioning mode between the temperature uniformization mode and the spot air conditioning mode is automatically carried out based on whether the load level in the overall space to be air-conditioned W is high or low.

As illustrated in the flow charts in FIGS. 13 and 14, first, "automatic operation" is selected as an operation mode after the start of the control (step S1), and then the radiation temperatures of the areas (1) through (4) are sequentially detected using the infrared sensors 15, 15, . . . (step S2). Based on the detected values for the areas (1) through (4), the temperature distribution in the overall space to be air-conditioned W is calculated, and the position of a human body in each of the areas (1) through (4) (i.e., a high temperature region in each area) is determined (step S3). Furthermore, at this time, a manipulation signal for cooling operation or heating operation is inputted, thus allowing the air conditioning apparatus to perform cooling operation or heating operation (step S4).

Subsequently, in step S5, the load level in the overall space to be air-conditioned W is determined, and the determination result is employed as the criterion for switching the operational air conditioning mode. It should be noted that the load level in the overall space to be air-conditioned W is determined by making a comparison between the average temperature Tm of the overall space to be air-conditioned W and reference temperature. Furthermore, the average temperature Tm is determined by the average of the radiation temperatures of the areas (1) through (4) detected by the infrared sensor 15.

In step S5, when cooling operation is performed, it is determined whether the average temperature Tm is lower than, equal to or higher than 26° C., and when heating operation is performed, it is determined whether the average temperature Tm is lower than, equal to or higher than 23° C. To be more specific, when it is determined that the average temperature Tm is higher than 26° C. during cooling operation, or when it is determined that the average temperature Tm is higher than 23° C. during heating operation, the process of the control goes to the execution of the temperature uniformization mode (step S6). To the contrary, when it is determined that the average temperature Tm is equal to or lower than 26° C. during cooling operation, or when it is determined that the average temperature Tm is equal to or lower than 23° C. during heating operation, the process goes to the execution of the spot air conditioning mode (step S14).

In the former case, the average temperature Tm in the space to be air-conditioned W is high, i.e., a lot of people are present in the space to be air-conditioned W, and therefore, there is a great need for the uniformization of the temperature of the overall space to be air-conditioned W. To the contrary, in the latter case, the average temperature Tm in the space to be air-conditioned W is low, i.e., only a few people are present in the space to be air-conditioned W, and therefore, it is more economical to provide spot air conditioning to the surroundings of people than to provide air conditioning to the overall space to be air-conditioned W.

After the operational air conditioning mode has been switched to the temperature uniformization mode (step S6), first, the operational mode of each air flow changing means 52 is determined in order to uniformize the room temperature.

In step S7, the ratio of air quantities from the outlets 4, 4, . . . of the indoor unit Z (i.e., the ratio of opening areas in the outlets 4, 4, . . . adjusted by the air quantity distribution mechanisms 10, 10, . . . ) is calculated. Furthermore, the operational modes of the first flaps 12, 12, . . . and the second flaps 13, 13, . . . are each set at "swing". In this step, the operational modes of all the first flaps 12 and second flaps 13 are each set at "swing" because it is necessary to discharge conditioned air evenly to a wider range of the room from the outlets 4, 4, . . . .

Based on each setting made in step S7, the ratio of air quantities, lateral wind direction, and longitudinal wind direction are adjusted (step S8).

Next, the process goes to the control of the capacity of the indoor unit Z in the temperature uniformization mode. To require the indoor unit Z to provide a capacity more than necessary is undesirable from the standpoint of ensuring energy conservation. Therefore, if the indoor unit Z provides an excessive capacity, the indoor unit Z is controlled so that its capacity is reduced, and if the indoor unit Z provides an insufficient capacity, the indoor unit Z is controlled so that its capacity is increased. Specifically, the indoor unit Z is controlled as follows.

First, it is determined in step S9 whether the operation mode of the main unit of the air conditioning apparatus is a cooling mode or a heating mode. If the operation mode is the cooling mode, the process goes to automatic capacity control that is carried out based on a set temperature (step 10), and if the operation mode is the heating mode, the process goes to automatic capacity control that is carried out based on a recommendable set temperature (step S11). In step S9, the selection of the mode of the automatic capacity control is carried out based on the operation mode of the main unit because of the following reasons. The average temperature Tm of the space to be air-conditioned W is high in the temperature uniformization mode; therefore, air conditioning is preferably performed at the set temperature during cooling operation since the load level is high. To the contrary, air conditioning is preferably performed at the recommendable set temperature during heating operation since the load level is low.

In carrying out the automatic capacity control based on the set temperature, first, a comparison is made between the average temperature Tm and the set temperature Ts in step S10. In this step, when the average temperature Tm is equal to or lower than the set temperature Ts, it is determined that air conditioning capacity is excessive. In this case, the indoor unit Z is controlled so that its capacity is reduced, for example, by reducing the number of rotations of a compressor and reducing the number of rotations of the fan 6 of the indoor unit Z (step S13).

To the contrary, when the average temperature Tm is higher than the set temperature Ts, it is determined that air conditioning capacity is insufficient. In this case, the indoor unit Z is controlled so that its capacity is increased, for example, by increasing the number of rotations of a compressor and increasing the number of rotations of the fan 6 (step S12).

On the other hand, in carrying out the automatic capacity control based on the recommendable set temperature Tss, first, a comparison is made between the current average temperature Tm and the recommendable set temperature Tss in step S11. When the average temperature Tm is equal to or higher than the recommendable set temperature Tss, it is determined that air conditioning capacity is excessive. In this case, the indoor unit Z is controlled so that its capacity is reduced (step S13). To the contrary, when the average temperature Tm is lower than the recommendable set temperature Tss, it is determined that air conditioning capacity is insufficient. In this case, the indoor unit Z is controlled so that its capacity is increased (step S12).

The above-described operation and automatic capacity control in the temperature uniformization mode are repeatedly carried out as long as the requirements for the execution of the temperature uniformization mode are met.

On the other hand, if the spot air conditioning mode has been selected in step S5, the process goes to the execution of the spot air conditioning mode (step S14).

After the operational air conditioning mode has been switched to the spot air conditioning mode, first, the number of people present in each of the areas (1) through (4) is calculated in step S15. In order to realize the optimum spot air conditioning for each of the areas (1) through (4) in accordance with the number of people present in each of the areas (1) through (4), the required operational modes of the air flow changing means 52 provided in the outlets 4, 4, . . . , each associated with the corresponding one of the areas (1) through (4), are determined.

For the area with the presence of only one person, the ratio of air quantities is set at "large", and the lateral wind direction and longitudinal wind direction (i.e., the operational modes of the first flaps 12 and the second flaps 13) are determined so as to direct the discharge of conditioned air toward the position of a human body (step 16).

In addition, for the area without the presence of a person, since this area does not need air conditioning itself, the ratio of air quantities is fixed at "small" and the lateral wind direction and longitudinal wind direction are both fixed (step S17).

Furthermore, the area with the presence of a plurality of people most needs air conditioning and requires uniform air conditioning of the entire area. Therefore, for this area, the ratio of air quantities is set at "large". Besides, to determine each discharge direction of conditioned air, the operational modes of the flaps for changing the lateral wind direction are each set at "swing", and the operational modes of the flaps for changing the longitudinal wind direction are each determined in accordance with the position of a human body (step S18).

Based on the settings made in steps S16 through S18, the ratio of air quantities, lateral wind direction, and longitudinal wind direction are adjusted (step S19).

Next, the process goes to the control of the capacity of the indoor unit Z in the spot air conditioning mode. Also in the spot air conditioning mode, to require the indoor unit Z to provide a capacity more than necessary is undesirable from the standpoint of ensuring energy conservation, as in the above-described temperature uniformization mode. Therefore, if the indoor unit Z provides an excessive capacity, the indoor unit Z is controlled so that its capacity is reduced, and if the indoor unit Z provides an insufficient capacity, the indoor unit Z is controlled so that its capacity is increased. Furthermore, if the states of the excessive capacity and insufficient capacity are within a predetermined range and are too negligible to carry out control, the process of the control is returned without carrying out any capacity control. Specifically, the following steps are performed.

First, in step S20, the infrared sensor 15 carries out detection for each of the areas (1) through (4) of the space to be air-conditioned W again, and the temperature distribution and human body position in the overall space to be air-conditioned W are determined based on pieces of the detected information (step 21).

Next, in step S22, the load level in the overall space to be air-conditioned W is determined. To be more specific, if cooling operation is currently performed, it is determined whether the average temperature Tm of all the areas (1) through (4) inside the room is lower than, equal to or higher than 26° C. On the other hand, if heating operation is currently performed, it is determined whether the average temperature Tm is in the range of 18° C. to 23° C. or lower than 18° C.

If it is determined that the load level is high (i.e., if the average temperature Tm is higher than 26° C. during cooling operation, or if the average temperature Tm is lower than 18° C. during heating operation), the process goes to automatic capacity control that is carried out based on a set temperature Ts (step S23). To the contrary, if it is determined that the load level is low (i.e., if the average temperature Tm is equal to or lower than 26° C. during cooling operation, or if the average temperature Tm is in the rage of 18° C. to 23° C. during heating operation), the process goes to automatic capacity control that is carried out based on a recommendable set temperature Tss (step S24).

First, in carrying out the automatic capacity control based on the set temperature Ts, a comparison is made between the current human body ambient temperature Tp and the set temperature Ts in step S23. In this step, when the human body ambient temperature Tp is equal to or lower than the set temperature Ts during cooling operation, or when the human body ambient temperature Tp is equal to or higher than the set temperature Ts during heating operation, it is determined that air conditioning capacity is excessive. In this case, the indoor unit Z is controlled so that its capacity is reduced (step S13).

To the contrary, when the human body ambient temperature Tp is higher than the set temperature Ts during cooling operation, or when the human body ambient temperature Tp is lower than the set temperature Ts during heating operation, it is determined that air conditioning capacity is insufficient. In this case, the indoor unit Z is controlled so that its capacity is increased (step S12).

Furthermore, when a difference between the average temperature Tm and the set temperature Ts is greater than a predetermined temperature $\alpha$° C. during cooling operation, or when a difference between the set temperature Ts and the average temperature Tm is greater than a predetermined temperature $\alpha$° C. during heating operation, it is deemed that the capacity control is unnecessary, and the process of the control is returned (step S23→step S6).

On the other hand, in carrying out the automatic capacity control based on the recommendable set temperature Tss, a comparison is made between the current human body ambient temperature Tp and the recommendable set temperature Tss in step S24. In this step, when the human body ambient temperature Tp is equal to or lower than the recommendable set temperature Tss during cooling operation, or when the human body ambient temperature Tp is equal or higher than the recommendable set temperature Tss during heating operation, it is determined that air conditioning capacity is excessive. In this case, the indoor unit Z is controlled so that its capacity is reduced (step S13).

To the contrary, when the human body ambient temperature Tp is higher than the recommendable set temperature Ts during cooling operation, or when the human body ambient temperature Tp is lower than the recommendable set temperature Ts during heating operation, it is determined that air conditioning capacity is insufficient. In this case, the indoor unit Z is controlled so that its capacity is increased (step S12).

Furthermore, when a difference between the average temperature Tm and the set temperature Ts is greater than a predetermined temperature β° C. during cooling operation, or when a difference between the set temperature Ts and the average temperature Tm is greater than a predetermined temperature β° C. during heating operation, it is deemed that the capacity control is unnecessary, and the process of the control is returned (step S24→step S6).

The above-described operation and automatic capacity control in the spot air conditioning mode are repeatedly carried out as long as the requirements for the execution of the spot air conditioning mode are met.

Figure 15:
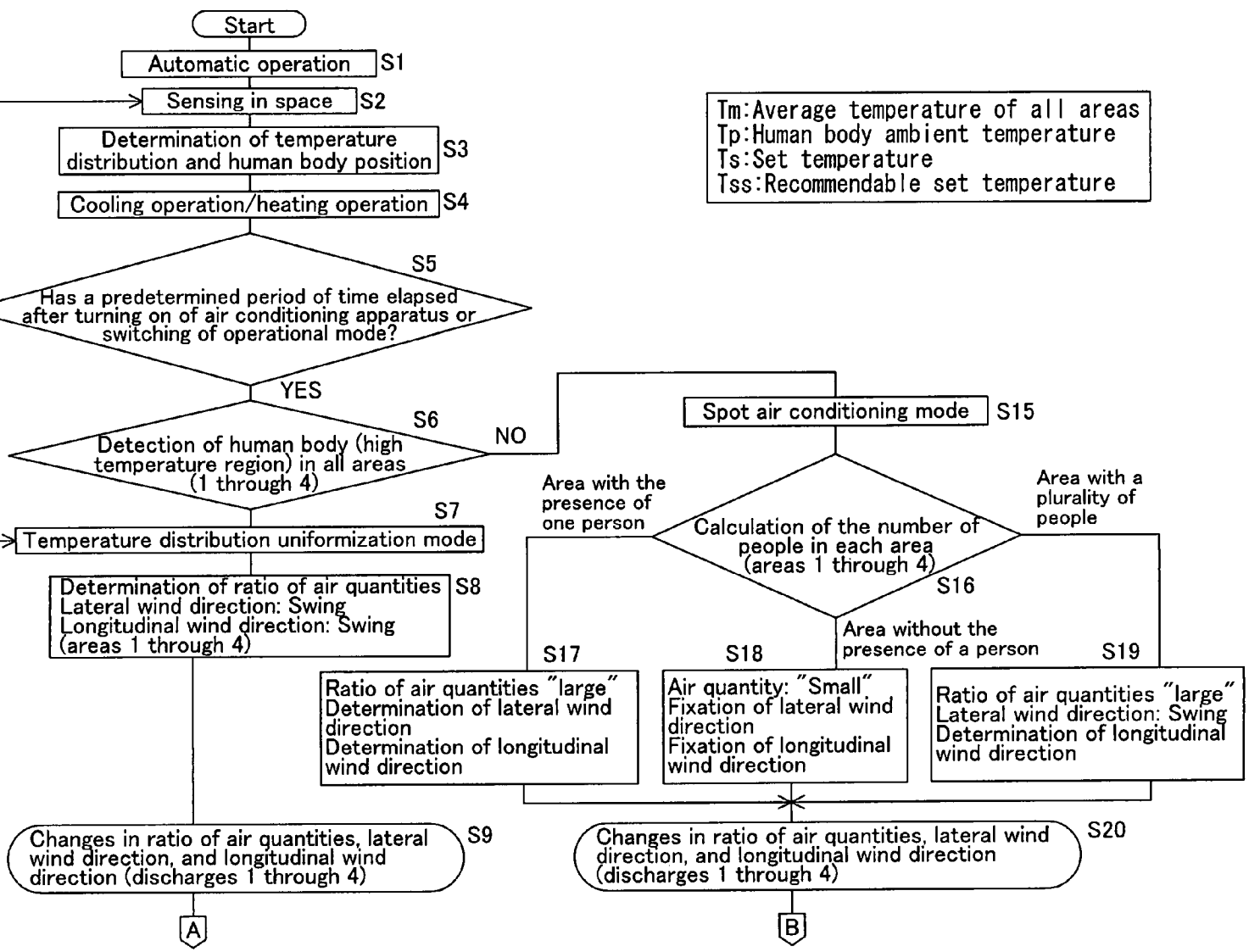
FIG. 15 is a flow chart illustrating the first half of the process of control in a third exemplary operational control for an overall air conditioning apparatus including an indoor unit.
Figure 16:
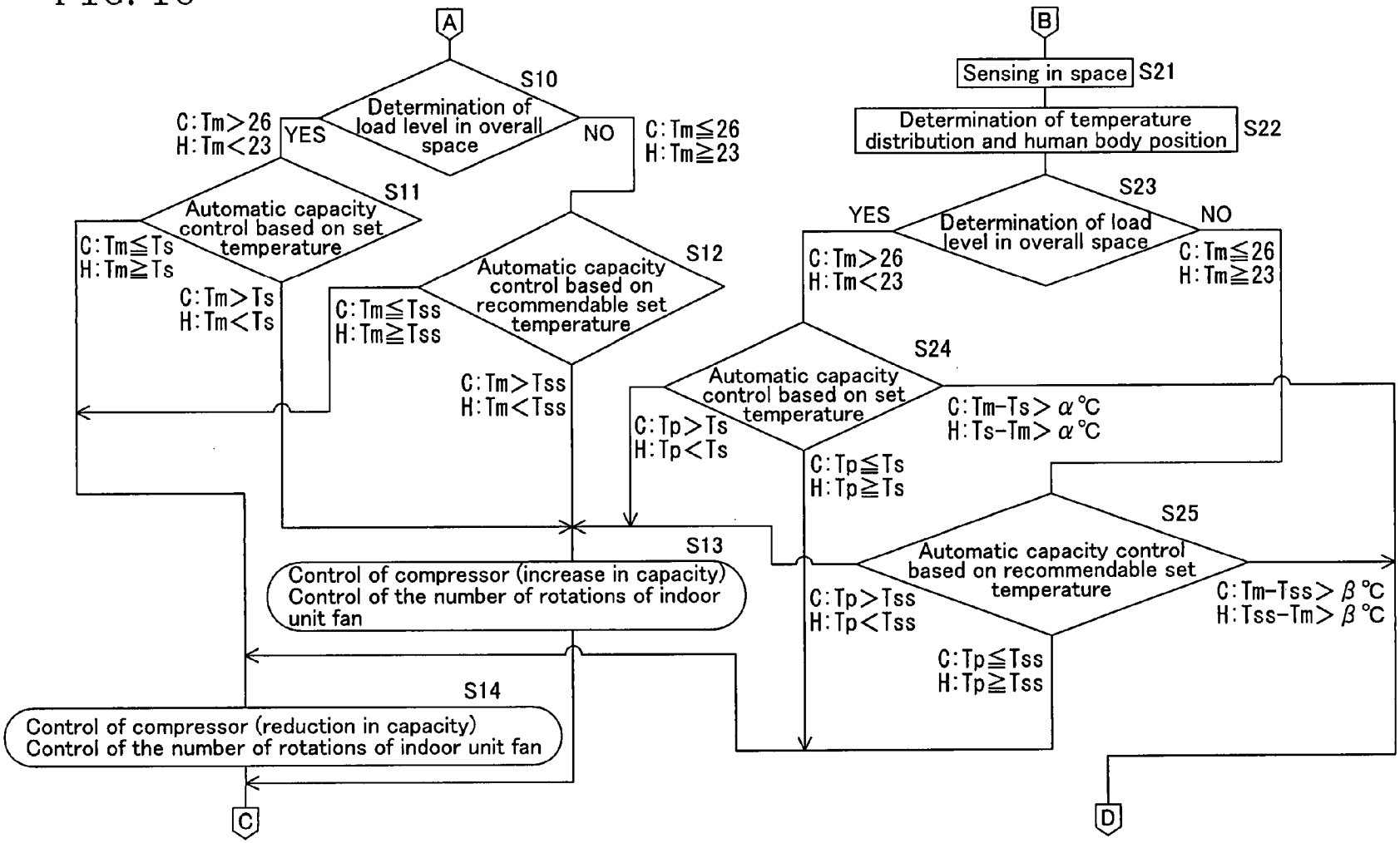
FIG. 16 is a flow chart illustrating the latter half of the process of control in the third exemplary operational control for an overall air conditioning apparatus including an indoor unit.

(d-3) Third Exemplary Control (see FIGS. 15 and 16)

The third exemplary control is targeted for the indoor unit Z according to the first embodiment (i.e., the indoor unit formed to include, as the detection means 51, only the infrared sensor 15). In the third exemplary control, basically, the control over switching of the operational air conditioning mode between the temperature uniformization mode and the spot air conditioning mode is automatically carried out based on the presence or absence of a human body (i.e., the presence or absence of a high temperature region) in each of the areas 1 through 4 of the space to be air-conditioned W as in the first exemplary control. Furthermore, in the third exemplary control, the control over the switching of the stabilized operational air conditioning mode is realized by causing a delay in the control over the switching of the operational air conditioning mode.

As illustrated in the flow charts in FIGS. 15 and 16, first, "automatic operation" is selected as an operation mode after the start of the control (step S1), and then the radiation temperatures of the areas (1) through (4) are sequentially detected using the infrared sensors 15, 15, . . . (step S2). Based on the detected values for the areas (1) through (4), the temperature distribution in the overall space to be air-conditioned W is calculated, and the position of a human body in each of the areas (1) through (4) (i.e., a high temperature region in each area) is determined (step S3). Furthermore, at this time, a manipulation signal for cooling operation or heating operation is inputted, thus allowing the air conditioning apparatus to perform cooling operation or heating operation (step S4).

Subsequently, it is determined in step S5 whether or not a predetermined period of time has elapsed after the start of the operation or after the previous switching of the operational air conditioning mode. If the answer is YES in this step, the operational air conditioning mode is immediately set at the temperature uniformization mode (step S7) without determining the selection of the operational air conditioning mode, and air conditioning is continuously performed in the temperature uniformization mode until the predetermined period of time has elapsed. To the contrary, if the answer is NO, the process goes to the selection of the operational air conditioning mode in step S6.

In this manner, the operational air conditioning mode is fixed at the temperature uniformization mode until a predetermined period of time has elapsed after the start of the operation or the previous switching of the operational air conditioning mode. Accordingly, the control over switching of the initial or next operational air conditioning mode is carried out after the stabilization of the operation of the air conditioning apparatus itself, or after the stabilization of the operational change of each air flow changing means 52 performed in switching the operational air conditioning mode. Consequently, the reliability of the control is ensured, and thus the comfort of air conditioning or energy conservation is improved with much more certainty.

Next, in step S6, it is determined whether or not the presence of a human body is detected in each of the areas (1) through (4), and the determination result is employed as the criterion for switching the operational air conditioning mode.

It should be noted that in this exemplary control, whether or not a person is present in each of the areas (1) through (4) is employed as the criterion for switching the operational air conditioning mode. In the other exemplary control, however, the percentage of the area with the presence of a person to all the areas (1) through (4) may naturally be employed as the criterion for switching the operational air conditioning mode. The criterion for the switching in this exemplary control is merely an example (in this example, the percentage of the area with the presence of a person to all the areas is 100%).

If it is determined in step S6 that a person is currently present in each of the areas (1) through (4), the operational air conditioning mode is set to the temperature uniformization mode (step S7). On the other hand, if it is determined that any one of the areas (1) through (4) is without the presence of a person, the operational air conditioning mode is set to the spot air conditioning mode (step S115).

In the former case, even if the number of people may vary, at least a person is present in each of the areas (1) through (4). Therefore, in order to ensure the comfort of air conditioning in each of the areas (1) through (4), it is preferable that the temperatures of the areas (1) through (4) are each set at a uniformized temperature as much as possible. To the contrary, in the latter case, at least one of the areas (1) through (4) is without the presence of a person. Therefore, if the area without the presence of a person is air-conditioned as with the other areas (i.e., the areas with the presence of people), the air conditioning operation becomes uneconomical by the air conditioning of the area without the presence of a person. Thus, it is conceivable that spot air conditioning of only the areas with the presence of people is more advantageous from the viewpoint of energy conservation. In other words, it is conceivable that this is an optimum method for achieving both of the comfort of air conditioning and energy conservation.

If the answer is YES in step S6, the process of the control goes to the execution of the temperature uniformization mode (step S7), and the operational mode of the air flow changing means 52 is first determined in order to uniformize the room temperature.

In step S8, the ratio of air quantities from the outlets 4, 4, . . . of the indoor unit Z (i.e., the ratio of opening areas in the outlets 4, 4, . . . adjusted by the air quantity distribution mechanisms 10, 10, . . . ) is calculated, and the operational modes of the first flaps 12, 12, . . . and the second flaps 13, 13, . . . are each set at "swing". In this step, the operational modes of all the first flaps 12 and second flaps 13 are each set at "swing" because it is necessary to discharge conditioned air evenly to a wider range of the room from the outlets 4, 4, . . . .

Based on each setting made in step S7, the ratio of air quantities, lateral wind direction, and longitudinal wind direction are adjusted (step S9).

Next, the process goes to the control of the capacity of the indoor unit Z in the temperature uniformization mode. To require the indoor unit Z to provide a capacity more than necessary is undesirable from the standpoint of ensuring energy conservation. Therefore, if the indoor unit Z provides an excessive capacity, the indoor unit Z is controlled so that its capacity is reduced, and if the indoor unit Z provides an insufficient capacity, the indoor unit Z is controlled so that its capacity is increased. Specifically, the indoor unit Z is controlled as follows.

First, the load level in the overall space to be air-conditioned W is determined in step S10. To be more specific, when cooling operation is currently performed, it is determined whether the average temperature Tm of all the areas (1) through (4) inside the room is lower than, equal to or higher than 26° C., and when heating operation is currently performed, it is determined whether the average temperature Tm of all the areas (1) through (4) is lower than, equal to or higher than 23° C. It should be noted that the average temperature is determined by the average of the radiation temperatures of the areas (1) through (4) detected by the infrared sensor 15.

In this step, if it is determined that the load level is high (i.e., if the average temperature Tm is higher than 26° C. during cooling operation, or if the average temperature Tm is lower than 23° C. during heating operation), the process goes to automatic capacity control that is carried out based on a set temperature Ts (step S11). To the contrary, if it is determined that the load level is low (i.e., if the average temperature Tm is equal to or lower than 26° C. during cooling operation, or if the average temperature Tm is equal to or higher than 23° C. during heating operation), the process goes to automatic capacity control that is carried out based on a recommendable set temperature Tss (step S12).

First, in carrying out the automatic capacity control based on the set temperature Ts, a comparison is made between the current average temperature Tm and the set temperature Ts in step S11. In this step, when the average temperature Tm is equal to or lower than the set temperature Ts during cooling operation, or when the average temperature Tm is equal to or higher than the set temperature Ts during heating operation, it is determined that air conditioning capacity is excessive. In this case, the indoor unit Z is controlled so that its capacity is reduced, for example, by reducing the number of rotations of a compressor and reducing the number of rotations of the fan 6 of the indoor unit Z (step S14).

To the contrary, when the average temperature Tm is higher than the set temperature Ts during cooling operation, or when the average temperature Tm is lower than the set temperature Ts during heating operation, it is determined that air conditioning capacity is insufficient. In this case, the indoor unit Z is controlled so that its capacity is increased, for example, by increasing the number of rotations of a compressor and increasing the number of rotations of the fan 6 (step S13).

On the other hand, in carrying out the automatic capacity control based on the recommendable set temperature Tss, first, a comparison is made between the current average temperature Tm and the recommendable set temperature Tss in step S12. In this step, when the average temperature Tm is equal to or lower than the recommendable set temperature Tss during cooling operation, or when the average temperature Tm is equal to or higher than the recommendable set temperature Tss during heating operation, it is determined that air conditioning capacity is excessive. In this case, the indoor unit Z is controlled so that its capacity is reduced (step S14). To the contrary, when the average temperature Tm is higher than the recommendable set temperature Tss during cooling operation, or when the average temperature Tm is lower than the recommendable set temperature Tss during heating operation, it is determined that air conditioning capacity is insufficient. In this case, the indoor unit Z is controlled so that its capacity is increased (step S13).

The above-described operation and automatic capacity control in the temperature uniformization mode are repeatedly carried out as long as the requirements for the execution of the temperature uniformization mode are met.

On the other hand, if the answer is NO in step S6 (i.e., if it is determined that there exist, among all the areas (1) through (4), at least one or more of the areas without the presence of people), the process goes to the execution of the spot air conditioning mode (step S15).

After the operational air conditioning mode has been switched to the spot air conditioning mode, first, the number of people present in each of the areas (1) through (4) is calculated in step S16. Then, in order to realize the optimum spot air conditioning for each of the areas (1) through (4) in accordance with the number of people present in each of the areas (1) through (4), the required operational modes of the air flow changing means 52 provided in the outlets 4, 4, . . . , each associated with the corresponding one of the areas (1) through (4), are determined.

For the area with the presence of only one person, the ratio of air quantities is set at "large", and the lateral wind direction and longitudinal wind direction (i.e., the operational modes of the first flaps 12 and the second flaps 13) are determined so as to direct the discharge of conditioned air toward the position of a human body (step 17).

In addition, for the area without the presence of a person, since this area does not need air conditioning itself, the ratio of air quantities is fixed at "small" and the lateral wind direction and longitudinal wind direction are both fixed (step S18).

Furthermore, the area with the presence of a plurality of people most needs air conditioning and requires uniform air conditioning of the entire area. Therefore, for this area, the ratio of air quantities is set at "large". In addition, to determine each discharge direction of conditioned air, the operational modes of the flaps for changing the lateral wind direction are each set at "swing", and the operational modes of the flaps for changing the longitudinal wind direction are each determined in accordance with the position of a human body (step S19).

Based on the settings made in steps S17 through S19, the ratio of air quantities, lateral wind direction, and longitudinal wind direction are adjusted (step S20).

Next, the process goes to the control of the capacity of the indoor unit Z in the spot air conditioning mode. Also in the spot air conditioning mode, to require the indoor unit Z to provide a capacity more than necessary is undesirable from the standpoint of ensuring energy conservation, as in the above-described temperature uniformization mode. Therefore, if the indoor unit Z provides an excessive capacity, the indoor unit Z is controlled so that its capacity is reduced, and if the indoor unit Z provides an insufficient capacity, the indoor unit Z is controlled so that its capacity is increased. Specifically, the indoor unit Z is controlled as follows.

First, in step S21, the infrared sensor 15 carries out detection for each of the areas (1) through (4) of the space to be air-conditioned W again, and the temperature distribution and human body position in the overall space to be air-conditioned W are determined based on pieces of the detected information (step 22).

Next, in step S23, the load level in the overall space to be air-conditioned W is determined. Specifically, if cooling operation is currently performed, it is determined whether the average temperature Tm of all the areas (1) through (4) inside the room is lower than, equal to or higher than 26° C., and if heating operation is currently performed, it is determined whether the average temperature Tm of all the areas (1) through (4) is lower than, equal to or higher than 23° C.

If it is determined that the load level is high (i.e., if the average temperature Tm is higher than 26° C. during cooling operation, or if the average temperature Tm is lower than 23° C. during heating operation), the process goes to automatic capacity control that is carried out based on a set temperature Ts (step S24). To the contrary, if it is determined that the load level is low (i.e., if the average temperature Tm is equal to or lower than 26° C. during cooling operation, or if the average temperature Tm is equal to or higher than 23° C. during heating operation), the process goes to automatic capacity control that is carried out based on a recommendable set temperature Tss (step S25).

First, in carrying out the automatic capacity control based on the set temperature Ts, a comparison is made between the current human body ambient temperature Tp and the set temperature Ts in step S24. In this step, when the human body ambient temperature Tp is equal to or lower than the set temperature Ts during cooling operation, or when the human body ambient temperature Tp is equal to or higher than the set temperature Ts during heating operation, it is determined that air conditioning capacity is excessive. In this case, the indoor unit Z is controlled so that its capacity is reduced (step S14).

To the contrary, when the human body ambient temperature Tp is higher than the set temperature Ts during cooling operation, or when the human body ambient temperature Tp is lower than the set temperature Ts during heating operation, it is determined that air conditioning capacity is insufficient. In this case, the indoor unit Z is controlled so that its capacity is increased (step S13).

Furthermore, when a difference between the average temperature Tm and the set temperature Ts is greater than a predetermined temperature α° C. during cooling operation, or when a difference between the set temperature Ts and the average temperature Tm is greater than a predetermined temperature α° C. during heating operation, it is deemed that the capacity control is unnecessary, and the process of the control is returned (step S24→step S7).

On the other hand, in carrying out the automatic capacity control based on the recommendable set temperature Tss, a comparison is made between the current human body ambient temperature Tp and the recommendable set temperature Tss in step S25. In this step, when the human body ambient temperature Tp is equal to or lower than the recommendable set temperature Tss during cooling operation, or when the human body ambient temperature Tp is equal to or higher than the recommendable set temperature Tss during heating operation, it is determined that air conditioning capacity is excessive. In this case, the indoor unit Z is controlled so that its capacity is reduced (step S14).

To the contrary, when the human body ambient temperature Tp is higher than the recommendable set temperature Tss during cooling operation, or when the human body ambient temperature Tp is lower than the recommendable set temperature Tss during heating operation, it is determined that air conditioning capacity is insufficient. In this case, the indoor unit Z is controlled so that its capacity is increased (step S13).

Furthermore, when a difference between the average temperature Tm and the set temperature Ts is greater than a predetermined temperature β° C. during cooling operation, or when a difference between the set temperature Ts and the average temperature Tm is greater than a predetermined temperature β° C. during heating operation, it is deemed that the capacity control is unnecessary, and the process of the control is returned (step S25→step S7).

The above-described operation and automatic capacity control in the spot air conditioning mode are repeatedly carried out as long as the requirements for the execution of the spot air conditioning mode are met.

Figure 17:
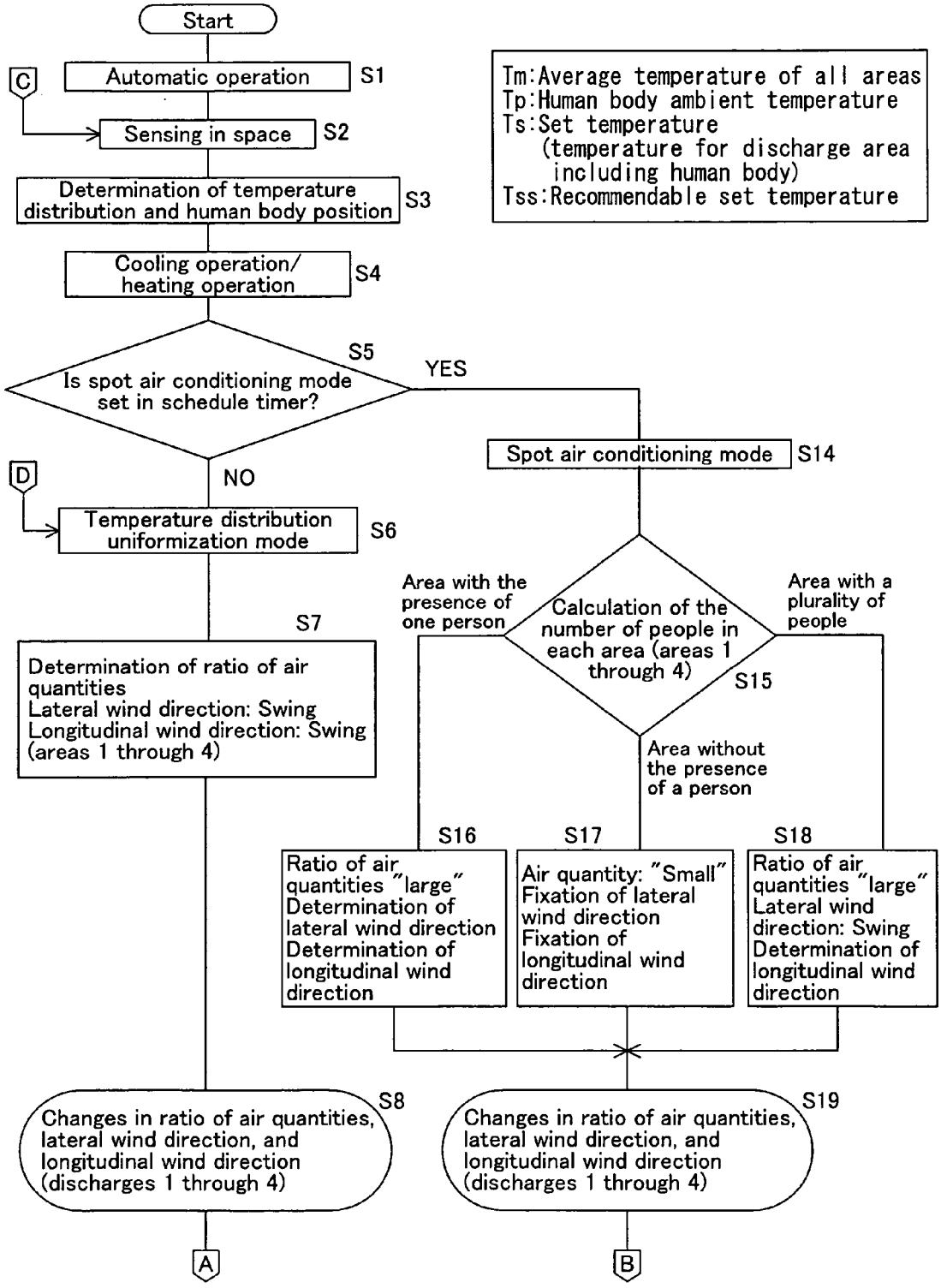
FIG. 17 is a flow chart illustrating the first half of the process of control in a fourth exemplary operational control for an overall air conditioning apparatus including an indoor unit.
Figure 18:
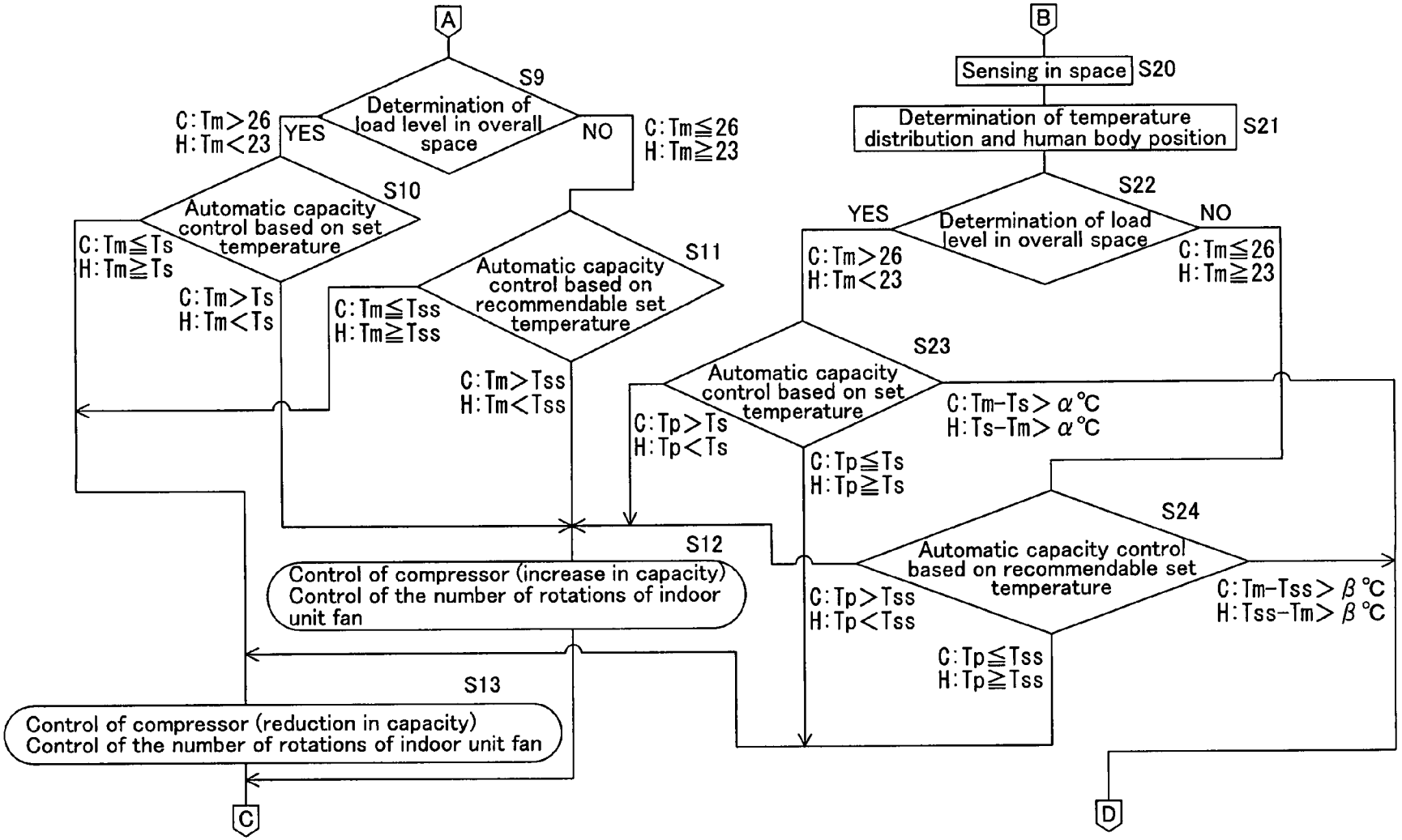
FIG. 18 is a flow chart illustrating the latter half of the process of control in the fourth exemplary operational control for an overall air conditioning apparatus including an indoor unit.

(d-4) Fourth Exemplary Control (see FIGS. 17 and 18)

The fourth exemplary control is targeted for the indoor unit Z according to the first embodiment (i.e., the indoor unit formed to include, as the detection means 51, only the infrared sensor 15). In the fourth exemplary control, the control over switching of the operational air conditioning mode between the temperature uniformization mode and the spot air conditioning mode is automatically carried out by using a schedule timer in which provision is made for each time period of a day.

An example of the schedule timer is illustrated in FIG. 28. In this example, 24 hours of a day are divided into four hour time periods, and the operational air conditioning mode is set for each time period in accordance with a living environment or a business environment in the time period. The illustrated schedule timer is intended for air conditioning of a restaurant, for example; therefore, the temperature uniformization mode is selected as the operational air conditioning mode for the time period from 12 o'clock to 16 o'clock which corresponds to mealtime, because the comings and goings of guests are frequent and a heat load from a kitchen is increased. Furthermore, since it is conceivable that the load might be increased to a certain extent during time periods prior to and subsequent to the mealtime, the temperature uniformization mode or the spot air conditioning mode is selected as the operational air conditioning mode for each of these time periods. It is also conceivable that during the other time periods, there are no comings and goings of guests or only a few guests, if any, come and go, and the load from the kitchen is small; therefore, the spot air conditioning mode is selected as the operational air conditioning mode for each of the other time periods. In other words, the schedule timer allows the switching of the operational air conditioning mode to be carried out automatically with time (elapse of time) by associating variations in the level of a load applied to the premises, i.e., space to be air-conditioned W, with the time periods of a day. Accordingly, the control after the selection of the operational air conditioning mode is carried out as in the first exemplary control.

As illustrated in the flow charts in FIGS. 17 and 18, first, "automatic operation" is selected as an operation mode after the start of the control (step S1), and then the radiation temperatures of the areas (1) through (4) are sequentially detected using the infrared sensors 15, 15, . . . (step S2). Then, based on the detected values for the areas (1) through (4), the temperature distribution in the overall space to be air-conditioned W is calculated, and the position of a human body in each of the areas (1) through (4) (i.e., a high temperature region in each area) is determined (step S3). Furthermore, at this time, a manipulation signal for cooling operation or heating operation is inputted, thus allowing the air conditioning apparatus to perform cooling operation or heating operation (step S4).

Subsequently, it is determined in step S5 whether or not the spot air conditioning mode is set in the schedule timer for the time period corresponding to the present time. In this step, if it is determined that the present time period corresponds to the time period for which the temperature uniformization mode is set, the process of the control goes to the execution of the temperature uniformization mode (step S6). On the other hand, if it is determined that the present time period corresponds to the time period for which the spot air conditioning mode is set, the process goes to the execution of the spot air conditioning mode (step S14).

When the operational air conditioning mode has been switched to the temperature uniformization mode, the operational mode of the air flow changing means 52 is first determined in order to uniformize the room temperature. To be more specific, in step S7, the ratio of air quantities from the outlets 4, 4, . . . of the indoor unit Z (i.e., the ratio of opening areas in the outlets 4, 4, . . . adjusted by the air quantity distribution mechanisms 10, 10, . . . ) is calculated, and the operational modes of the first flaps 12, 12, . . . and the second flaps 13, 13, . . . are each set at "swing". In this step, the operational modes of all the first flaps 12 and second flaps 13 are each set at "swing" because it is necessary to discharge conditioned air evenly to a wider range of the room from the outlets 4, 4, . . . .

Based on each setting made in step S7, the ratio of air quantities, lateral wind direction, and longitudinal wind direction are adjusted (step S8).

Next, the process goes to the control of the capacity of the indoor unit Z in the temperature uniformization mode. To require the indoor unit Z to provide a capacity more than necessary is undesirable from the standpoint of ensuring energy conservation. Therefore, if the indoor unit Z provides an excessive capacity, the indoor unit Z is controlled so that its capacity is reduced, and if the indoor unit Z provides an insufficient capacity, the indoor unit Z is controlled so that its capacity is increased. Specifically, the indoor unit Z is controlled as follows.

First, the load level in the overall space to be air-conditioned W is determined in step S9. To be more specific, when cooling operation is currently performed, it is determined whether the average temperature Tm of all the areas (1) through (4) inside the room is lower than, equal to or higher than 26° C., and when heating operation is currently performed, it is determined whether the average temperature Tm of all the areas (1) through (4) is lower than, equal to or higher than 23° C. It should be noted that the average temperature is determined by the average of the radiation temperatures of the areas (1) through (4) detected by the infrared sensor 15.

In this step, if it is determined that the load level is high (i.e., if the average temperature Tm is higher than 26° C. during cooling operation, or if the average temperature Tm is lower than 23° C. during heating operation), the process goes to automatic capacity control that is carried out based on a set temperature Ts (step S10). To the contrary, if it is determined that the load level is low (i.e., if the average temperature Tm is equal to or lower than 26° C. during cooling operation, or if the average temperature Tm is equal to or higher than 23° C. during heating operation), the process goes to automatic capacity control that is carried out based on a recommendable set temperature Tss (step S11).

First, in carrying out the automatic capacity control based on the set temperature Ts, a comparison is made between the current average temperature Tm and the set temperature Ts in step S10. In this step, when the average temperature Tm is equal to or lower than the set temperature Ts during cooling operation, or when the average temperature Tm is equal to or higher than the set temperature Ts during heating operation, it is determined that air conditioning capacity is excessive. In this case, the indoor unit Z is controlled so that its capacity is reduced, for example, by reducing the number of rotations of a compressor and reducing the number of rotations of the fan 6 of the indoor unit Z (step S13).

To the contrary, when the average temperature Tm is higher than the set temperature Ts during cooling operation, or when the average temperature Tm is lower than the set temperature Ts during heating operation, it is determined that air conditioning capacity is insufficient. In this case, the indoor unit Z is controlled so that its capacity is increased, for example, by increasing the number of rotations of a compressor and increasing the number of rotations of the fan 6 (step S12).

On the other hand, in carrying out the automatic capacity control based on the recommendable set temperature Tss, first, a comparison is made between the current average temperature Tm and the recommendable set temperature Tss in step S11. In this step, when the average temperature Tm is equal to or lower than the recommendable set temperature Tss during cooling operation, or when the average temperature Tm is equal to or higher than the recommendable set temperature Tss during heating operation, it is determined that air conditioning capacity is excessive. In this case, the indoor unit Z is controlled so that its capacity is reduced (step S13). To the contrary, when the average temperature Tm is higher than the recommendable set temperature Tss during cooling operation, or when the average temperature Tm is lower than the recommendable set temperature Tss during heating operation, it is determined that air conditioning capacity is insufficient. In this case, the indoor unit Z is controlled so that its capacity is increased (step S12).

The above-described operation and automatic capacity control in the temperature uniformization mode are repeatedly carried out as long as the requirements for the execution of the temperature uniformization mode are met.

On the other hand, if the answer is NO in step S5 (i.e., if it is determined that there exist, among all the areas (1) through (4), at least one or more of the areas without the presence of people), the process goes to the execution of the spot air conditioning mode (step S14).

After the operational air conditioning mode has been switched to the spot air conditioning mode, first, the number of people present in each of the areas (1) through (4) is calculated in step S15. Then, in order to realize the optimum spot air conditioning for each of the areas (1) through (4) in accordance with the number of people present in each of the areas (1) through (4), the required operational modes of the air flow changing means 52 provided in the outlets 4, 4, . . . , each associated with the corresponding one of the areas (1) through (4), are determined.

For the area with the presence of only one person, the ratio of air quantities is set at "large", and the lateral wind direction and longitudinal wind direction (i.e., the operational modes of the first flaps 12 and the second flaps 13) are determined so as to direct the discharge of conditioned air toward the position of a human body (step 16).

In addition, for the area without the presence of a person, since this area does not need air conditioning itself, the ratio of air quantities is fixed at "small" and the lateral wind direction and longitudinal wind direction are both fixed (step S17).

Furthermore, the area with the presence of a plurality of people most needs air conditioning and requires uniform air conditioning of the entire area. Therefore, for this area, the ratio of air quantities is set at "large"; in addition, to determine each discharge direction of conditioned air, the operational modes of the flaps for changing the lateral wind direction are each set at "swing", and the operational modes of the flaps for changing the longitudinal wind direction are each determined in accordance with the position of a human body (step S18).

Based on the settings made in steps S16 through S18, the ratio of air quantities, lateral wind direction, and longitudinal wind direction are adjusted (step S19).

Next, the process goes to the control of the capacity of the indoor unit Z in the spot air conditioning mode. Also in the spot air conditioning mode, to require the indoor unit Z to provide a capacity more than necessary is undesirable from the standpoint of ensuring energy conservation, as in the above-described temperature uniformization mode. Therefore, if the indoor unit Z provides an excessive capacity, the indoor unit Z is controlled so that its capacity is reduced, and if the indoor unit Z provides an insufficient capacity, the indoor unit Z is controlled so that its capacity is increased. Specifically, the indoor unit Z is controlled as follows.

First, in step S20, the infrared sensor 15 carries out detection for each of the areas (1) through (4) of the space to be air-conditioned W again, and the temperature distribution and human body position in the overall space to be air-conditioned W are determined based on pieces of the detected information (step 21).

Next, in step S22, the load level in the overall space to be air-conditioned W is determined. Specifically, if cooling operation is currently performed, it is determined whether the average temperature Tm of all the areas (1) through (4) inside the room is lower than, equal to or higher than 26° C., and if heating operation is currently performed, it is determined whether the average temperature Tm of all the areas (1) through (4) is lower than, equal to or higher than 23° C.

If it is determined that the load level is high (i.e., if the average temperature Tm is higher than 26° C. during cooling operation, or if the average temperature Tm is lower than 23° C. during heating operation), the process goes to automatic capacity control that is carried out based on a set temperature Ts (step S23). To the contrary, if it is determined that the load level is low (i.e., if the average temperature Tm is equal to or lower than 26° C. during cooling operation, or if the average temperature Tm is equal to or higher than 23° C. during heating operation), the process goes to automatic capacity control that is carried out based on a recommendable set temperature Tss (step S24).

First, in carrying out the automatic capacity control based on the set temperature Ts, a comparison is made between the current human body ambient temperature Tp and the set temperature Ts in step S23. In this step, when the human body ambient temperature Tp is equal to or lower than the set temperature Ts during cooling operation, or when the human body ambient temperature Tp is equal to or higher than the set temperature Ts during heating operation, it is determined that air conditioning capacity is excessive. In this case, the indoor unit Z is controlled so that its capacity is reduced (step S13).

To the contrary, when the human body ambient temperature Tp is higher than the set temperature Ts during cooling operation, or when the human body ambient temperature Tp is lower than the set temperature Ts during heating operation, it is determined that air conditioning capacity is insufficient. In this case, the indoor unit Z is controlled so that its capacity is increased (step S12).

Furthermore, when a difference between the average temperature Tm and the set temperature Ts is greater than a predetermined temperature $\alpha$° C. during cooling operation, or when a difference between the set temperature Ts and the average temperature Tm is greater than a predetermined temperature $\alpha$° C. during heating operation, it is deemed that the capacity control is unnecessary, and the process of the control is returned (step S23→step S6).

On the other hand, in carrying out the automatic capacity control based on the recommendable set temperature Tss, a comparison is made between the current human body ambient temperature Tp and the recommendable set temperature Tss in step S24. In this step, when the human body ambient temperature Tp is equal to or lower than the recommendable set temperature Tss during cooling operation, or when the human body ambient temperature Tp is equal to or higher than the recommendable set temperature Tss during heating operation, it is determined that air conditioning capacity is excessive. In this case, the indoor unit Z is controlled so that its capacity is reduced (step S13).

To the contrary, when the human body ambient temperature Tp is higher than the recommendable set temperature Tss during cooling operation, or when the human body ambient temperature Tp is lower than the recommendable set temperature Tss during heating operation, it is determined that air conditioning capacity is insufficient. In this case, the indoor unit Z is controlled so that its capacity is increased (step S12).

Furthermore, when a difference between the average temperature Tm and the set temperature Ts is greater than a predetermined temperature $\beta$° C. during cooling operation, or when a difference between the set temperature Ts and the average temperature Tm is greater than a predetermined temperature $\beta$° C. during heating operation, it is deemed that the capacity control is unnecessary, and the process of the control is returned (step S24→step S6).

The above-described operation and automatic capacity control in the spot air conditioning mode are repeatedly carried out as long as the requirements for the execution of the spot air conditioning mode are met.

Figure 19:
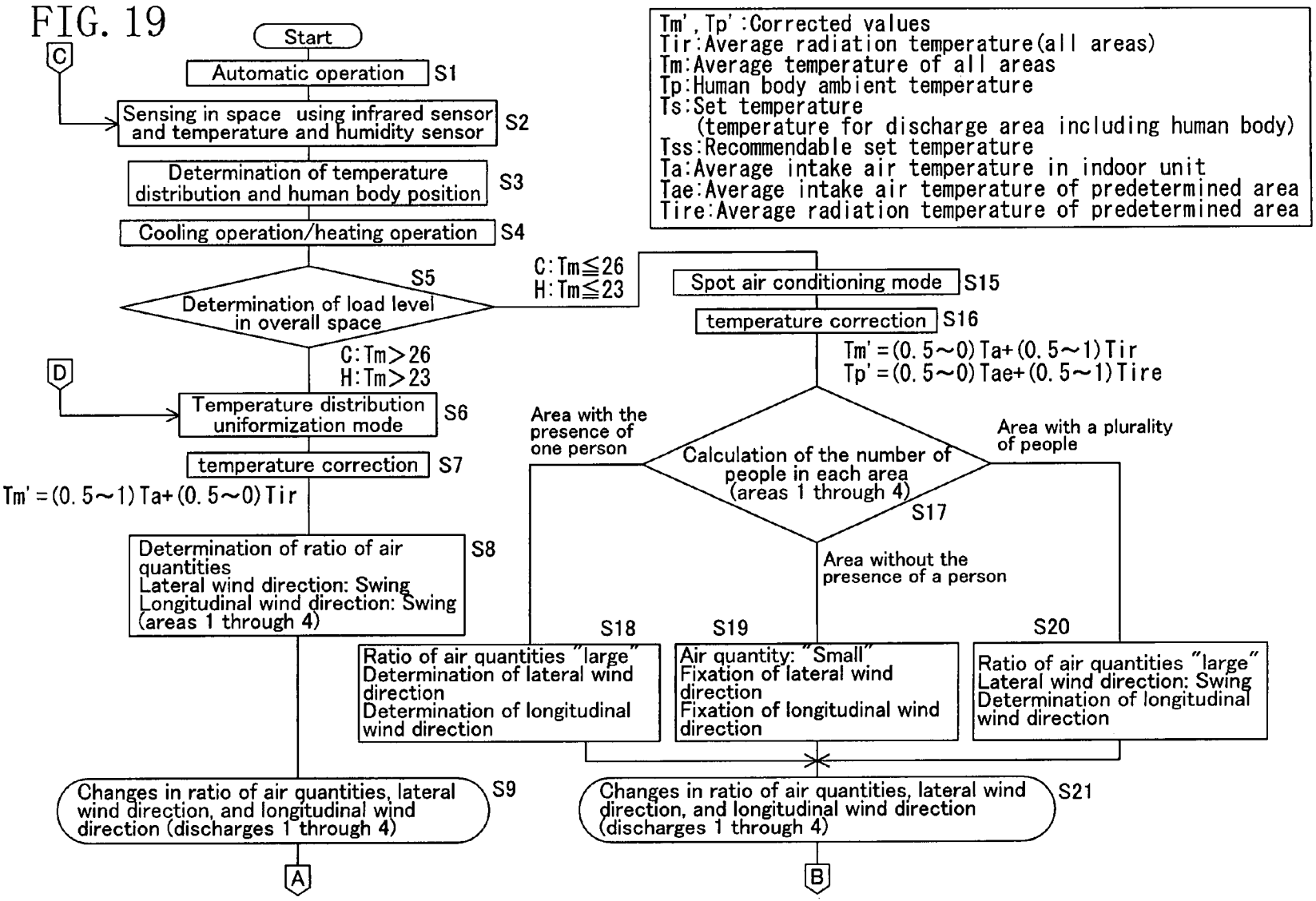
FIG. 19 is a flow chart illustrating the first half of the process of control in a fifth exemplary operational control for an overall air conditioning apparatus including an indoor unit.
Figure 20:
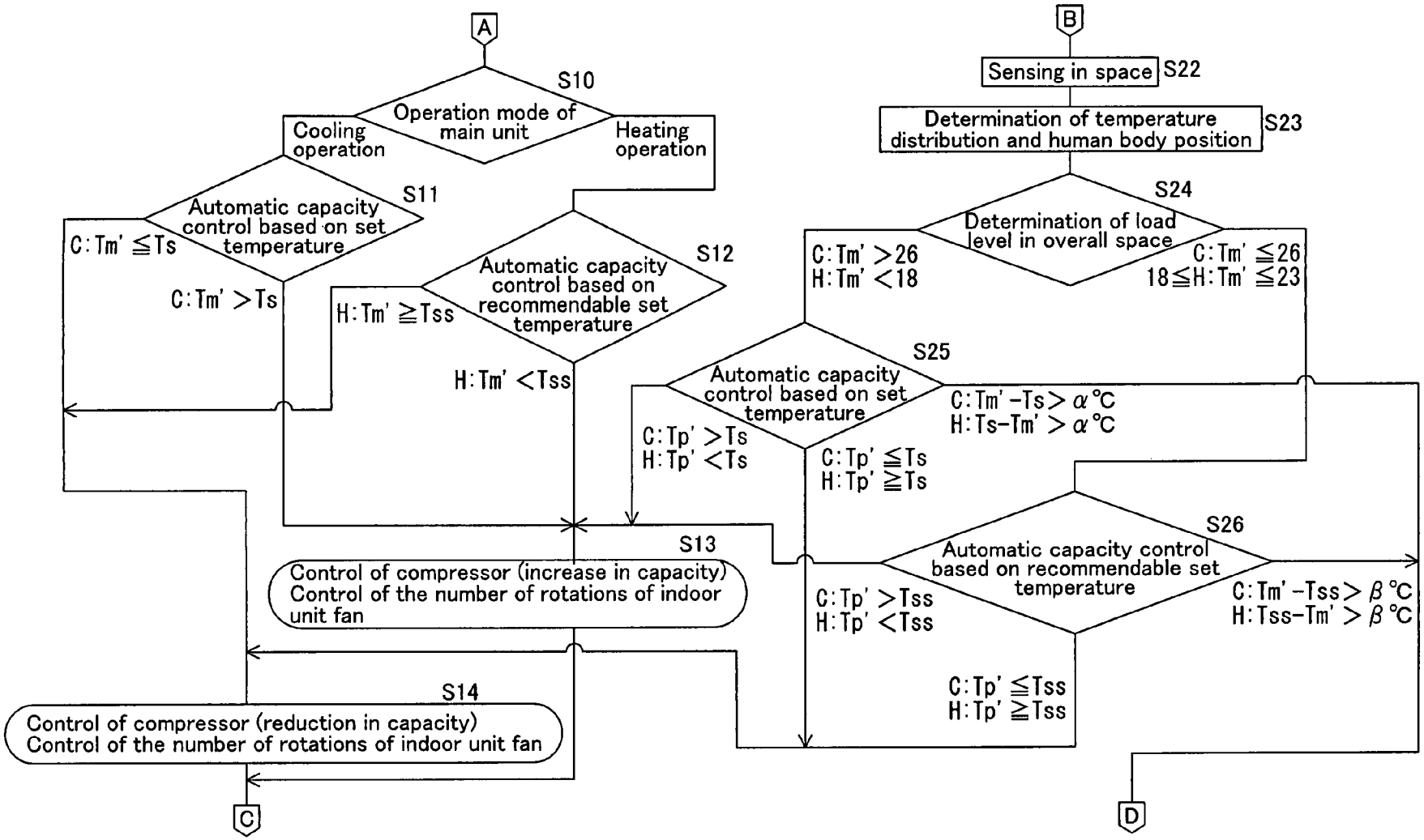
FIG. 20 is a flow chart illustrating the latter half of the process of control in the fifth exemplary operational control for an overall air conditioning apparatus including an indoor unit.

(d-5) Fifth Exemplary Control (see FIGS. 19 and 20)

The fifth exemplary control is targeted for the indoor unit Z according to the second embodiment (i.e., the indoor unit formed to include, as the detection means 51, the infrared sensor 15 and the temperature and humidity sensor 16). In the fifth exemplary control, the control over switching of the operational air conditioning mode between the temperature uniformization mode and the spot air conditioning mode is automatically carried out based on whether the load level in the overall space to be air-conditioned W is high or low. Furthermore, this exemplary control differs from the other exemplary control in that each radiation temperature detected by the infrared sensor 15 is not employed as it is when determining the average temperature Tm of the space to be air-conditioned W, which serves as the criterion for determining the automatic capacity control. In the fifth exemplary control, values detected by the infrared sensor 15 and values detected by the temperature and humidity sensor 16 are each assigned a predetermined weight to determine a value that more precisely indicates the temperature environment of the space to be air-conditioned W, and this value is employed as the measurement temperature of the space to be air-conditioned W, thus making it possible to further promote the comfort of air conditioning and energy conservation.

Specifically, as illustrated in the flow charts in FIGS. 19 and 20, first, "automatic operation" is selected as an operation mode after the start of the control (step S1), and then the process of the control goes to step S2.

Next, in step S2, the radiation temperature and high temperature region (i.e., human body position) of each of the areas (1) through (4) are detected by the infrared sensor 15, and the temperature of an intake air from each of the areas (1) through (4) is detected by the associated temperature and humidity sensors 16, 16, . . . . Then, based on pieces of the detected information, the temperature distribution and human body position, for example, in the overall space to be air-conditioned W are determined (step S3).

Thereafter, in step S4, an operation signal for cooling operation or heating operation is inputted, and the air conditioning apparatus is allowed to start cooling operation or heating operation in response to the inputted signal (step S4).

Subsequently, in step S5, the load level in the overall space to be air-conditioned W is determined, and the determination result is employed as the criterion for switching the operational air conditioning mode. It should be noted that the load level in the overall space to be air-conditioned W is determined by making a comparison between the average temperature Tm of the overall space to be air-conditioned W and reference temperature. Furthermore, the average temperature Tm is determined by the average of the radiation temperatures of the areas (1) through (4) detected by the infrared sensor 15.

Specifically, in step S5, when cooling operation is performed, it is determined whether the average temperature Tm is lower than, equal to or higher than 26° C., and when heating operation is performed, it is determined whether the average temperature Tm is lower than, equal to or higher than 23° C. More specifically, when it is determined that the average temperature Tm is higher than 26° C. during cooling operation, or when it is determined that the average temperature Tm is higher than 23° C. during heating operation, the process goes to the execution of the temperature uniformization mode (step S6). To the contrary, when it is determined that the average temperature Tm is equal to or lower than 26° C. during cooling operation, or when it is determined that the average temperature Tm is equal to or lower than 23° C. during heating operation, the process goes to the execution of the spot air conditioning mode (step S15).

In the former case, the average temperature Tm in the space to be air-conditioned W is high, i.e., a lot of people are present in the space to be air-conditioned W, and therefore, there is a great need for the uniformization of the temperature of the overall space to be air-conditioned W. To the contrary, in the latter case, the average temperature Tm in the space to be air-conditioned W is low, i.e., only a few people are present in the space to be air-conditioned W. Therefore, it is more economical to provide spot air conditioning to the surroundings of people than to provide air conditioning to the overall space to be air-conditioned W.

After the operational air conditioning mode has been switched to the temperature uniformization mode (step S6), first, the average temperature Tm of the overall space to be air-conditioned W is weighted to carry out temperature correction. Normally, employed as the average temperature Tm is either an average radiation temperature Tir determined based on information detected by the infrared sensor 15, or an average intake air temperature Ta determined based on information detected by the temperature and humidity sensor 16. However, the temperature uniformization mode is not targeted for air conditioning of each human body itself but targeted for air conditioning of the overall space to be air-conditioned W so that the temperature thereof becomes uniform; therefore, it is preferable that the average temperature Tm is calculated with weight placed on the average intake air temperature Ta rather than the average radiation temperature Tir that is more likely to vary with the presence of a human body.

In consideration of the above-described points, in this exemplary control, a weight factor for the average intake air temperature Ta is (0.5~1) and a weight factor for the average radiation temperature Tir is (0.5~0) so that a corrected average temperature Tm' is determined by the following equation, Tm'=(0.5~1) Ta+(0.5~0) Tir. The corrected average temperature Tm' is employed as the measurement temperature of the space to be air-conditioned W and is reflected in the automatic capacity control described below.

Next, in step S8, the ratio of air quantities from the outlets 4, 4, . . . of the indoor unit Z (i.e., the ratio of opening areas in the outlets 4, 4, . . . adjusted by the air quantity distribution mechanisms 10, 10, . . . ) is calculated, and furthermore, the operational modes of the first flaps 12, 12, . . . and the second flaps 13, 13, . . . are each set at "swing". In this step, the operational modes of all the first flaps 12 and second flaps 13 are each set at "swing" because it is necessary to discharge conditioned air evenly to a wider range of the room from the outlets 4, 4, . . . .

Based on each setting made in step S7, the ratio of air quantities, lateral wind direction, and longitudinal wind direction are adjusted (step S9).

Thereafter, the process goes to the control of the capacity of the indoor unit Z in the temperature uniformization mode. To require the indoor unit Z to provide a capacity more than necessary is undesirable from the standpoint of ensuring energy conservation. Therefore, if the indoor unit Z provides an excessive capacity, the indoor unit Z is controlled so that its capacity is reduced, and if the indoor unit Z provides an insufficient capacity, the indoor unit Z is controlled so that its capacity is increased. Specifically, the indoor unit Z is controlled as follows.

First, it is determined in step S10 whether the operation mode of the main unit of the air conditioning apparatus is a cooling mode or a heating mode. If the operation mode is the cooling mode, the process goes to automatic capacity control that is carried out based on a set temperature (step 11), and if the operation mode is the heating mode, the process goes to automatic capacity control that is carried out based on a recommendable set temperature (step S12). In step S10, the selection of the mode of the automatic capacity control is carried out based on the operation mode of the main unit because of the following reasons. The average temperature Tm of the space to be air-conditioned W is high in the temperature uniformization mode; therefore, air conditioning is preferably performed at the set temperature during cooling operation since the load level is high, while air conditioning is preferably performed at the recommendable set temperature during heating operation since the load level is low.

In carrying out the automatic capacity control based on the set temperature, first, a comparison is made between the corrected average temperature Tm' and the set temperature Ts in step S11. In this step, when the corrected average temperature Tm' is equal to or lower than the set temperature Ts, it is determined that air conditioning capacity is excessive. In this case, the indoor unit Z is controlled so that its capacity is reduced, for example, by reducing the number of rotations of a compressor and reducing the number of rotations of the fan 6 of the indoor unit Z (step S14).

To the contrary, when the corrected average temperature Tm' is higher than the set temperature Ts, it is determined that air conditioning capacity is insufficient. In this case, the indoor unit Z is controlled so that its capacity is increased, for example, by increasing the number of rotations of a compressor and increasing the number of rotations of the fan 6 (step S13).

On the other hand, in carrying out the automatic capacity control based on the recommendable set temperature Tss, first, a comparison is made between the current corrected average temperature Tm' and the recommendable set temperature Tss in step S12. Then, when the corrected average temperature Tm' is equal to or higher than the recommendable set temperature Tss, it is determined that air conditioning capacity is excessive. In this case, the indoor unit Z is controlled so that its capacity is reduced (step S14). To the contrary, when the corrected average temperature Tm' is lower than the recommendable set temperature Tss, it is determined that air conditioning capacity is insufficient. In this case, the indoor unit Z is controlled so that its capacity is increased (step S13).

The above-described operation and automatic capacity control in the temperature uniformization mode are repeatedly carried out as long as the requirements for the execution of the temperature uniformization mode are met.

On the other hand, if the spot air conditioning mode has been selected in step S5, the process goes to the execution of the spot air conditioning mode (step S15).

After the operational air conditioning mode has been switched to the spot air conditioning mode, first, the average temperature Tm of the overall space to be air-conditioned W and human body ambient temperature Tp are each weighted to carry out temperature correction. Normally, employed as the average temperature Tm is either an average radiation temperature Tir determined based on information detected by the infrared sensor 15, or an average intake air temperature Ta determined based on information detected by the temperature and humidity sensor 16. However, the spot air conditioning mode is not targeted for air conditioning of the overall space to be air-conditioned W but targeted for air conditioning of the surroundings of each human body present in the space; therefore, it is preferable that the average temperature Tm is calculated with weight placed on, rather than the average intake air temperature Ta, the average radiation temperature Tir that is more likely to vary with the presence of a human body.

In consideration of the above-described points, in this exemplary control, as for a corrected average temperature Tm', a weight factor for the average intake air temperature Ta is (0.5~0) and a weight factor for the average radiation temperature Tir is (0.5~1) so that the corrected average temperature Tm' is determined by the following equation, Tm'=(0.5~0) Ta+(0.5~1) Tir. On the other hand, as for a corrected human body ambient temperature Tp', a weight factor for the average intake air temperature Tae of a predetermined area is (0.5~0) and a weight factor for the average radiation temperature Tire of the predetermined area is (0.5~1) so that the corrected human body ambient temperature Tp' is determined by the following equation, Tp'=(0.5~0) Tae+(0.5~1) Tire. Furthermore, the corrected values are each employed as the measurement temperature of the space to be air-conditioned W and reflected in the automatic capacity control described below.

Next, the number of people present in each of the areas (1) through (4) is calculated in step S17. In order to realize the optimum spot air conditioning for each of the areas (1) through (4) in accordance with the number of people present in each of the areas (1) through (4), the required operational modes of the air flow changing means 52 provided in the outlets 4, 4, . . . , each associated with the corresponding one of the areas (1) through (4), are determined.

Specifically, for the area with the presence of only one person, the ratio of air quantities is set at "large", and the lateral wind direction and longitudinal wind direction (i.e., the operational modes of the first flaps 12 and the second flaps 13) are determined so as to direct the discharge of conditioned air toward the position of a human body (step 18).

Besides, for the area without the presence of a person, since this area does not need air conditioning itself, the ratio of air quantities is fixed at "small" and the lateral wind direction and longitudinal wind direction are both fixed (step S19).

Furthermore, the area with the presence of a plurality of people most needs air conditioning and requires uniform air conditioning of the entire area. Therefore, for this area, the ratio of air quantities is set at "large"; in addition, to determine each discharge direction of conditioned air, the operational modes of the flaps for changing the lateral wind direction are each set at "swing", and the operational modes of the flaps for changing the longitudinal wind direction are each determined in accordance with the position of a human body (step S20).

Based on the settings made in steps S18 through S20, the ratio of air quantities, lateral wind direction, and longitudinal wind direction are adjusted (step S21).

Next, the process goes to the control of the capacity of the indoor unit Z in the spot air conditioning mode. Also in the spot air conditioning mode, to require the indoor unit Z to provide a capacity more than necessary is undesirable from the standpoint of ensuring energy conservation, as in the above-described temperature uniformization mode. Therefore, if the indoor unit Z provides an excessive capacity, the indoor unit Z is controlled so that its capacity is reduced, and if the indoor unit Z provides an insufficient capacity, the indoor unit Z is controlled so that its capacity is increased. Furthermore, if the states of the excessive capacity and insufficient capacity are within a predetermined range and are too negligible to carry out control, the process of the control is returned without carrying out any capacity control. Specifically, the following steps are performed.

First, in step S22, the infrared sensor 15 and the temperature and humidity sensor 16 carry out detection for each of the areas (1) through (4) of the space to be air-conditioned W again, and then the temperature distribution and human body position in the overall space to be air-conditioned W are determined based on pieces of the detected information (step 23).

Next, in step S24, the load level in the overall space to be air-conditioned W is determined. To be more specific, if cooling operation is currently performed, it is determined whether the average temperature Tm of all the areas (1) through (4) inside the room is lower than, equal to or higher than 26° C. On the other hand, if heating operation is currently performed, it is determined whether the average temperature Tm is in the range of 18° C. to 23° C. or lower than 18° C.

If it is determined that the load level is high (i.e., if the average temperature Tm is higher than 26° C. during cooling operation, or if the average temperature Tm is lower than 18° C. during heating operation), the process goes to automatic capacity control that is carried out based on a set temperature Ts (step S25). To the contrary, if it is determined that the load level is low (i.e., if the average temperature Tm is equal to or lower than 26° C. during cooling operation, or if the average temperature Tm is in the rage of 18° C. to 23° C. during heating operation), the process goes to automatic capacity control that is carried out based on a recommendable set temperature Tss (step S26).

First, in carrying out the automatic capacity control based on the set temperature Ts, a comparison is made between the current corrected human body ambient temperature Tp' and the set temperature Ts in step S25. In this step, when the corrected human body ambient temperature Tp' is equal to or lower than the set temperature Ts during cooling operation, or when the corrected human body ambient temperature Tp' is equal to or higher than the set temperature Ts during heating operation, it is determined that air conditioning capacity is excessive. In this case, the indoor unit Z is controlled so that its capacity is reduced (step S14).

To the contrary, when the corrected human body ambient temperature Tp' is higher than the set temperature Ts during cooling operation, or when the corrected human body ambient temperature Tp' is lower than the set temperature Ts during heating operation, it is determined that air conditioning capacity is insufficient. In this case, the indoor unit Z is controlled so that its capacity is increased (step S13).

Furthermore, when a difference between the corrected average temperature Tm' and the set temperature Ts is greater than a predetermined temperature α° C. during cooling operation, or when a difference between the set temperature Ts and the corrected average temperature Tm' is greater than a predetermined temperature α° C. during heating operation, it is deemed that the capacity control is unnecessary, and the process of the control is returned (step S25→step S6).

On the other hand, in carrying out the automatic capacity control based on the recommendable set temperature Tss, a comparison is made between the current corrected human body ambient temperature Tp' and the recommendable set temperature Tss in step S24. In this step, when the corrected human body ambient temperature Tp' is equal to or lower than the recommendable set temperature Tss during cooling operation, or when the corrected human body ambient temperature Tp' is equal to or higher than the recommendable set temperature Tss during heating operation, it is determined that air conditioning capacity is excessive. In this case, the indoor unit Z is controlled so that its capacity is reduced (step S14).

To the contrary, when the corrected human body ambient temperature Tp' is higher than the recommendable set temperature Tss during cooling operation, or when the corrected human body ambient temperature Tp' is lower than the recommendable set temperature Tss during heating operation, it is determined that air conditioning capacity is insufficient. In this case, the indoor unit Z is controlled so that its capacity is increased (step S13).

Furthermore, when a difference between the corrected average temperature Tm' and the set temperature Ts is greater than a predetermined temperature β° C. during cooling operation, or when a difference between the set temperature Ts and the corrected average temperature Tm' is greater than a predetermined temperature β° C. during heating operation, it is deemed that the capacity control is unnecessary, and the process of the control is returned (step S26→step S6).

The above-described operation and automatic capacity control in the spot air conditioning mode are repeatedly carried out as long as the requirements for the execution of the spot air conditioning mode are met.

INDUSTRIAL APPLICABILITY

As described above, the air conditioning apparatus according to the present invention is not only useful as an air conditioning apparatus of the type in which its indoor unit is embedded in a ceiling or hung from a ceiling, but also particularly suitable for air conditioning of a relatively large space.

The invention claimed is:

1. An air conditioning apparatus comprising:

an indoor panel (2) that is disposed at the bottom side of a ceiling (50), and is provided with an inlet (3) and a plurality of outlets (4, 4, . . . ) rectangularly surrounding the periphery of the inlet (3);

detection means (51) comprising an infrared sensor (15) for detecting as a radiation temperature the temperature of an object in a space to be air-conditioned (W);

air flow changing means (52) for changing the characteristic of an air flow discharged from each of the outlets (4, 4, . . . ); and control means (53) for controlling the operation of the air flow changing means (52) based on detection information detected by the detection means (51) and operation information concerning the operation of the air conditioning apparatus, wherein an operational air conditioning mode of the air conditioning apparatus is selectively switched between a temperature uniformization mode in which temperature distribution in the space to be air-conditioned (W) is uniformized, and a spot air conditioning mode in which the surroundings of a human body (M) present in the space to be air-conditioned (W) are intensively air-conditioned, the operational air conditioning mode being switched automatically by the control means (53) or manually.

2. The air conditioning apparatus of claim 1, wherein the operational air conditioning mode is switched automatically by the control means (53), and wherein the space to be air-conditioned (W) is divided into a plurality of areas, and the operational air conditioning mode is set to the temperature uniformization mode when it is detected by the detection means (51) that the percentage of the area with the presence of a human body (M) to the plurality of areas is above a predetermined level, while the operational air conditioning mode is set to the spot air conditioning mode when it is detected by the detection means (51) that the percentage is below the predetermined level.

3. The air conditioning apparatus of claim 1, wherein the operational air conditioning mode is switched automatically by the control means (53), and wherein the operational air conditioning mode is switched to the temperature uniformization mode when it is detected by the detection means (51) that the level of a load applied to the overall space to be air-conditioned (W) is above a predetermined level, while the operational air conditioning mode is switched to the spot air conditioning mode when it is detected by the detection means (51) that the load level is below the predetermined level.

4. The air conditioning apparatus of claim 1, wherein the operational air conditioning mode is continuously set to the temperature uniformization mode during a predetermined time period subsequent to the start of air conditioning operation or the switching of the operational air conditioning mode, and after the predetermined time period has been elapsed, the control over the switching of the operational air conditioning mode is carried out based on the detection information detected by the detection means (51).

5. The air conditioning apparatus of claim 1, wherein the switching of the operational air conditioning mode is executed based on each time period of a day.

6. The air conditioning apparatus of claim 1, wherein the control of air conditioning capacity is carried out based on the temperature of radiation emitted from an object in a predetermined area which is detected by the detection means (51), and a set temperature that has been set in advance.

7. The air conditioning apparatus of claim 6, wherein a recommendable set temperature is used instead of the set temperature depending on the load level detected by the detection means (51).

8. The air conditioning apparatus of claim 1, wherein the detection means (51) further comprises, in addition to the infrared sensor (15), a temperature and humidity sensor (16) for detecting the temperature of an intake air taken into the inlet (3).

9. The air conditioning apparatus of claim 8, wherein the infrared sensor (15) is formed to detect the position of a human body in the space to be air-conditioned (W), and wherein the temperature and humidity sensor (16) is formed to detect the temperature of an intake air.

10. The air conditioning apparatus of claim 9, wherein a plurality of the temperature and humidity sensors (16) are provided so that each temperature and humidity sensor (16) detects the temperature of an intake air from an associated one of the areas of the space to be air-conditioned (W), wherein the radiation temperature from each of the areas detected by the infrared sensor (15) and the intake air temperature from each of the areas detected by the associated one of the temperature and humidity sensors (16, 16, . . . ) are each assigned a predetermined weight and are summed to determine the measurement temperature of each of the areas, and wherein the weight assignment to the radiation temperature and the intake air temperature are made such that the weight assigned to the intake air temperature is increased in the temperature uniformization mode, and the weight assigned to the radiation temperature is increased in the spot air conditioning mode.

11. The air conditioning apparatus of claim 1, wherein the air flow changing means (52) comprises: an air quantity distribution mechanism (10) for changing the ratio of distribution of air quantities discharged from the outlets (4, 4, . . . ); a first flap (12) for changing the lateral discharge direction of an air flow discharged from the associated outlet (4); and a second flap (13) for changing the longitudinal discharge direction of the air flow discharged from the associated outlet (4), and wherein the air quantity distribution mechanism (10), the first flap (12) and the second flap (13) associated with each of the outlets (4, 4, . . . ) are formed so that they are operable independently and separately from their counterparts.

12. The air conditioning apparatus of claim 1, wherein the air flow changing means (52) comprises: an air quantity distribution mechanism (10) for changing the ratio of distribution of air quantities discharged from the outlets (4, 4, . . . ); a first flap (12) for changing the lateral discharge direction of an air flow discharged from the associated outlet (4); and a second flap (13) for changing the longitudinal discharge direction of the air flow discharged from the associated outlet (4), wherein the air quantity distribution mechanism (10) and the first flap (12) associated with each of the outlets (4, 4, . . . ) are formed so that they are operable independently and separately from their counterparts, and wherein the second flap (13) associated with each the outlets (4, 4, . . . ) is formed to operate together with its counterpart.

13. The air conditioning apparatus of claim 11 or 12, wherein the air quantity distribution mechanism (10) and the first flap (12) are each provided in an upstream region of a discharge duct (14) continuous with the outlet (4), and wherein a driving mechanism (29) for the air quantity distribution mechanism (10) and a driving mechanism (30) for the first flap (12) are provided at respective longitudinal ends of the discharge duct (14).

14. The air conditioning apparatus of claim 13, wherein the air quantity distribution mechanism (10) comprises a distribution shutter (11) attached so that the shutter (11) is allowed to assume a position adjacent to a side wall of the discharge duct (14) extending in a longitudinal direction thereof, and to tilt toward an inward region of the discharge duct (14), and wherein the distribution shutter (11) is formed to assume a position adjacent to the longitudinally extending side wall of the discharge duct (14) when the area of an opening of the discharge duct (14) is increased, and to assume a position at an upstream side region of the discharge duct (14) when the area of the opening is reduced.

* * * * *